US007827761B2

(12) United States Patent
Buchanan et al.

(10) Patent No.: US 7,827,761 B2
(45) Date of Patent: Nov. 9, 2010

(54) PLASTIC SPACER STOCK, PLASTIC SPACER FRAME AND MULTI-SHEET UNIT, AND METHOD OF MAKING SAME

(75) Inventors: Michael Buchanan, Cranberry Township, PA (US); Mehran Arbab, Pittsburgh, PA (US); Stephen L. Crandell, Cranberry Township, PA (US); William B. Davis, Fom Bell, PA (US); Barent A. Rosskamp, Butler, PA (US); William R. Siskos, Delmont, PA (US); Cory D. Steffek, Evanston, IL (US)

(73) Assignee: PPG Industries Ohio, Inc., Cleveland, OH (US)

( * ) Notice: Subject to any disclaimer, the term of this patent is extended or adjusted under 35 U.S.C. 154(b) by 869 days.

(21) Appl. No.: 11/696,406

(22) Filed: Apr. 4, 2007

(65) Prior Publication Data

US 2007/0261359 A1 Nov. 15, 2007

Related U.S. Application Data

(63) Continuation-in-part of application No. 10/874,435, filed on Jun. 23, 2004, now Pat. No. 7,588,653, and a continuation-in-part of application No. 10/874,503, filed on Jun. 23, 2004, now Pat. No. 7,765,769, and a continuation-in-part of application No. 10/874,682, filed on Jun. 23, 2004, now Pat. No. 7,490,445, and a continuation-in-part of application No. 10/874,721, filed on Jun. 23, 2004.

(60) Provisional application No. 60/480,621, filed on Jun. 23, 2003, provisional application No. 60/839,399, filed on Aug. 22, 2006.

(51) Int. Cl.
*E04C 2/54* (2006.01)

(52) U.S. Cl. ..... 52/786.13

(58) Field of Classification Search ..... 52/204.57, 52/204.58, 204.595, 631, 656.5, 656.6, 656.9, 52/786.1
See application file for complete search history.

(56) References Cited

U.S. PATENT DOCUMENTS 2,064,530 A 12/1936 Gelstharp et al. ..... 20/56.5

(Continued)

FOREIGN PATENT DOCUMENTS

BE 1012746 A3 6/2001

(Continued)

OTHER PUBLICATIONS

PCT Application No. US2007/075071, filed Aug. 2, 2007.

(Continued)

*Primary Examiner*—Brian E Glessner
*Assistant Examiner*—Patrick Maestri
(74) *Attorney, Agent, or Firm*—Andrew C. Siminerio

(57) ABSTRACT

The present invention provides spacer stock for making a spacer frame for a multi-sheet unit. The spacer stock includes a first supporting surface; a second supporting surface opposite to, and facing away from, the first supporting surface; a base surface between and connecting the first and second supporting surfaces, and wherein the first and second supporting surfaces and base surface are made of plastic and rate of moisture and/or gas movement through portions of the first and second supporting surfaces is greater than the rate of moisture and/or gas movement, respectively through the base surface.

14 Claims, 26 Drawing Sheets

U.S. PATENT DOCUMENTS

| | | | | | |
|---|---|---|---|---|---|
| 2,497,515 | A | | 2/1950 | Pearse | 189/77 |
| 3,238,685 | A | | 3/1966 | Emory | 52/502 |
| 3,758,996 | A | | 9/1973 | Bowser | 52/172 |
| 3,890,754 | A | * | 6/1975 | Spurdle | 52/631 |
| 3,919,023 | A | | 11/1975 | Bowser et al. | 156/107 |
| 4,149,348 | A | | 4/1979 | Pyzewski | 52/172 |
| 4,170,460 | A | | 10/1979 | Donley | 65/30 R |
| 4,239,816 | A | | 12/1980 | Breininger et al. | 427/168 |
| 4,357,744 | A | * | 11/1982 | McKenzie et al. | 29/451 |
| 4,462,884 | A | | 7/1984 | Gillery et al. | 204/192 C |
| 4,513,546 | A | * | 4/1985 | Gow | 52/172 |
| 4,520,611 | A | | 6/1985 | Shingu et al. | 52/789 |
| 4,562,677 | A | * | 1/1986 | Hrabak | 52/211 |
| 4,564,540 | A | | 1/1986 | Davies et al. | |
| 4,610,711 | A | | 9/1986 | Matesa et al. | 65/134 |
| 4,628,582 | A | | 12/1986 | Leopold | 29/451 |
| 4,649,685 | A | | 3/1987 | Wolf et al. | 52/398 |
| 4,652,472 | A | | 3/1987 | Davies | |
| 4,692,389 | A | | 9/1987 | Gillery et al. | 428/622 |
| 4,719,127 | A | | 1/1988 | Greenberg | 427/165 |
| 4,780,164 | A | | 10/1988 | Rueckheim et al. | 156/104 |
| 4,792,536 | A | | 12/1988 | Pecoraro et al. | 501/70 |
| 4,806,220 | A | | 2/1989 | Finley | 204/192.27 |
| 4,853,256 | A | | 8/1989 | Obringer et al. | 427/152 |
| 4,873,206 | A | | 10/1989 | Jones | 501/71 |
| 4,898,789 | A | | 2/1990 | Finley | 428/623 |
| 4,937,996 | A | * | 7/1990 | Karlsson | 52/658 |
| 4,952,430 | A | | 8/1990 | Bowser et al. | 428/34 |
| 4,994,315 | A | | 2/1991 | Schreiber et al. | 428/76 |
| 5,030,593 | A | | 7/1991 | Heithoff | 501/72 |
| 5,088,258 | A | | 2/1992 | Schield et al. | 52/398 |
| 5,099,626 | A | | 3/1992 | Seeger | 52/314 |
| 5,107,655 | A | | 4/1992 | Lindgren | |
| 5,177,916 | A | | 1/1993 | Misera et al. | 52/172 |
| 5,240,886 | A | | 8/1993 | Gulotta et al. | 501/70 |
| 5,255,481 | A | * | 10/1993 | Misera et al. | 52/172 |
| 5,313,761 | A | | 5/1994 | Leopold | 52/788 |
| 5,345,743 | A | | 9/1994 | Baier | 52/455 |
| 5,531,047 | A | | 7/1996 | Leopold et al. | 52/172 |
| 5,553,440 | A | | 9/1996 | Bulger et al. | 52/786.13 |
| 5,564,631 | A | | 10/1996 | Leopold | 239/135 |
| 5,593,929 | A | | 1/1997 | Krumwiede et al. | 501/70 |
| 5,617,699 | A | | 4/1997 | Thompson, Jr. | 52/786.13 |
| 5,644,894 | A | | 7/1997 | Hudson | 52/786.13 |
| 5,653,073 | A | | 8/1997 | Palmer | 52/204.593 |
| 5,655,280 | A | | 8/1997 | McCommon | 29/243.518 |
| 5,655,282 | A | | 8/1997 | Hodek et al. | 29/469.5 |
| 5,675,944 | A | | 10/1997 | Kerr et al. | 52/172 |
| 5,720,836 | A | | 2/1998 | Gallagher et al. | 156/109 |
| 5,851,609 | A | | 12/1998 | Baratuci et al. | 428/34 |
| 5,873,203 | A | | 2/1999 | Thiel | 52/172 |
| 6,027,766 | A | | 2/2000 | Greenberg et al. | 427/226 |
| 6,055,783 | A | | 5/2000 | Guhl et al. | 52/204.62 |
| 6,061,994 | A | | 5/2000 | Goer et al. | 52/786.13 |
| 6,115,989 | A | | 9/2000 | Boone et al. | 52/786.13 |
| 6,159,616 | A | | 12/2000 | Planeta et al. | 428/518 |
| 6,192,652 | B1 | | 2/2001 | Goer et al. | 52/786.13 |
| 6,209,269 | B1 | | 4/2001 | Valderrama | |
| 6,218,024 | B1 | | 4/2001 | Tamber et al. | 428/520 |
| 6,250,026 | B1 | | 6/2001 | Thompson, Jr. | 52/172 |
| 6,289,641 | B1 | | 9/2001 | McCandless | 52/172 |
| 6,339,909 | B1 | | 1/2002 | Brunnhofer et al. | 52/786.13 |
| 6,355,328 | B1 | | 3/2002 | Baratuci et al. | 428/68 |
| 6,401,428 | B1 | | 6/2002 | Glover et al. | 52/786.13 |
| 6,463,706 | B1 | | 10/2002 | Guhl et al. | 52/204.62 |
| 6,528,131 | B1 | | 3/2003 | Lafond | 428/34 |
| 6,536,182 | B2 | | 3/2003 | France | |
| 6,581,341 | B1 | | 6/2003 | Baratuci et al. | 52/204.5 |
| 6,662,523 | B2 | | 12/2003 | Hornung et al. | 52/786.13 |
| 6,762,240 | B2 | | 7/2004 | Swarup et al. | 524/560 |
| 6,841,641 | B2 | | 1/2005 | Olson et al. | 526/328.5 |
| 6,868,648 | B2 | | 3/2005 | Glover et al. | 52/786.13 |
| 6,877,292 | B2 | | 4/2005 | Baratuci et al. | 52/786.13 |
| 6,889,480 | B2 | | 5/2005 | Guhl et al. | 52/786.13 |
| 6,974,518 | B2 | | 12/2005 | Hornung et al. | |
| 7,001,952 | B2 | | 2/2006 | Faler et al. | 525/185 |
| 2003/0084622 | A1 | | 5/2003 | Hornung et al. | 52/172 |
| 2004/0123557 | A1 | | 7/2004 | Hornung et al. | |
| 2004/0231255 | A1 | | 11/2004 | Silverman | 52/204.6 |
| 2005/0028458 | A1 | | 2/2005 | Rosskamp et al. | 52/172 |
| 2005/0028459 | A1 | | 2/2005 | Crandell et al. | 52/204.5 |
| 2005/0028460 | A1 | | 2/2005 | Steffek et al. | 52/204.5 |
| 2005/0034386 | A1 | | 2/2005 | Crandell et al. | 52/204.5 |
| 2007/0261325 | A1 | | 11/2007 | Rosskamp et al. | 52/203 |
| 2007/0261358 | A1 | | 11/2007 | Davis et al. | 52/658 |
| 2007/0261795 | A1 | | 11/2007 | Rosskamp et al. | 156/556 |

FOREIGN PATENT DOCUMENTS

| | | | |
|---|---|---|---|
| DE | 33 19 787 | A1 | 12/1984 |
| EP | 0 763 645 | A1 | 3/1997 |
| EP | 1055795 | | 11/2000 |
| FR | 2 455 669 | | 11/1980 |
| GB | 832432 | | 4/1960 |
| GB | 1520257 | | 2/1978 |
| GB | 2 072 249 | | 9/1981 |
| JP | 1-128820 | | 9/1989 |
| WO | 91/02864 | | 7/1991 |
| WO | 92/18777 | | 10/1992 |
| WO | 1998/52737 | A1 | 11/1998 |
| WO | 2005/001229 | A3 | 1/2005 |
| WO | 2006/002264 | A1 | 1/2006 |
| WO | 2006/002269 | A1 | 1/2006 |
| WO | 2006/002270 | A1 | 1/2006 |

OTHER PUBLICATIONS

U.S. Appl. No. 60/480,621, filed Jun. 23, 2003.

U.S. Appl. No. 60/839,399, filed Aug. 22, 2006.

PPG Glass Technical Document TD-103, published Dec. 11, 2001.

Decker, C., "Photostabilization of Poly(vinyl chloride) by Protective Coatings", Journal of vinyl and Additive Technology, vol. 7, Issue 4, Dec. 2001, pp. 235-243.

Selkowitz, Stephen E. et al, United States Statutory Invention Registration No. H975 entitled "Thermal Insulated Glazing Unit", published Nov. 5, 1991.

Langowski, H.-C. et al, "Ultra High Barrier Layers for Technical Applications", 45$^{th}$ Annual Technical Conference Proceedings of the Society of Vacuum Coaters, p. 475 (2002).

Amberg-Schwab, S. et al, "Inorganic-Organic Polymers with Barrier Properties for Water Vapor, Oxygen and Flavor", Journal of Sol Gel Science and Technology, ½, 141 (1998).

* cited by examiner

PLASTIC SPACER STOCK, PLASTIC SPACER FRAME AND MULTI-SHEET UNIT, AND METHOD OF MAKING SAME

RELATED APPLICATIONS

This application is a continuation-in-part of application Ser. No. 10/874,435 filed on Jun. 23, 2004, now U.S. Pat. No. 7,588,653 in the names of Stephen L. Crandell et al. for "Method of Making An Integrated Window Sash" (United States Patent Application Publication No.: US 2005/0028459A1), of application Ser. No. 10/874,503 filed on Jun. 23, 2004, now U.S. Pat. No. 7,765,769 in the names of Barent A. Rosskamp et al. for "Integrated Window Sash With Lattice Frame And Retainer Clip" (United States Patent Application Publication No.: US 2005/0028458A1), of application Ser. No. 10/874,682 filed on Jun. 23, 2004, now U.S. Pat. No. 7,490,445 in the names of Cory D. Steffek, et al. for "Integrated Window Sash" (United States Patent Application Publication No.: US 2005/0028460A1), and of application Ser. No. 10/874,721 filed on Jun. 23, 2004, in the names of Stephen L. Crandell et al. for "Integrated Window Sash With Groove For Desiccant Material" (United States Patent Application Publication No.: US 2005/0034386A1) and this application claims the benefit of U.S. Provisional Patent Application Ser. No. 60/480,621 filed Jun. 23, 2003, and U.S. Provisional Patent Application Ser. No. 60/839,399 filed Aug. 22, 2006, which applications in their entirety are incorporated herein by reference.

FIELD OF THE INVENTION

This invention relates to components of a multi-sheet unit, a multi-sheet unit and method of making the components and the unit, and in particular, to plastic spacer stock, a spacer frame made using one or more pieces of the plastic spacer stock, a multi-sheet glazing unit, e.g. a multi-sheet insulating glazing unit having the spacer frame to space sheets, e.g. glass sheets, and methods of making the spacer stock, the spacer frame and the unit.

BACKGROUND OF THE INVENTION

One practice of fabricating a multi-sheet unit, e.g. a multi-sheet insulating unit includes the steps of forming a spacer frame from metal box type spacer stock and securing a sheet, e.g. a glass sheet to each one of opposed outer surfaces of the spacer frame with a moisture impervious sealant or adhesive to provide a sealed air space between the sheets. For a more detailed discussion of multi-sheet units, reference can be made to U.S. Pat. Nos. 3,919,023; 4,520,611 and 4,780,164. One of the limitations of units made using a spacer frame made from metal box type spacer stock includes, but is not limited to, a high thermal conducting path at the marginal edges of the unit. U.S. Pat. No. 5,655,282 discusses in detail the high thermal conducting path at the marginal edges of a multi-sheet unit made using a spacer frame made from metal box type spacer stock, and discusses techniques to eliminate or significantly reduce high thermal conduction through the marginal edges of the unit.

In general, U.S. Pat. No. 5,655,282 discloses, among other things, an edge assembly between and secured to a pair of glass sheets. The edge assembly includes a spacer frame made from U-shaped metal spacer stock, U-shaped plastic or metal-plastic laminated spacer stock and U-shaped plastic spacer stock.

As can be appreciated by those skilled in the art of fabricating multi-sheet units, and in particular, multi-sheet insulating glazing units, that it would be advantageous to provide additional embodiments of spacer stock, spacer frame, and multi-sheet units that have a low thermal conducting path at the marginal edges of the unit, and to provide a barrier to prevent or reduce moisture and/or gas from moving through the spacer frame into and out of the compartment between the sheets.

SUMMARY OF THE INVENTION

This invention relates to a spacer stock for making a spacer frame for a multi-sheet unit. In one non-limiting embodiment of the invention, the spacer stock includes a first supporting surface; a second supporting surface opposite to, and facing away from, the first supporting surface; a base surface between and connecting the first and second supporting surfaces, wherein the spacer stock is made of plastic and rate of moisture and/or gas movement through portions of the first and second supporting surfaces is greater than the rate of moisture and/or gas movement, respectively through the base surface. In another non-limiting embodiment of the invention, the first supporting surface is outer surface of a first supporting member; the second supporting surface is outer surface of a second supporting member; the base surface is outer surface of a base member between and connecting the first and second supporting members, and thickness of the base member is greater than thickness of the first supporting member and greater than thickness of the second supporting member. In another non-limiting embodiment of the invention, the first supporting surface is outer surface of a first supporting member; the second supporting surface is outer surface of a second supporting member; the base surface is outer surface of a base, the base between and connecting the first and second supporting members, and further includes, among other things, a moisture and gas impervious barrier layer between the base surface, and opposite inner surface, of the base. In a still further non-limiting embodiment of the invention, the spacer stock further includes, among other things, a moisture and/or gas impervious barrier layer over the base surface of the base.

The invention further relates to a spacer stock for making a spacer frame for a multi-sheet unit, including, among other things, a plastic core made from a material selected from a moisture pervious material, a gas pervious material, and a moisture and gas pervious material, the plastic core, includes, among other things, outer surface portions and opposite inner surface portions; a barrier layer made from a material selected from a moisture impervious plastic material, a gas impervious plastic material, and a moisture and gas impervious plastic material, the barrier layer over selected surface portions of the plastic core, and an ultraviolet barrier layer over portions of the barrier layer expected to have exposure to ultraviolet radiation to prevent degradation of the barrier layer by ultraviolet radiation. Optionally the ultraviolet barrier layer is a coating selected from a two-component isocyanate containing clear coat, and a solvent-borne, thermosetting clear coat.

The invention still further relates to a plastic spacer stock for making a spacer frame for a multi-sheet unit, including, among other things, a first upright member having an end; a second upright member having an end; a base joining the first and second upright members to provide the spacer stock with a generally U-shaped cross section with the end of each the first and second members facing away from the base; wherein the spacer stock includes at least one of the following: (i) a cross member on the ends of the first and second members to provide the first and second members with a cross sectional "T" shape, a tab extending from the end of each of the members toward one another over the base; a tab extending from the end of each of the members away from one another, and combinations thereof, and (ii) the base is selected from a flat member extending beyond the first and the second members, outer surface of the base having spaced raised portions, a pair of members spaced from one another to provide the base with a chamber, and combinations thereof.

In another non-limiting embodiment of the invention a spacer stock for making a spacer frame for a multi-sheet unit having at least one corner, includes, among other things, an elongated plastic spacer stock segment having a predetermined length and a first sheet supporting surface, an opposite second sheet supporting surface, a base between and connecting the first and second supporting surfaces, and a position designed as a bend line for the at least one corner, the position comprising a groove in the base and extending between the first and the second supporting surfaces.

In addition, the invention relates to a spacer stock for making a spacer frame for a multi-sheet unit, the spacer frame having at least one corner, and the spacer stock includes, among other things, a first upright member having an outer supporting surface and an opposite inner surface; a second upright member having an outer supporting surface and an opposite inner surface; a base interconnecting the first and second upright members to provide the spacer stock segment with a generally U-shaped cross section, the base having an inner surface facing the space between the upright legs and an opposite outer surface, and a position at each of the upright members designed as bend position for the at least one corner. The bend position of each of the first and second upright members each of the upright members includes, among other things, a V-shaped area with wall thickness of the upright members within the V-shaped area greater than zero and less than the wall thickness of the upright members adjacent to and out of the V-shaped area.

DESCRIPTION OF THE INVENTION

Figure 1:
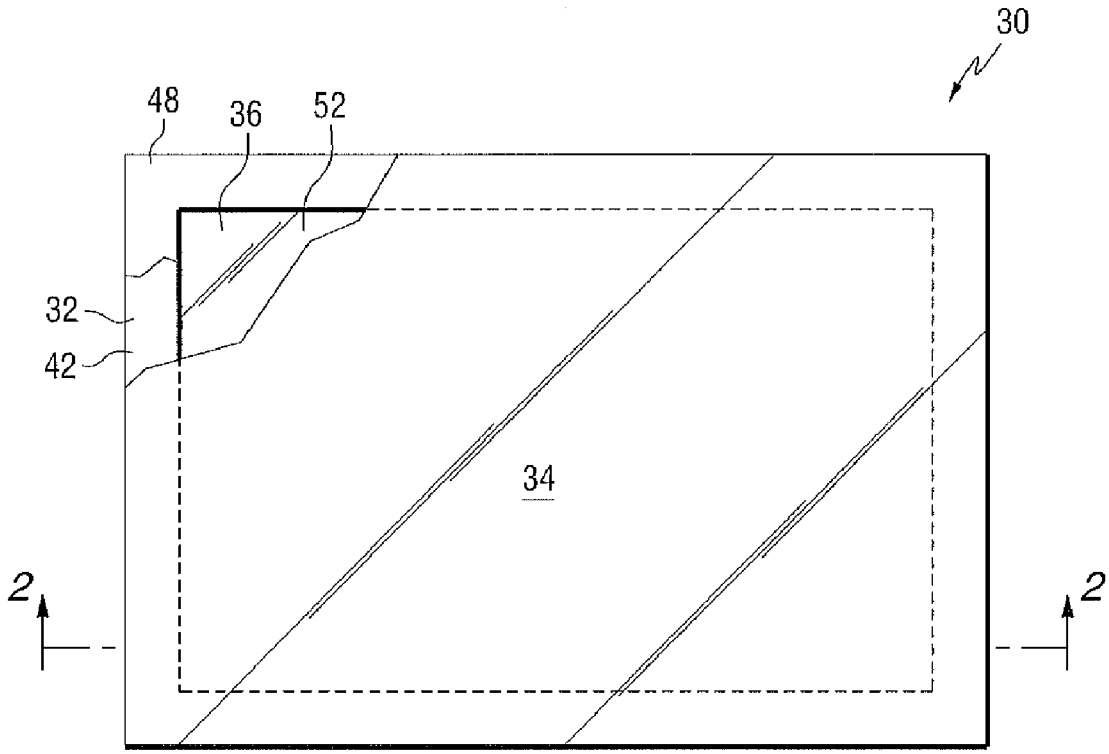
FIG. 1 is an elevated front view of a multi-sheet unit of the invention having portions removed for purposes of clarity.

As used herein, spatial or directional terms, such as "inner", "outer", "left", "right", "up", "down", "horizontal", "vertical", and the like, relate to the invention as it is shown in the drawing figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the terms "deposited over", "applied over", or "provided over" mean deposited, applied, or provided on but not necessarily in surface contact with. For example, a material "deposited over" a substrate does not preclude the presence of one or more other materials of the same or different composition located between the deposited material and the substrate.

Before discussing several nonlimiting embodiments of the invention, it is understood that the invention is not limited in its application to the details of the particular nonlimiting embodiments shown and discussed herein since the invention is capable of other embodiments. Further, the terminology used herein to discuss the invention is for the purpose of description and is not of limitation. Still further, unless indicated otherwise, in the following discussion like numbers and alphanumerical designations refer to like elements.

In general, the nonlimiting embodiments of the invention include, but are not limited to making lineals of spacer stock, making spacer frames using the lineals of spacer stock and making multi-sheet units using the spacer frames. The term "multi-sheet unit" means a unit having two or more sheets in spaced relationship to one another; the term "multi-sheet insulating unit" means a unit having two or more sheets in spaced relationship to one another and a space or compartment between the sheets in which there is no or limited ingress or egress of gas into and/or out of the space (hereinafter also referred to as a "sealed compartment"); the term "multi-sheet glazing unit" means a unit having two or more sheets in spaced relationship to one another and at least one of the sheets having a visible light transmission greater than 0%, and the term "multi-sheet insulating glazing unit" means a unit having two or more sheets in spaced relationship to one another, a sealed compartment between the sheets, and at least one of the sheets having a visible light transmission greater than 0%. The term "multi-sheet unit" includes, but is not limited to a "multi-sheet insulating unit", a "multi-sheet glazing unit" and a "multi-sheet insulating glazing unit."

The invention is not limited to the material of the sheets of the multi-sheet units of the invention, and the sheets can be made of any material, e.g. glass, plastic, metal, wood and combinations thereof, and the selection of the material of the sheets is not limiting to the invention. Still further, the two or more sheets of the multi-sheet unit can be made of the same material or the sheets can be made of different materials. In addition, one or more of the sheets of the unit can be monolithic sheets, and the remaining sheet can be a laminated sheet, e.g. made of one or more monolithic sheets laminated together in any usual manner. One or more of the glass sheets of the unit can be uncoated and/or coated, and/or one or more of the sheets can be colored and/or clear sheets. For example and not limiting to the invention, the colored sheets can be of the type disclosed in U.S. Pat. Nos. 4,873,206; 4,792,536; 5,030,593 and 5,240,886, which disclosures are hereby incorporated by reference. Further, one or more of the surfaces of one or more of the sheets can have an environmental coating to selectively pass predetermined wavelength ranges of light and energy, e.g. glass or plastic transparent sheets can have an opaque coating of the type used in making spandrels or coatings of the type disclosed in U.S. Pat. Nos. 4,170,460; 4,239,816; 4,462,884; 4,610,711; 4,692,389; 4,719,127; 4,806,220; 4,853,256 and 4,898,789, which disclosures are hereby incorporated by reference. Still further, in the practice of the nonlimiting embodiments of the invention, one or more of the surfaces of the sheets can have a photocatalytic film or water reducing film, e.g. of the type disclosed in U.S. Pat. Nos. 5,873,203; 6,027,766, and 6,027,766, which disclosures are hereby incorporated by reference. It is contemplated that the photocatalytic film disclosed in U.S. Pat. Nos. 6,027,766 and 6,027,766 and/or the water reducing film disclosed in U.S. Pat. No. 5,873,203 can be deposited on the outer surface of one or more of the sheets of the multi-sheet unit.

Although not limiting to the invention, nonlimiting embodiments of the invention are discussed in two groups, namely, Group A which includes multi-sheet units having two sheets; and Group B which includes multi-sheets units having three or more sheets.

Group a Nonlimiting Embodiments of the Invention

Figure 2:
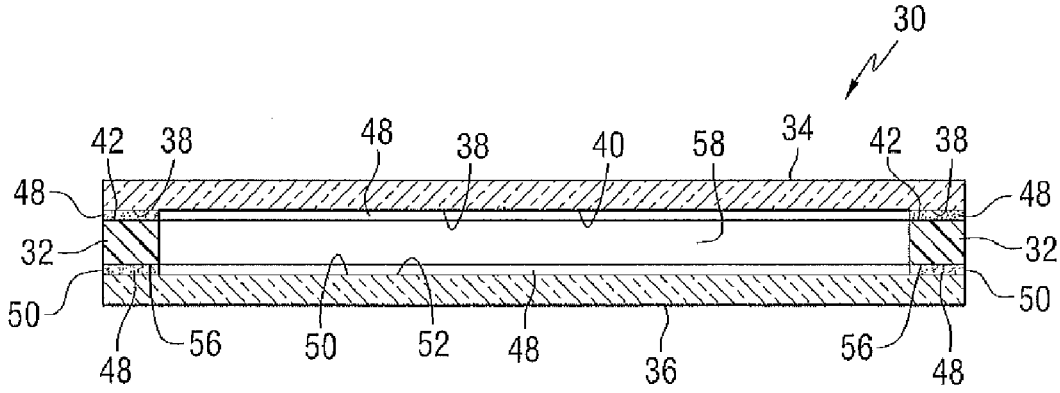
FIG. 2 is a view taken along line 2-2 of FIG. 1.

With reference to FIGS. 1 and 2, multi-sheet unit 30 of Group A includes, but is not limited to a spacer frame 32 between a pair of sheets 34 and 36. In one nonlimiting embodiment of the invention, marginal edges 38 of inner surface 40 of the glass sheet 34 are secured to outer side surface 42 of the spacer frame 32 by an adhesive layer 48, and marginal edges 50 of inner surface 52 of the second sheet 36 are secured to opposite outer side surface 56 of the spacer frame 32 by the layer 48 to provide a compartment 58 between the sheets 34 and 36. In one nonlimiting embodiment of the invention, the adhesive layers 48 are layers of a moisture and/or gas impervious adhesive-sealant, and the spacer frame 32 is made of a moisture and/or gas impervious material to provide a sealed compartment 58 between the sheets 34 and 36. When the compartment 58 is a sealed compartment, it is preferred to provide a desiccant in communication with the sealed compartment 58, in a manner discussed below, to absorb or adsorb moisture captured in the compartment 58 during manufacture of the unit. The invention is not limited to the type of desiccant used. For example, and not limiting to the invention, the desiccant can be loose, or solid particles of a desiccant, or a desiccant contained in a moisture pervious solid matrix, e.g. as disclosed in U.S. Pat. No. 3,919,023, which disclosure is hereby incorporated by reference, or a desiccant dispersed in a moisture pervious adhesive or matrix, e.g. as disclosed in U.S. Pat. No. 5,177,916, which disclosure is hereby incorporated by reference.

As can be appreciated by those skilled in the art, the material of the layers 48 and of the spacer frame 32 preferably have a low moisture vapor and/or gas transmission rate. Low moisture vapor transmission rate is desired because low moisture content or dew point of gas atmosphere between the glass sheets 34 and 36, e.g. in the sealed compartment 58, is especially important to maintaining clear visibility through the vision area of the multi-sheet unit and to optimize thermal performance of the unit. Low gas transmission rate is important to maintaining gas conditions between the glass sheets, especially for multi-sheet insulating units having the compartment between the sheets filled with argon or krypton. In the discussion of the nonlimiting embodiments of the invention, the terms "pervious" and "impervious" will be used to describe permeability of materials. For example, for a given thickness and at a given temperature, a moisture and/or gas impervious layer 48 has a lower moisture vapor transfer rate and/or argon gas transfer rate than a moisture and/or gas pervious layer 48. In the use of the terms "moisture and/or gas pervious" and "moisture and/or gas impervious" to describe a component of the invention, e.g. the layer 48, and spacer frame 32 or the spacer stocks discussed below to make the spacer frame, a property difference, e.g. a difference in moisture vapor and argon gas transfer rates is noted but not a numerical difference. The numerical difference or range of numerical difference depends on the function of the component.

With the foregoing in mind, consider now the layer 48. In the instance where the compartment 58 is a sealed compartment of a multi-sheet insulating unit, the layer 48 is a moisture and/or gas impervious adhesive-sealant layer to secure the sheets to the spacer frame 32 and to prevent or reduce moisture and/or gas transmission rate through the layer 48. In the instance where the compartment is not a sealed compartment, and it is desired to have moisture and/or gas move through the layer 48, the layer 48 is a moisture and/or gas pervious adhesive to secure the sheets to the spacer frame and allow moisture and/or gas to move through the layer 48 at a faster transmission rate than through a moisture and/or gas impervious layer. In the instance where moisture and/or gas permeation and/or transmission rate is immaterial, e.g. the compartment can be sealed or not sealed, the layer 48 can be a moisture and/or gas impervious adhesive-sealant layer, or a moisture and/or gas pervious adhesive layer. Then term "securing layer" means an "adhesive layer" and an "adhesive-sealant" layer.

In one nonlimiting embodiment of the invention, the layer 48 is a moisture impervious layer having a moisture vapor transfer rate of equal to or less than 0.10 $g/m^2$/day at 100° F./95% RH/30 mils, e.g. equal to or less than 0.05 $g/m^2$/day or equal to or less than 0.03 $g/m^2$/day or equal to or less than 0.02 $g/m^2$/day or equal to or less than 0.01 $g/m^2$/day as determined by using the procedure of ASTM F 372-73. In another nonlimiting embodiment of the invention, the layer 48 has a moisture pervious layer having a moisture vapor transfer rate of greater than 0.10 $g/m^2$/day at 100° F./95% RH/30 mils. In one nonlimiting embodiment of the invention, the layer 48 is a gas imperious layer having an argon gas transfer rate of equal to or less than 15 $cm^3/m^2$/day, e.g. equal to or less than 10 $cm^3/m^2$/day, or equal to or less than 5 $cm^3/m^2$/day, or equal to or less than 3 $cm^3/m^2$/day as determined by using the procedure of ASTM D1434-82. In another nonlimiting embodiment of the invention, layer 48 is a gas pervious layer having an argon transfer rate of greater than 15 $cm^3/m^2$/day. In the instance when the compartment 58 contains an insulating gas, e.g. but not limited to argon and/or krypton, a gas impervious layer 48 has an argon transfer rate sufficiently low to prevent a loss of equal to or less than 5%/yr of the gas, e.g. equal to or less than 1%/yr of the gas, as measured using the European procedure DIN 52293. In one nonlimiting embodiment of the invention, layer 48 is a moisture and gas impervious layer.

Adhesive-sealants that can be used in the practice of the invention include, but are not limited to, butyls, silicones, polyurethane adhesives, polysulfides, and butyl hot melts. The thickness of the securing layers 48 are not limiting to the invention. In nonlimiting embodiments of the invention, the layer 48 has a thickness in the range of 0.005 to 0.125 inches (0.127 to 3.175 mm), e.g. in the range of 0.010 to 0.020 inches (0.254 to 0.508 mm), or in the range of 0.015 to 0.018 inches (0.381 to 0.4572 mm). The height of the layer is preferably sufficient to cover the side surface 42 of the spacer frame 32.

Consider now the moisture and/or gas pervious matrix or adhesive having the desiccant to adsorb or absorb moisture in the sealed compartment 58. The moisture permeability of the matrix depends on the rate at which moisture is to be removed from the sealed compartment. For a matrix having a given amount of desiccant, increasing the permeability of the matrix increases the rate at which moisture in the sealed compartment moves through the matrix and vise versa. In one nonlimiting embodiment of the invention, the moisture vapor transfer rate of the matrix is greater than 0 $g/m^2$/day at 100° F./95% RH/30 mils, e.g. at least 30 $g/m^2$/day, or at least 40 $g/m^2$/day or at least 100 $g/m^2$/day measured as discussed above. The gas permeability of the matrix is not limiting to the invention and can be the same as the moisture permeability of the matrix. Further the invention is not limited to the material of the matrix and any moisture and gas pervious adhesive can be used, e.g. but not limiting to the invention polyurethanes and silicones.

Figure 3A:
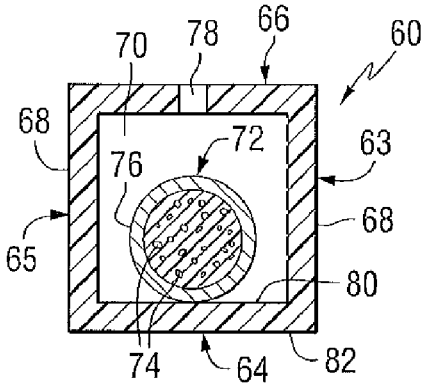
FIGS. 3A-3N and 3P are cross sectional views of nonlimiting embodiments of spacer stocks of the invention. There is no FIG. 3O.
Figure 3B:
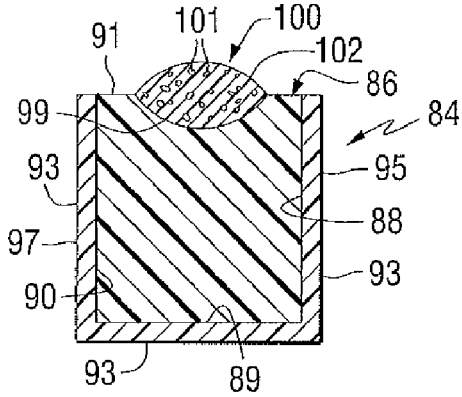
Figure 3C:
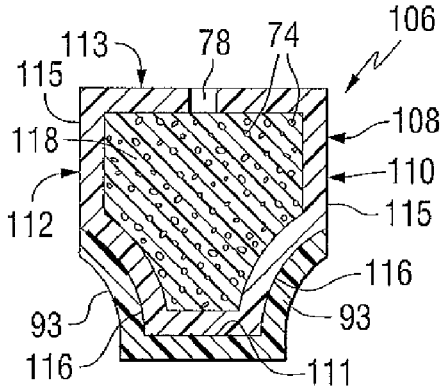
Figure 3D:
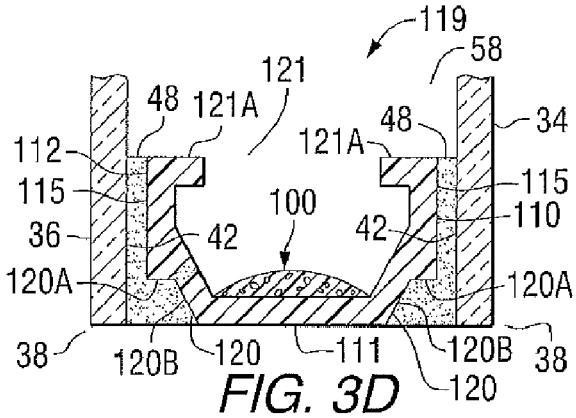
Figure 3E:
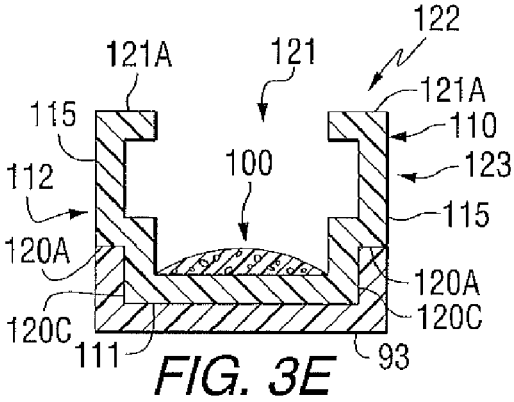
Figure 3F:
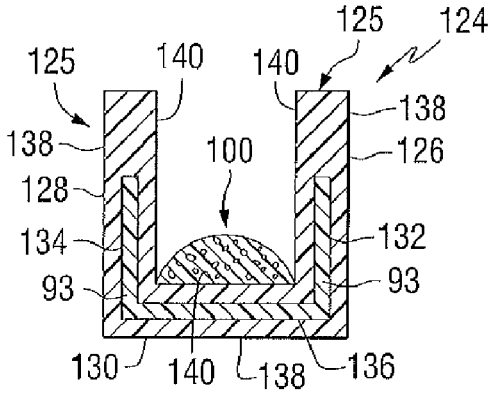
Figure 3G:
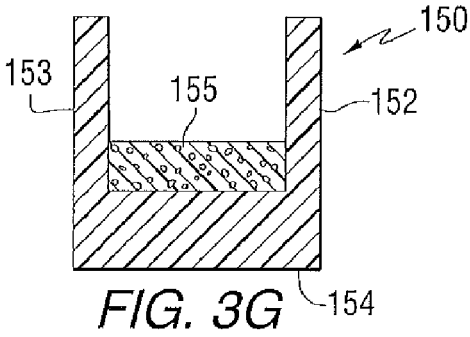
Figure 3H:
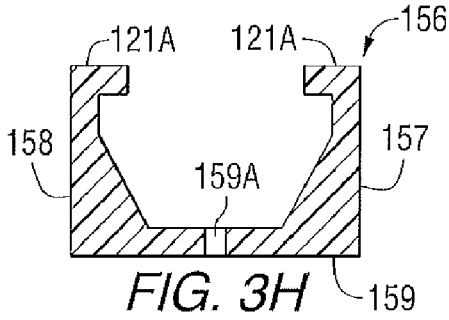
Figure 3I:
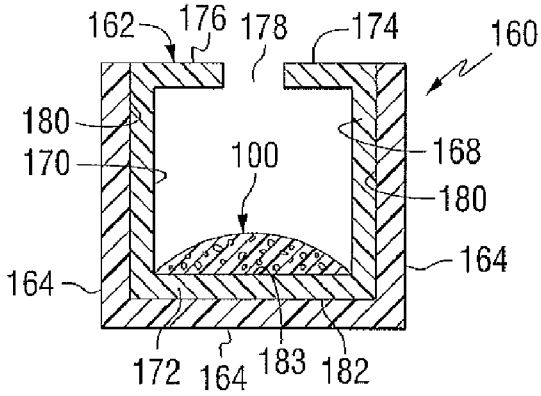
Figure 3J:
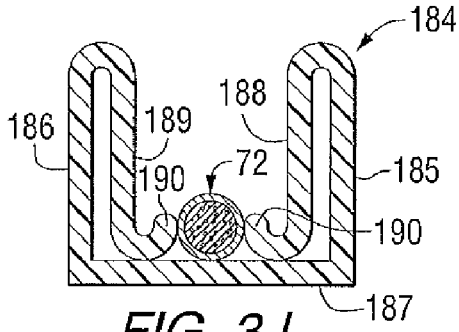
Figure 3K:
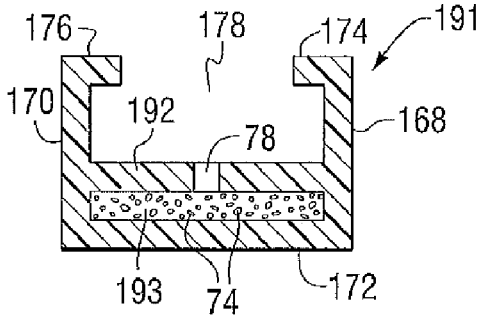
Figure 3L:
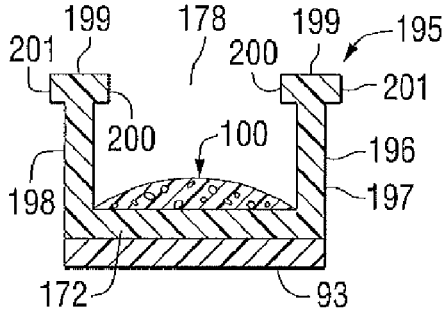
Figure 3M:
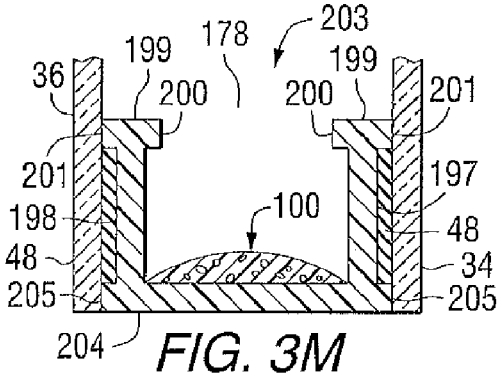
Figure 3N:
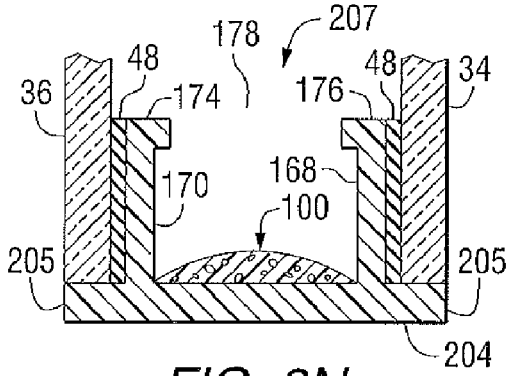
Figure 3P:
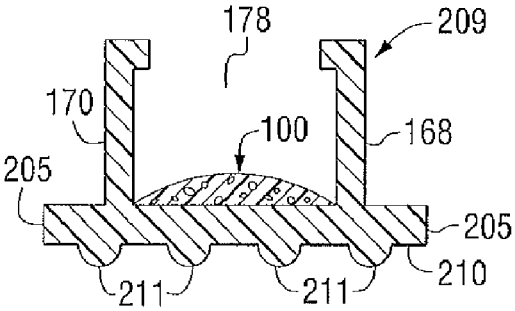

Shown in FIGS. 3A-3N, and 3P are nonlimiting embodiments of cross-sectional views of lineals of spacer stock (hereinafter also referred to as "spacer stock") that can be used in the practice of the invention. The spacer stock 60 shown in FIG. 3A has a parallelepiped cross-sectional configuration having sides 63-66 with the side 66 designated to face the compartment 58 (see FIG. 2) and outer surface 68 of the sides 63 and 65 designated to receive the adhesive layer 48 to secure the sheets 34 and 36 to the sides 63 and 65, respectively (the adhesive layers 48 are shown in FIG. 2). The spacer stock 60 has passageway or hollow interior 70 to receive desiccating system 72 including solid or loose desiccant 74 in a hollow tube 76 having moisture and gas pervious walls. The side 66 of the spacer stock 60 has an opening, for example and not limiting to the invention, a plurality of spaced holes 78 (only one hole shown in FIG. 3A) to provide communication between the desiccating system 72 and the compartment 58. The desiccating system 72 can be captured in, and free to move in the passageway 70, or the desiccating system 72 can be secured to inner surface 80 of the side 64 of the spacer stock 60 in any convenient manner, for example and not limiting to the invention, by a securing layer (not shown in FIG. 3A).

In one nonlimiting embodiment of the invention, the spacer stock 60 is a moisture impervious layer having a moisture vapor transfer rate of equal to or less than 0.10 g/m$^2$/day at 100° F./95% RH/30 mils, e.g. equal to or less than 0.05 g/m$^2$/day or equal to or less than 0.03 g/m$^2$/day or equal to or less than 0.02 g/m$^2$/day or equal to or less than 0.01 g/m$^2$/day as determined by using the procedure of ASTM F 372-73. In another nonlimiting embodiment of the invention, the spacer stock 60 is a gas imperious layer having an argon gas transfer rate of equal to or less than 15 cm$^3$/m$^2$/day, e.g. equal to or less than 10 cm$^3$/m$^2$/day, or equal to or less than 5 cm$^3$/m$^2$/day, or equal to or less than 3 cm$^3$/m$^2$/day as determined by using the procedure of ASTM D1434-82. In the instance when the compartment 58 contains an insulating gas, e.g. but not limited to argon and/or krypton, a gas impervious spacer stock 60 has an argon transfer rate sufficiently low to prevent a loss of equal to or less than 5%/yr of the gas, e.g. equal to or less than 1%/yr of the gas, as measured using the European procedure DIN 52293. In one nonlimiting embodiment of the invention, spacer stock 60 is a moisture and gas imperious plastic.

In another nonlimiting embodiment of the invention, the spacer stock 60 is made of a moisture and/or gas pervious plastic having at least one surface that is moisture and/or gas impervious to prevent or retard the movement of moisture and/or gas through the spacer stock into and out of the sealed compartment 58, e.g. and not limiting to the invention, the inner surface 80 and/or outer surface 82 the sides 63-65, or the inner surface 80 and/or the outer surface 82 of the side 64 can be moisture and/or gas impervious.

More particularly and not limiting to the invention, shown in FIG. 3B is spacer stock 84 having a solid plastic core 86 made of a moisture and/or gas pervious plastic. The plastic core 86 has a parallelepiped shape having sides 88-91 with the side 91 designated to face the compartment 58. A film or barrier layer 93 of a moisture and/or gas impervious plastic or metal material is secured to the sides 88-90 of the plastic core 86 in any convenient manner, e.g. and not limiting to the invention by an adhesive (not shown). In another nonlimiting embodiment of the invention, the film 93 is applied over all of the sides 88-91 of the plastic core 86.

In one nonlimiting embodiment of the invention, the moisture vapor transfer rate of the plastic used for spacer stock 60 is greater than 0.10 g/m$^2$/day at 100° F./95% RH/30 mils, and the argon gas transfer rate of the plastic is greater than 15 cm$^3$/m$^2$/day.

Further, in one nonlimiting embodiment of the invention, moisture and/or gas impervious plastics that can be used for barrier layers include plastics that have a moisture vapor transfer rate of equal to or less than 0.10 g/m$^2$/day at 100° F./95% RH/30 mils, e.g. equal to or less than 0.05 g/m$^2$/day or equal to or less than 0.03 g/m$^2$/day or equal to or less than 0.02 g/m$^2$/day or equal to or less than 0.01 g/m$^2$/day as determined by using the procedure of ASTM F 372-73, and/or an argon gas transfer rate of equal to or less than 15 cm$^3$/m$^2$/day, e.g. equal to or less than 10 cm$^3$/m$^2$/day, or equal to or less than 5 cm$^3$/m$^2$/day, or equal to or less than 3 cm$^3$/m$^2$/day as determined by using the procedure of ASTM D1434-82. In the instance when the compartment 58 contains an insulating gas, e.g. but not limited to argon and/or krypton, a gas impervious plastic has an argon gas transfer rate sufficiently low to prevent a loss of equal to or less than 5%/yr of the gas, e.g. equal to or less than 1%/yr of the gas, as measured using the European procedure DIN 52293. As can be appreciated, the adhesive-sealant layer 48 and the barrier layer 93 can have the same or different moisture permeability and gas permeability.

In the instance when the barrier layer 93 is metal, e.g. aluminum and stainless steel, the metal films can have a thickness of greater than 0.001 inches (0.0254 mm). At this thickness the moisture and gas permeability of the solid metal film is essentially 0 g-mm/m$^2$-day. In the alternative, two or more thin metal films can be adhered to together in any convenient manner and used as a barrier layer.

With continued reference to FIG. 3B, the spacer stock 84 has a groove 99 on the side 91 to receive desiccating system 100 including a desiccant 101 in a moisture and/or gas pervious matrix 102. The matrix 102 can be an adhesive, and the matrix of the desiccating system 100 can be applied in any convenient manner, e.g. by flowing the matrix 102 having the desiccant 101 over selected surface portion the spacer stock, e.g. the groove 99. The desiccating system 100 is of the type disclosed in U.S. Pat. No. 5,177,916. The adhesive-sealant layers 48 (shown in FIG. 2) are applied in any usual manner to the outer surface portions 95 and 97 of the layer 93, i.e. on the sides 95 and 97 of the plastic core 86. As can be appreciated, the barrier layer 93 can be eliminated by making the plastic core 86 from a moisture and/or gas impervious material.

Spacer stock 106 shown in FIG. 3C includes a plastic core 108 of a moisture and/or gas pervious material having sides 110-113 with the side 113 designated to face the compartment 58. Each of the sides 110 and 112 has a flat portion 115 and a curved portion 116 as shown in FIG. 3C. The interior of the plastic core has a passageway or hollow interior 118 having solid or loose particles of desiccant 74. The desiccant 74 communicates with the compartment 58 by way of the holes 78 in the side 113 of the spacer stock 106. The barrier layer 93 covers the curved portion 116 of the sides 110 and 112, and the side 111 of the plastic core 108 of the spacer stock 106. As can be appreciated the barrier layer can be extend to cover the flat portions 115 of the sides 110 and 112, and the side 113.

The barrier layer 93 is shown on outer surfaces of the curved portions 116 of the sides 110 and 112, and outer surface of the side 111, however, the invention contemplates providing the barrier layer 93 on selected inner surfaces of the passageway 118, e.g. and not limiting to the invention, on inner surface of the curved portions 116 of the sides 110 and 112 and inner surface of the side 111.

Spacer stock 119 shown in FIG. 3D has a shape similar to the shape of the spacer stock 106 shown in FIG. 3C with the similarities and differences discussed. The spacer stock 119 is made of a moisture and/or gas impervious material and does not have the barrier layer 93. The sides 110 and 112 of the spacer stock 119 have the flat portions 115, but in place of the curved portions 116 of the sides 110 and 112 shown in FIG. 3C, the sides 110 and 112 of the spacer stock 119 of FIG. 3D have shaped portion 120. In the nonlimiting embodiment of the spacer stock shown in FIG. 3D, the shaped portion includes a horizontal portion 120A and a sloped portion 120B. As can be appreciated the horizontal portion 120A can be eliminated, and the shaped potion 120 only includes the sloped portion 120B. Side 121 of the spacer stock 119 facing the compartment 58, has extensions 121A connected to the flat portions 115 of the legs 110 and 112 of the spacer stock 119 with the extensions 121A facing and spaced from one another. Using extensions in place of a full side such as side 113 of the spacer 106 of FIG. 3C reduces the amount of material needed to make the spacer stock. The desiccating system 100 is provided on the inner surface of the side 111 of the spacer stock 119

In the nonlimiting embodiments of the spacer stock 106 and 119, the curved portions 116 of the sides 110 and 112 of the spacer stock 106, and the shaped portion 120 of the sides 110 and 112 of the spacer stock 119 increases the amount of the adhesive-sealant layer 48 that can be provided between the sheets 34 and 36, and side 110 and 112, respectively of the spacer (see FIG. 3D).

Spacer stock 122 shown in FIG. 3E is similar to the spacer stock 106 shown in FIG. 3C and the spacer stock 119 shown in FIG. 3D with the similarities and differences discussed. The spacer stock 122 has a moisture and/or gas pervious plastic core 123 having the sides 110 and 112 having the flat portions 115 (see also FIGS. 3C and 3D) and the horizontal portions 120A (see FIG. 3D); the flat side 111 (see also FIGS. 3C and 3D); the side 121 having the extensions 121A (see also FIG. 3D); the barrier layer 93 (see also FIG. 3C), and the desiccating system 100 (see also FIG. 3D). With reference to FIG. 3E, the sides 110 and 112 of the spacer stock 122 have a vertical portion 120C joining the flat side 111 and the horizontal portions 120A of the shaped portions 120. The barrier layer 93 in one nonlimiting embodiment of the invention is applied to the horizontal portions 120A and the vertical portions 120C of the sides 110 and 112, and the side 111, of the spacer stock 122.

Spacer stock 124 shown in FIG. 3F has an outer core 125 made of a moisture and/or gas pervious plastic material; an inner film 93 of a moisture and/or gas impervious material, e.g. a metal or plastic barrier layer 93; a pair of upright legs 126 and 128 joined by a base 130 to provide the spacer stock 124 with a U-shaped cross section. The inner film 93 has a pair of outer legs 132 and 134 connected to a base 136 to provide the inner film 93 with a U-shaped cross section. The legs 132 and 134 of the inner film 93 as shown in FIG. 3F are shorter than the legs 126 and 128 of the outer core 125; however, the invention also contemplates the legs 132 and 134 of the inner film 93 having a height similar to the height of the legs 126 and 128 of the outer core 125. The inner barrier layer 93 is between the outer surface 138 and inner surface 140 of the spacer stock 124 and prevents moisture and/or gas from moving through the base 130 and portions of the legs 126 and 128 of the outer core 125 of the spacer stock 124. Mounted on the inner surface 140, e.g. inner surface of the base 130 is the desiccating system 100.

Nonlimiting embodiments of the invention for making the spacer stock 124 include any of the methods discussed above for proving a barrier film in a plastic core, e.g. and not limiting to the invention, the barrier film 93 in the plastic core 125.

Spacer stock 150 shown in FIG. 3G has a pair of upright legs 152 and 153 joined to a base 154 to provide the spacer stock 150 with a generally U-shaped cross section. The desiccating system 100 (see FIG. 3B) can be provided between the legs 152 and 153 on the base 154, or a desiccating system 155 of the type having a solid moisture and/or gas pervious co-polymer having a desiccant can be provided. For a detailed discussion of the desiccating system 155, reference can be made to U.S. Pat. No. 3,758,996, which patent is hereby incorporated by reference. The desiccating system 155 can be mounted between the legs 152 and 153 of the spacer stock and held in position by a friction fit between the legs 152 and 153, by an adhesive, and/or by heating a surface of the co-polymer to make it viscid and biasing the viscid surface against the base 154 to adhere the desiccating system 155 to the base 154.

The base 154 of the spacer 150 has a thickness greater than the thickness of the upright legs 152 and 153. Increasing the thickness of the base 154 requires the moisture and/or gas to travel further before entering the compartment 58 between the sheets 34 and 36 (see FIG. 2). The base 154 of the spacer stock 150 having increased thickness allows the spacer stock 150 to be made of a moisture and/or gas pervious plastic material having a low moisture and/or gas permeability. The thickness of the base 154 is not limiting to the invention. In one nonlimiting embodiment of the invention, the base 154 is less than 5 times, e.g. less than three times, or less than two times thickness of the legs 152 and 153. In another nonlimiting embodiment of the invention, the base has a thickness in the range of 0.015-0.075 inches (0.381 to 1.905 mm), e.g. 0.030-0.060 inches 0.762 to 1.524 mm), or 0.040-0.050 inches (1.106 to 1.27 mm), e.g. 0.045 inches (1.143 mm).

Spacer stock 156 shown in FIG. 3H has a pair of legs 157 and 158 connected to a base 159, and the extensions 121A (see also FIG. 3E) connected to the legs 157 and 158 of the spacer stock 156. The base 159 has a vent hole or passageway 159A which is discussed in more detail below for moving a gas through the base. Any one of the desiccating systems 72 (FIG. 3A), 100 (FIG. 3B or 155 (FIG. 3G), along with others known in the art can be provided on the base 159 between the legs 157 and 158. No desiccating system is shown in FIG. 3H. The thickness of the legs 157 and 158 increases as the distance from the base decreases. The increased thickness of the legs 157 and 158 provides structural support to prevent bending the legs 152 and 153 when the securing layer 48 (see FIG. 2) is applied at elevated temperatures.

Spacer stock 160 shown in FIG. 3I includes a core 162 made of moisture and/or gas pervious plastic and a barrier film 164 of a moisture and/or gas impervious material on selected outer surfaces as shown in FIG. 3I and/or inner surface portions of the plastic core 162. The core 162 has a pair of upright legs 168 and 170 joined to a base 172 to provide the legs and the base with a generally U-shaped cross section. Each of the legs 168 and 170 has an extension 174 and 176, respectively, extending from its respective leg over and spaced from the base 172 and terminating short of one another as shown in FIG. 3I to provide a slit 178 to provide communication to interior cavity of the spacer stock 160. In one nonlimiting embodiment of the invention, the film 164 is a metal film, and in another nonlimiting embodiment the film 164 is a moisture and/or gas impervious plastic film, for example and not limiting to the invention a polyvinylidene chloride (PVDC) film adhered to the outer surface 180 of the legs 168 and 170, and the base 172 of the plastic core 162 by an adhesive, e.g. EVA.

In FIG. 3I, the film 164 is secured to all or selected outer surface portions of the plastic core 162; in another nonlimiting embodiment of the invention, the film 164 is secured to all or selected or selected portions of the inner surface of the plastic core 162, and in still another nonlimiting embodiment of the invention, the film 164 is secured to all or selected portions of the inner and outer surface portions of the plastic core 162. The desiccating system 100 is provided on inner surface 183 of the base 172. Other nonlimiting embodiments include providing the desiccating system 100 on the inner surface of one or more of the inner surfaces of the legs 168 and 170.

Spacer stock 184 shown in FIG. 3J is made from a moisture and/or gas impervious material and includes a pair of upright legs 185 and 186 joined to base 187 to provide the base and upright legs with a generally U-shaped cross section. Each of the legs 185 and 186 has an extension 188 and 189 respectively that gives each of the legs 185 and 186 when viewed in cross section an inverted U-shape. The inverted U-shape provides the upright legs 185 and 186 with additional structural stability allowing the upright legs 185 and 186 to have a reduced thickness. The desiccating system 72 is captured between upturned end portions 190 of the extensions 188 and 189.

Spacer stock 191 shown in FIG. 3K is made of moisture and/or gas impervious plastic and is similar to the spacer stock 160 shown in FIG. 3I. The spacer stock 191 includes the legs 168 and 170 joined to the base 172 and having the extensions 174 and 176 to provide the slit 178. A platform 192 having the plurality of spaced holes 78 (only one hole shown) is joined to the inner surface of the legs 168 and 170, and spaced from the base 172 to provide a chamber 193 to contain the solid or loose desiccant 74. The base 172 and the platform 192 provide additional structural strength to the spacer 191 to counter act compression forces acting on the legs 168 and 170.

Spacer stock 195 shown in FIG. 3L includes a moisture and/or gas pervious plastic core 196 having a pair of legs 197 and 198 joined to the base 172 to provide the spacer stock 195 with a U-shaped cross section. The barrier layer 93 is provided on outer surface of the base 172, and the desiccating system 100 is provided on the inner surface of the base 172. Each of the legs 197 and 198 has a horizontal extension 199. Inner ends 200 of the horizontal extensions 199 are spaced from one another to provide the slit 178, and outer ends 201 of the horizontal extensions 199 engage the sheets 34 and 46 (sheets shown in FIG. 2) and provide for a controlled thickness of the adhesive-sealant layer to secure the sheets to the legs 197 and 198.

Spacer stock 203 shown in FIG. 3M is similar to the spacer stock 195 shown in FIG. 3L with the similarities and differences discussed. The spacer stock 3M is made of moisture and/or gas impervious plastic and includes the legs 197 and 198 joined to base 204. The desiccating system 100 is on the inner surface of the base 204. The base 204 has ends 205 that are aligned with the ends 201 of the horizontal extensions 199 of the legs 197 and 198 to provide a recess there between to maintain a predetermined thickness of the securing layer 48 to adhere the glass sheets 34 and 36 to the legs 197 and 198.

Spacer stock 207 shown in FIG. 3N is made of moisture and/or gas impervious plastic and includes the legs 168 and 170 of the spacer stock 160 of FIG. 3I. The legs 168 and 170 have the extensions 174 and 176, respectively to provide the slit 178. The legs 168 and 170 are joined to the base 204 of the spacer stock 207 with the ends 205 providing a support to support the sheets 34 and 36 as shown in FIG. 3N. The ends 205 of the base 204 prevent or minimize damage to the edges of the sheets.

Spacer stock 209 shown in FIG. 3P is similar to the spacer stock 207 shown in FIG. 3N with the similarities and differences discussed. The legs 168 and 170 have the extensions 174 and 176, respectively to provide the slit 178. The legs 168 and 170 are joined to base 210 having the ends 205. Bottom outer surface of the base 210 is provided with spaced raised portions 211. The raised portions 211 maintain the sheets of the unit above the surface supporting the unit to provide paths for water drainage.

As is now appreciated, the invention is not limited to the cross sectional configuration of the spacer stock, and the cross-sectional configuration of any metal spacer can be duplicated for a plastic spacer and can be used in the practice of the invention.

Lineals of the spacer stock in a nonlimiting embodiment of the invention are made of plastic, fiber reinforced plastics and combinations thereof having at least one surface that is moisture and/or gas impervious to prevent or retard the movement of moisture and/or gas through the spacer stock into and out of the sealed compartment 58. Discussed below and not limiting to the invention are plastics that can be used in the practice of the invention.

Moisture and/or gas pervious plastics that can be used in the practice of the invention to make lineals of spacer stock include, but are not limited to thermoplastics such as acrylic, acrylonitrile-butadiene-styrene ("ABS"), polyethylene ("PET"), high density polyethylene ("HDPE"), low density polyethylene ("LDPE"), linear low density polyethylene ("LLDPE"), polypropelene ("PP"), polystriene ("PS"), and polyvinyl chloride ("PVC"); and thermoset plastics such as alkyd, diallyl phthalate, epoxy, melamine molding compound, phenolic, polyester unsaturated, polyurethane isocyanates, urea molding compound, vinyl ester, polyvinyl chloride ("PVC"), and cellular PVC.

Moisture and/or gas impervious materials that can be used as barrier layers 93 in the practice of the invention include, but are not limited to metal, e.g. aluminum or stainless steel, inorganic/organic hybrid materials, e.g. made from an inorganic precursor, e.g. but not limited to metal and/or ceramic, and an organic precursor, e.g. a polymer, polymeric materials including, but not limited to ethylene vinyl alcohol, polyacrylonitrile, polyethylene naphthalate, oriented polypropylene, liquid crystal polymer, oriented terephthalate, polychlorofluoro-ethylene, polyamide 6, polyvinylidene fluoride, polyvinyl chloride or polytrichlorofluoro ethylene and copolymers thereof, thermoplastic including but not limited to acetal resins (polyoxymethylene), acrylic resins (acrylonitrile-methyl acrylate copolymer), cellulosic plastic, fluoroplastics (fluoropolymer, ethylene-chlorotrifluoroethylene copolymer (ECTFE), ethylene-tetrafluoroethylene copolymer (ETFE), fluorinated ethylene-propylene copolymer (FEP), perfluoroalkoxy resin (PFA & MFA), polychlorotrifluoroethylene (PCTFE), polytetrafluoroethylene (PTFE), polyvinyl fluoride (PVF), polyvinylidene fluoride (PVDF), hexafluoropropylene, tetrafluoroethylene, ethylene (HTE), tetrafluoroethylene, hexafluoropropylene, vinylidene fluoride, terpolymer (THV)), ionomers, parylenes, polyamides (Amorphous Nylon, Nylon 6—PA6, Nylon 66—PA 66, Nylon 6/66—PA 6/66, Nylon 6/12—PA 6/12, Nylon 6/6.9—PA 6/69, Nylon 6.6/6.10—PA 66/610), polyamide nano-composites, polycarbonates, polyesters (polybutylene terephthalate (PBT), polyethylene napthalate (PEN), polycyclohexylenedimethylene terephthalate (PCTG), polycyclohexylenedimethylene ethylene terephthalate (PETG), polyethylene terephthalate (PET), liquid crystal polymer (LCP)), polyimides, polyolefins (Ultra low density polyethylene (ULDPE), low density polyethylene (LDPE), linear low density polyethylene (LLDPE), medium density polyethylene and linear medium density, polyethylene (MDPE & LMDPE), high density polyethylene (HDPE), polyolefin plastomers (POP), cyclic olefin copolymer (COC), ethylene-vinyl acetate copolymer (EVA), ethylene-acrylic acid copolymer (EAA), polypropylene (PP), polybutene, polybutylene (PB)), polyphenylene sulfides, polysulfones, polyvinyl alcohol, styrenic resins (acrylonitrile-butadiene-styrene copolymer (ABS), acrylonitrile-styrene-acrylate copolymer (ASA), polystyrene (PS), oriented polystyrene (OPS), general purpose polystyrene (GPPS), high impact polystyrene (HIPS), styrene-acrylonitrile copolymer (SAN), ethylene-vinyl alcohol copolymer (EVOH), styrene-butadiene block copolymer (SBS)), and vinyl resins (polyvinyl chloride (PVC), polyvinylidene chloride (PVDC), PVDC coated films, PVDC coated polyester films); thermosets such as epoxy resins; thermoplastic elastomers such as olefinic thermoplastics elastomers, polyether block amides, polybutadiene thermoplastic elastomer, polyester thermoplastic elastomer, styrenic thermoplastic elastomer, and vinyl thermoplastic elastomers, and rubbers such as butadiene rubber, butyl rubber, bromobutyl rubber, chlorobutyl rubber, polyisobutylene rubber, chlorosulfonated polyethylene rubber, epichlorohydrin rubber, ethylene-propylene rubber, fluoroelastomer (vinylidene fluoride-hexafluoropropylene copolymer), natural rubber, neoprene rubber, nitrile rubber, polysulfide rubber, polyurethane rubber, silicone rubber, styrene-butadiene rubber.

The invention is not limited to the thickness of the barrier film applied over the surfaces of the plastic core or provided within the thickness of the spacer stock: however, the film should be sufficiently thick to provide the desired resistance to movement of moisture and/or gas through the film. For example, metal barrier layers, e.g. aluminum and stainless steel films having a thickness of greater than 0.001 inches (0.0254 mm), and a polyvinylidene chloride film in the thickness range of 0.005 to 0.60 inches (0.127 to 15.24 mm), e.g. in the range of 0.010 to 0.040 inches (0.254 to 1.106 mm), or in the range of 0.020 to 0.030 inches (0.508 to 0.762 mm) meets the requirements discussed above.

Lineals of moisture and/or gas impervious plastic spacer stock can be made of the same material as the moisture and/or gas impervious plastic barrier layers.

The invention also contemplates lineals of the spacer stock of the invention having a body made from a plastic material, e.g. an inorganic-organic hybrid polymer, modified to improve its moisture and/or gas permeation performance. In one nonlimiting embodiment of the invention, a plastic material is modified to improve its moisture and/or gas permeation performance, by blending liquid crystal polymers with PVC or nanometer-scale platelets, e.g. but not limited to, aluminum silica platelets. Inorganic-organic modified plastic materials improve the moisture and/or gas permeation performance, making the inorganic-organic hybrid polymers a candidate for use as a moisture and/or gas impervious plastic and more preferably as a barrier layer. More particularly, it has been observed that when the thickness of inorganic-organic hybrid polymers is increased, the polymer becomes more brittle. This limitation can be overcome by applying a protective topcoat over the barrier layer. The topcoat can be any paint formulation, e.g. a UV curable paint.

As can be appreciated, and as discussed above, the invention contemplates the spacer stocks of the invention, for example but not limited to the spacer stocks shown in FIGS. 3A-3N and 3P having a body made entirely from a moisture and/gas impervious plastic material; a body made from a plastic material, e.g. an inorganic-organic hybrid polymer, modified to improve its moisture and/or gas permeation performance, and/or a body including a moisture and/or gas pervious plastic core having a moisture and/or gas impervious barrier or film on selected surface portions of the plastic core. As is appreciated by those skilled in the art, moisture and/or gas impervious plastics, e.g. but not limited to crystalline polymeric materials have a lower thermal conductivity than metals, e.g. aluminum, carbon steel, or stainless steel and are preferred materials for barrier layers or films.

As is appreciated by those skilled in the art, crystalline polymeric materials such as PVDC do not readily adhere to PVC surfaces. In those instances when the adhesion of the crystalline materials and the PVC to one another is to be improved, an adhesive layer can be used to improve the adhesion of the layer of crystalline polymeric material to selected surfaces of the PVC core of the spacer stock, or the PVC core of the spacer frame. The adhesive layer can include any one of a number of adhesives such as, but not limited to, ethyl vinyl acetate.

Figure 4:
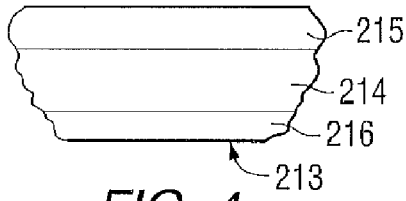
FIG. 4 is an elevated fragmented side view of a three film barrier layer incorporating features of the invention.

It is well recognized that crystalline polymeric materials can deteriorate as a result of exposure to ultraviolet radiation. Therefore, in the practice of the invention, it is preferred to prevent or reduce exposure of the crystalline polymeric materials to ultraviolet radiation. It is further recognized that most of the surfaces of the barrier layer will not be exposed to ultraviolet radiation; nevertheless, care should be taken to protect surface portions of barrier layers of the spacer stock and of the spacer frame that have a high probability of being exposed to ultraviolet radiation during shipment, manufacturing and/or use. In one nonlimiting embodiment of the invention, an adhesive film of a material that does not deteriorate or has reduced deterioration upon exposure to ultraviolet radiation is applied on selected surface portions a crystalline polymeric material. For example but not limited to the invention, crystalline polymeric resin, e.g. polyvinylidene chloride is fed into the center orifice of an extruder and molten ethyl vinyl acetate resin fed into an orifice of the extruder on each side of the center orifice to extrude a three layer barrier layer 213 (see FIG. 4) having a polyvinylidene chloride layer 214 between and adhered to a pair of ethyl vinyl acetate layers 215 and 216. For a more detailed discussion of the process, reference can be made to Japanese Patent Application JP 1-128820, which application is hereby incorporated by reference.

The thickness of the outer layers 215 and 216 is not limiting to the invention; however, the outer layers to be joined to the plastic core should be sufficiently thick to secure the barrier layer 213 to the selected surface portions of the plastic core, and the outer layer to provide the ultraviolet protection should be sufficiently thick to provide such protection. In one nonlimiting embodiment of the invention, thicknesses of the layers 215 and 216 are in the range of greater than 0 to 0.003 inches (0.0762 mm), e.g. in the range of greater than 0 to 0.002 inches (0.0508 mm), or in the range of 0.0005 to 0.001 inches (0.0127 to 0.0254 mm).

In another nonlimiting embodiment of the invention, the barrier layer is simultaneously extruded with the moisture and/or gas pervious plastic core. For example and not limiting to the invention, during the extrusion of the plastic core 108 (see FIG. 3C), the barrier layer 213 (see FIG. 4) is extruded onto the curved portions 116 of the sides 110 and 112, and the side or base 111 of the spacer stock 106 shown in FIG. 3C to provide a spacer stock having the three layer barrier layer.

In another nonlimiting embodiment of the invention, the surface of the crystalline polymeric material exposed to ultraviolet radiation can be covered with one of the desiccating systems 72, 100, 155. For example and not limiting to the invention, the inner surface 183 of the base 172 of the spacer stock 160 shown in FIG. 3I is covered with a polyvinylidene chloride layer, and the desiccating system 100 covers and protects the polyvinylidene chloride layer. In still another nonlimiting embodiment of the invention, a polyvinylidene chloride layer provided on the outer surface of the spacer stock, e.g. as shown for the spacer stock 160 of FIG. 3I can be protected by the adhesive-sealant layers 48 (see FIGS. 1 and 2). In a further nonlimiting embodiment of the invention, when the spacer stock is made polyvinylidene chloride, e.g. the spacer stock 60 shown in FIG. 3A, the sheets 34 and 36 can be solar control type glass sheets having a coating or composition to reduce ultraviolet transmission, e.g. glass having titanium and/or cerium as disclosed in U.S. Pat. Nos. 5,240,886 and 5,593,929, which patents are hereby incorporated by reference.

In a still further nonlimiting embodiment of the invention, the surface of the polyvinylidene chloride film can be covered with a coating that blocks or reduces ultraviolet transmission. The coating compositions are not limiting to the invention and include, but are not limited to, clearcoat TKU1050, a two-component isocyanate containing clearcoat, and clearcoat DCT5555, a solvent-borne, thermosetting clear coat. The coatings are available from PPG Industries, Inc., Pittsburgh, Pa., and a more detailed discussion of the coatings is found in U.S. Pat. Nos. 6,762,240 B2; 6,841,641 B2, and 7,001,952 B2, which patents are hereby incorporated by reference. The coatings can be applied in any convenient manner, e.g. but not limited to spraying, rolling, curtain or flow coating and brushing. The invention contemplates using the above techniques alone or in combination with one another to protect the barrier layer against ultraviolet degradation.

The dimensions of the spacer stock are not limiting to the invention, however, the dimensions should be sufficient to provide a spacer stock that is structurally stable to maintain the sheets 34 and 36 in spaced relationship to one another and has a length sufficient to meet the requirements of the desired spacer frame.

The discussion is now directed to nonlimiting embodiments of fabricating a spacer frame. As is appreciated, the non-limited embodiments of the spacer frame of the invention can be made using any type of spacer stock and is not limited to the spacer stock shown in FIGS. 3A-3N and 3P. In one nonlimiting embodiment of the invention, ends of spacer stock sections are joined to make a spacer frame, e.g. and not limiting to the invention, spacer frame 220 shown in FIG. 5. The frame 220 includes sections 230 of spacer stock cut from a lineal of the spacer stock, e.g. but not limiting to the invention, a lineal of the spacer stock 160 shown in FIG. 3I, to provide spacer sections of a desired length and opposite ends 230 cut at an angle depending on the configuration of the spacer frame and the manner in which the ends of adjacent sections are joined. More particularly, for a spacer frame having a parallelepiped shape, the ends of the spacer stock sections can be cut at a 45 degree angle, and for a spacer frame having a pentagon shape, the ends of the spacer stock sections can be cut at a 36 degree angle. In one nonlimiting embodiment of the invention, the spacer stock sections 230 are joined by inserting one leg 234 of corner key 236 into one end 232 of a first one of the spacer stock sections 230 and other leg 238 of the corner key into the end of a second one of the spacer stock sections 230. The process is repeated to join adjacent ends of adjacent spacer stock sections to form the spacer frame. In the instance when the spacer stock is a solid, e.g. the spacer stock 84 shown in FIG. 3B, the ends of the spacer stock section can be milled out to receive the legs of a corner key.

The invention is not limited to the material of the corner keys, and the corner keys can be made of any material, e.g. wood, metal, plastic, and glass and metal re-enforced plastic. In a preferred non-limited embodiment of the invention, the corner keys are made of a moisture and/or gas impervious plastic or a moisture and/gas pervious plastic core having a moisture and/or gas impervious film or layer, e.g. a barrier layer over selected surfaces of the plastic core as discussed above for the spacer stock. The materials for making the corner keys can be selected from the same group of materials listed for making the spacer stocks discussed above.

Figure 6A:
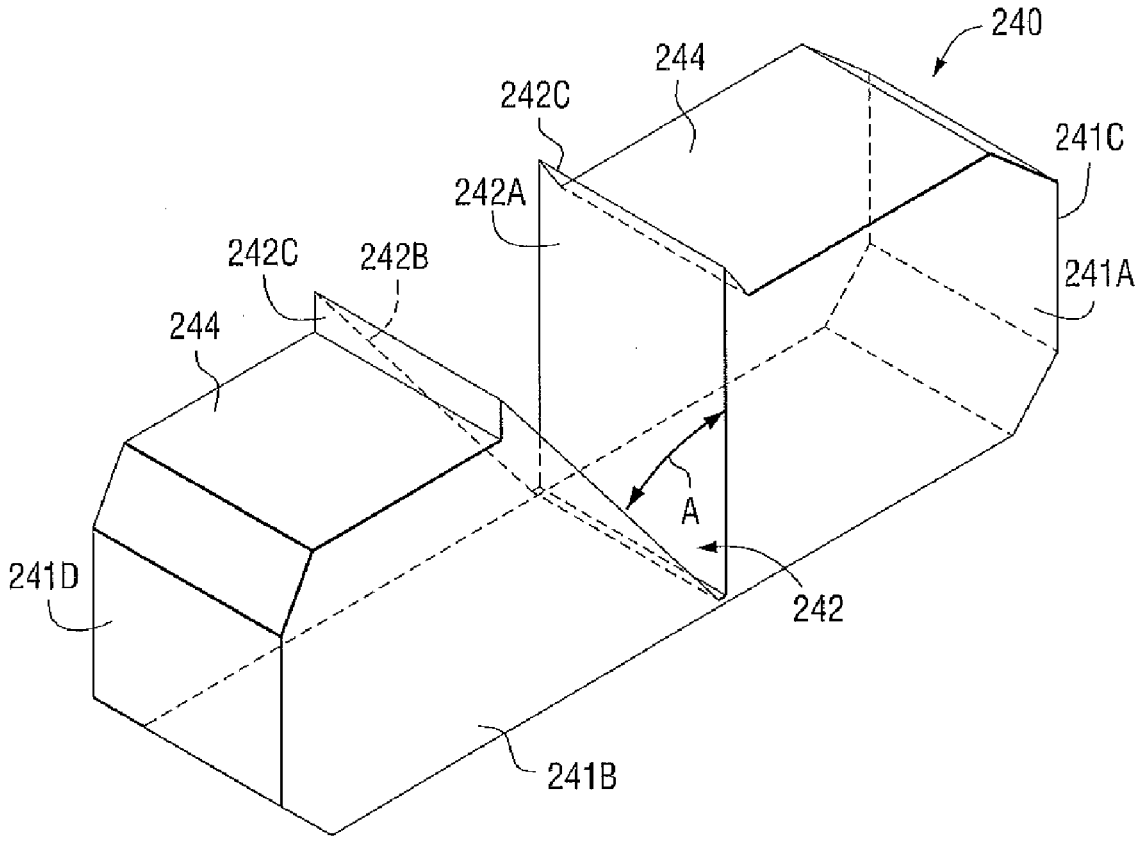
FIG. 6A is an isometric view of a nonlimiting embodiment of a corner key of the invention prior to bending to join ends of spacer stock sections.
Figure 6B:
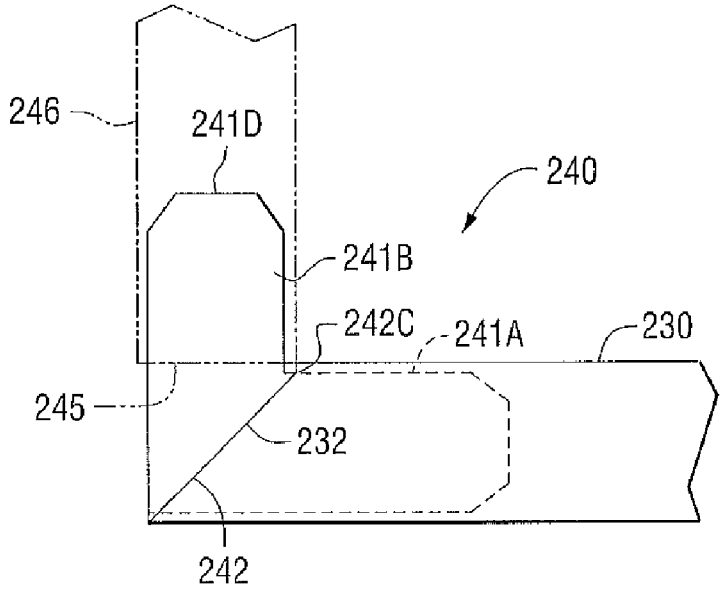
FIG. 6B is an elevated side view of the corner key of FIG. 6A joining ends of spacer stock sections.

The discussion is now directed to nonlimiting embodiments of corner keys of the invention. With reference to FIGS. 6A and 6B, there is shown corner key 240 incorporating features of the invention. The corner key 240 includes an elongated solid body 241 having a first end portion 241A and a second end portion 241B separated by a cut out 242. The invention is not limited to any particular shape of the cut out. In a preferred nonlimiting embodiment of the invention, the cut out has a V-shape. Sides 242A and 242B of the cut out 242 subtend an angle "A". The size of the angle A depends on the shape of the spacer frame to be formed. For example and not limiting to the invention, the angle "A" would be 90 degrees for a 90 degree corner of a spacer frame. Ends 241C and 241D of the end portions 241A and 241B, respectively are beveled for ease of moving the ends 241C and 241D into ends 232 of the spacer stock section (see FIG. 6B). Although not limiting to the invention, the sides 242A and 242B of the V-shape cut out 242 extend above top surface 244 of the end portions 241A and 241B to provide stops 242C to prevent the end of the spacer stock section from moving over the V-shape cut out 242.

Figure 5:
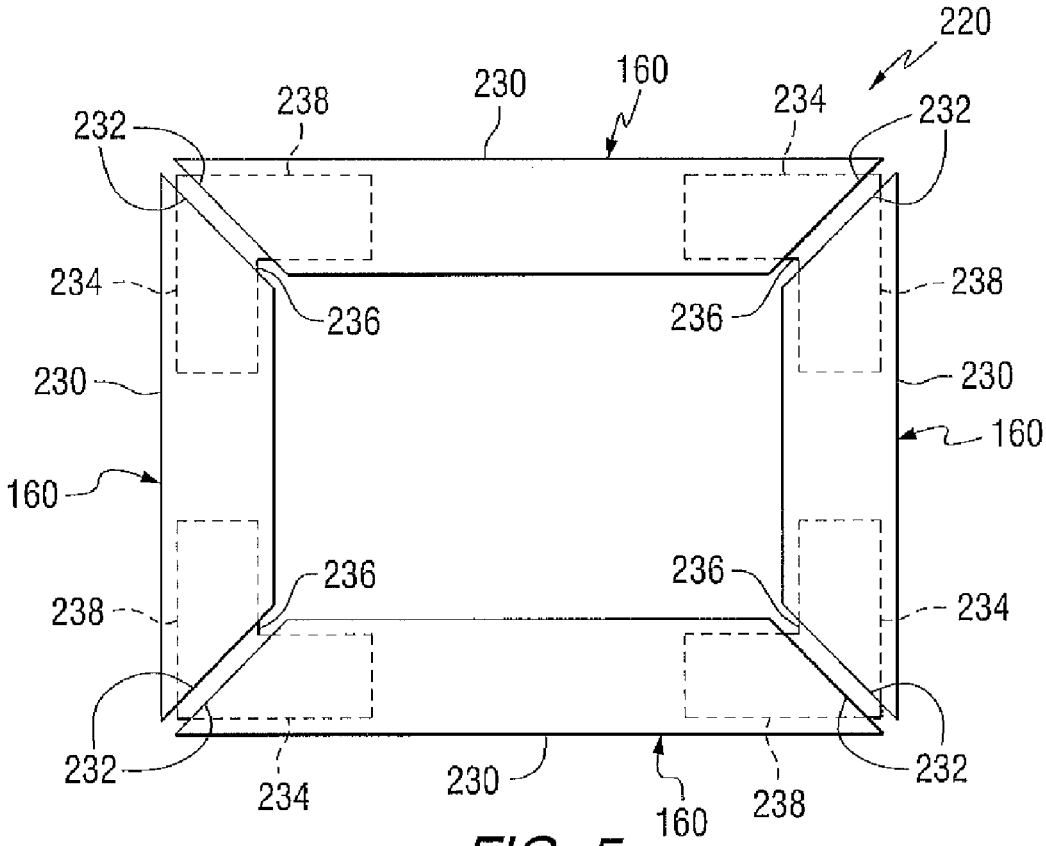
FIG. 5 is an elevated view of spacer stock sections of the invention joined by corner keys to form a spacer frame of the invention.

With reference to FIGS. 5 and 6B, in one nonlimiting practice of the invention, the end portion 241A of a first corner key 240 is in one end 232 of a first spacer stock section 230, and the second end portion 241B of the first corner key is in the first end of a second spacer section. The first and second spacer sections are moved toward one another bring the sides 242A and 242B of the V-shaped cut out 242 toward one another. A first end of a third spacer stock section is on the second end portion of the second corner key, and the third section is moved toward the first spacer stock section. The steps are repeated until the remaining end portion of the last corner key is in the second end of the first spacer stock section to form the spacer frame. As can be appreciated, and with reference to FIG. 6B, the spacer stock sections can have the mitered angled end 232 as shown for the spacer stock section 230 or a straight cut end as shown for end 244 of spacer stock section 245 shown in phantom in FIG. 6B. The usual practice in the art is to have mitered angled corners, e.g. a mitered 45 degree angle.

Figure 7A:
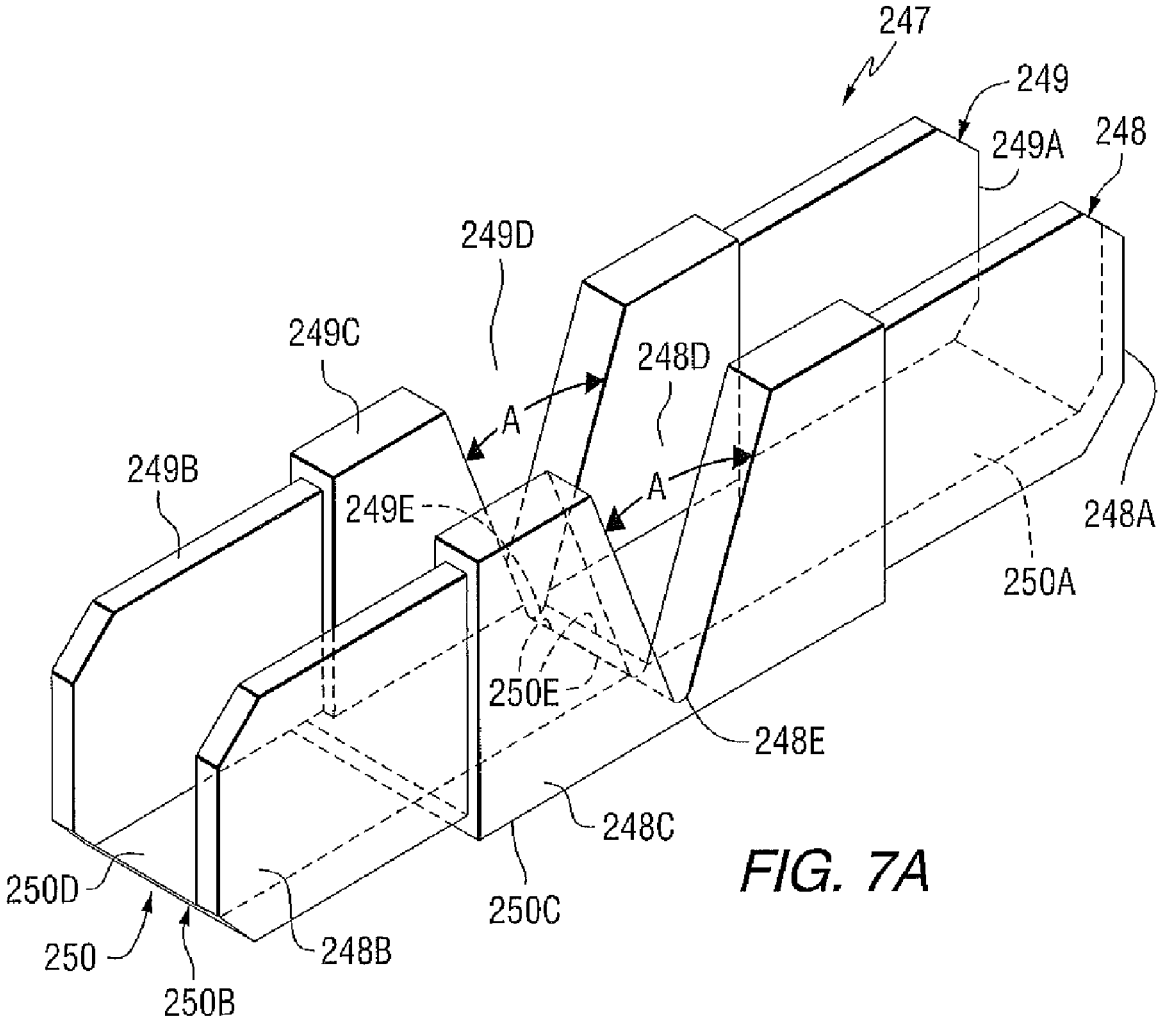
FIG. 7A is a view similar to the view of FIG. 6A showing another nonlimiting embodiment of a corner key of the invention.
Figure 7B:
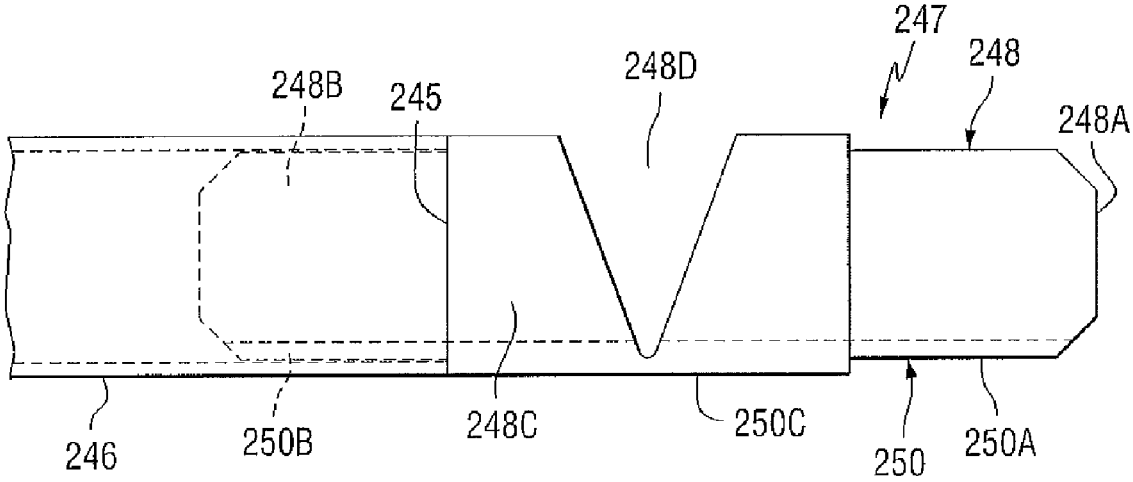
FIG. 7B is a side elevated view of the corner key of FIG. 7A having one end of the corner key in an end of a spacer stock section.

Shown in FIGS. 7A and 7B is another nonlimiting embodiment of a corner key 247 of the invention. The corner key 247 includes a first upright leg 248 and a second upright leg 249 spaced from one another and connected to a base 250 to provide the corner key 247 with a generally U-shaped cross section. Each of the legs 248 and 249 include a first outer portion 248A and 249A, a second outer portion 248B and 249B and an intermediate portion 248C and 249C between the outer portions of the first and second legs 248 and 249, respectively. The base 250 similarly includes first and second outer portions 250A and 250B, and an intermediate portion 250C between the outer portions 250A and 250B. The intermediate portions 248C and 249C each include a generally V-shaped cut out 248D and 249D each having an angle A. The size of the angle A is a function of the corresponding angle of the corner of the spacer frame to be assembled. For example and not limiting to the invention, for a 90 degree corner of a spacer frame the angle A is 90 degrees. Vertex 248E and 249E of each of the V-shaped cut outs 248C and 249C extends below inner surface 250D of the base 250 for ease of folding the corner key about the vertexes 248E and 249E of the cut outs 248 and 249, respectively. In the practice of the invention, the depth of the vertex of the cut outs 248E and 249E into the inner surface 250D of the base 250 is in the range of 0-99% of the base thickness, e.g. 50-95% of the base thickness, or 70-90% of the base thickness. In one nonlimiting embodiment of the invention, the corner key 248 is made of polypropylene, the angle A is 90 degrees and the thickness of the intermediate section 250C of the base 250 is of 0.070 inches (1.778 mm). The vertex 248E and 248E of the cut outs 248D and 249D, respectively, each have a flat portion having a width of 0.020 inches (0.508 mm) that extends into the inner surface 250D of the base 250 to a depth of 0.048 inches (1.2192 mm) and extends across the inner surface 250D of the base 250 and shown in FIG. 7A by dotted lines 250E.

In one nonlimiting embodiment of the invention, the outer portions of the legs 248 and 249, and the base 250 are sized to fit into an end of a spacer stock section, e.g. the end 245 of the spacer stock section 246 (see FIG. 7B) and the difference in thickness between the intermediate portions 248C, 249C and 250C and outer portions 248A and 248B, 249A and 249B, 250A and 250B of the legs 248 and 249, and the base 250, respectively, is equal to the wall thickness of the spacer stock section. In one nonlimiting embodiment of the invention, the difference is 0.040 inches (1.1016 mm). With this arrangement, the outer surface of the sides and base of the spacer stock section are aligned with the outer surface of the intermediate portions 248C, 249C and 250C of the corner key 240. In another non-limiting embodiment of the invention the outer portions 250A and 250B of the base 250 are omitted and the outer portions 248A, 248B, and 249A, 249B of the legs 248 and 249, respectively are moved into the ends of the spacer stock section.

As can be appreciated, the length of the intermediate portions 248C, 249C and 250C is not limiting to the invention. For example, the length of the intermediate sections can be reduced such that the cut outs 248D and 249D have the stops 242C of the cut out 242 (see FIG. 6A), or the length can be increased to any length up to or greater than 2 inches (5.08 cm).

Figure 7C:
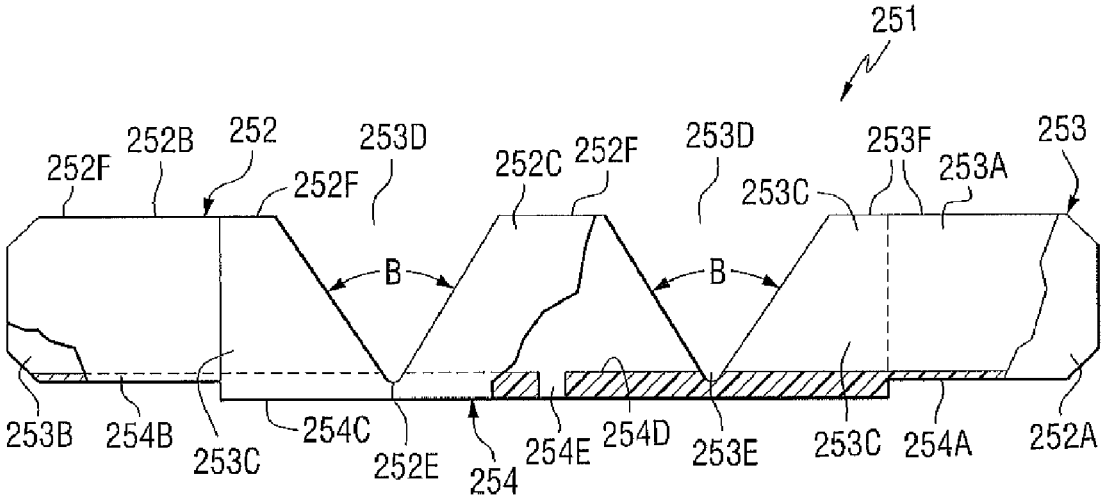
FIG. 7C is an elevated side view of still another nonlimiting embodiment of a corner key of the invention having portions removed for purposes of clarity.
Figure 7D:
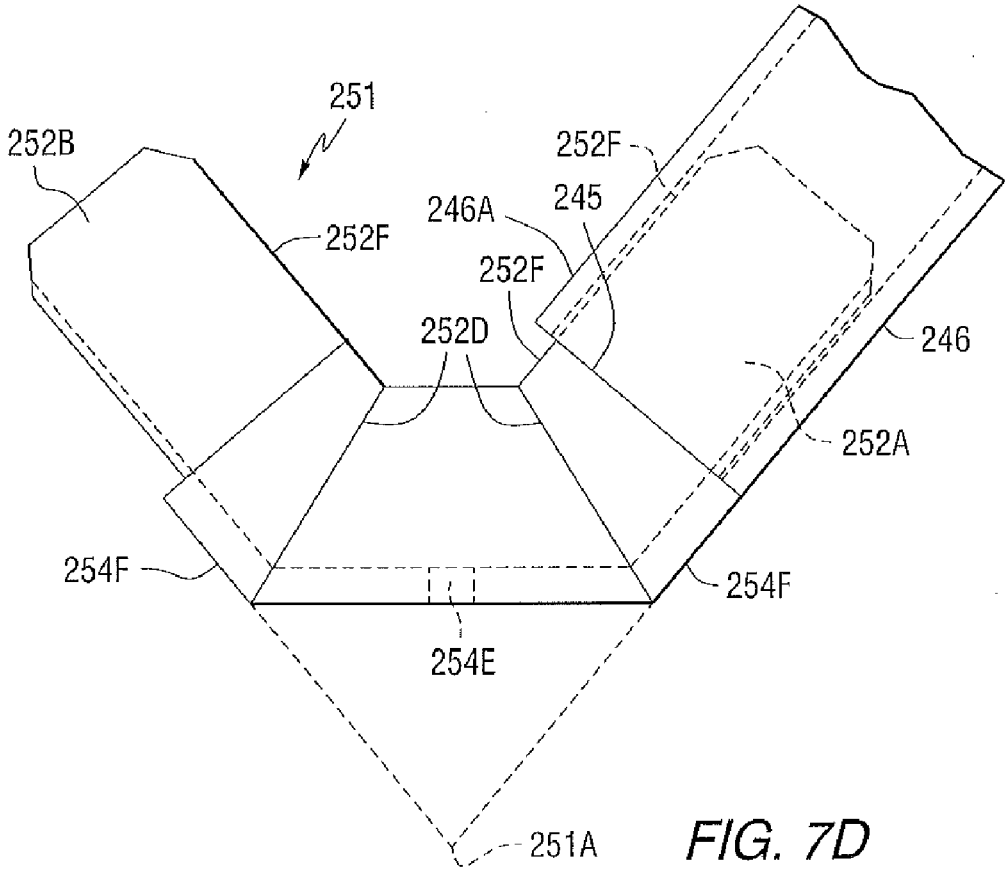
FIG. 7D is a side elevated view of the corner key of FIG. 7C having one end of the corner key in an end of a spacer stock section.
Figure 7E:
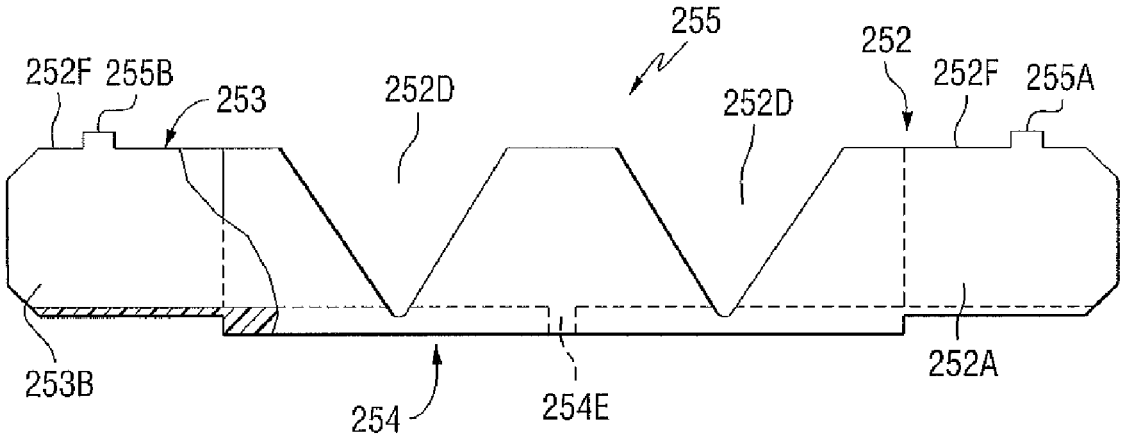
FIG. 7E is a view similar to the view of FIG. 7C showing a further nonlimiting embodiment of a corner key of the invention.
Figure 7H:
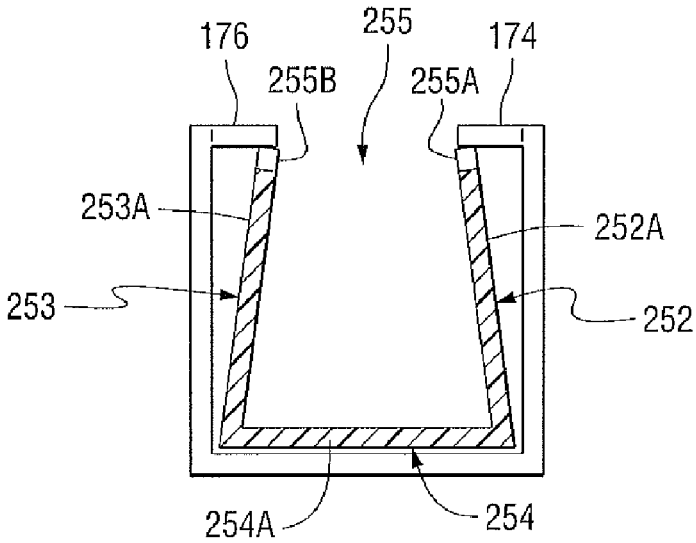
FIG. 7H is a view taken along lines 7H of FIG. 7G.

Shown in FIGS. 7C and 7D is another nonlimiting embodiment of a corner key 251 of the invention. The corner key 251 includes a first upright leg 252 and a second upright leg 253 spaced from one another and connected to a base 254 to provide the corner key 251 with a generally U-shaped cross section. Each of the legs 252 and 253 include a first outer portion 252A and 253A, a second outer portion 252B and 253B and an intermediate portion 252C and 253C between the outer portions 252A, 252B, and 253A and 253B, of the first and second legs 252 and 253, respectively. The base 254 similarly includes first and second outer portions 254A and 254B, and an intermediate portion 253C between the outer portions 254A and 254B. The intermediate portions 252C and 253C each include two cut outs 252D and 253D. The invention is not limited to the shape of the cuts and the cut outs can have different shapes. In one nonlimiting embodiment of the invention, the cut outs 252C each having a V-shape and an angle B. The size of the angle B as discussed above is a function of the corresponding angle of the corner of the spacer frame to be assembled. More specifically, the sum of the angle B for the corner key 251 is equal to the desired angle of the corresponding corner of the spacer frame. For example and not limiting to the invention, for a 90 degree corner of a spacer frame, each of the angles B of the corner key would be 45 degrees.

Vertex 252E and 253E of the V-shaped cut outs 252D and 253D, respectively extend below inner surface 254D of the base 254 for reasons discussed above. Optionally the intermediate portion 254C of the base 254 between the cuts 252D and 253D has a hole 254E extending through the base to move gas into and/or out of the compartment 58 between the sheets (see FIG. 1) for reasons discussed below. As can be appreciated, the hole 254E in the base 254 of the corner key 251 (see FIG. 7C), or a hole in the base 250 of the corner key 247 (FIG. 7A) can replace the need to provide a hole in a spacer section. Although not limiting to the invention, the centerline of the hole 254E (see FIG. 7D) is preferably at a 45 degree angle to the base of the spacer sections joined by the corner key to have a straight line to the corner opposite to the hole 254E to direct the gas stream toward the center of the unit.

In one nonlimiting embodiment of the invention, upper edge 252F of the outer portions 252A and 252B, and the intermediate portion 252B lie in a generally straight line, and upper edge 253F of the outer portions 253A and 253B, and the intermediate portion 253C also lie in a generally straight line. The outer portions of the legs 252 and 253, and the base 250 are sized to fit into an end of a spacer stock section, e.g. the end 245 of the spacer stock section 246 (see FIG. 7D) with the side 246 of the spacer section 246 extending above the upper edge 252F a distance equal to the thickness of the side 246A of the spacer section 246. In another nonlimiting embodiment of the invention, the upper edge 252F and 253F of the outer portions of the legs 252 and 253 can be below the upper edge 252F of the intermediate portion of the legs 252 and 253 as shown for the corner key 248 (see FIG. 7A).

When providing a corner key with one cut out, e.g. the corner keys 240 and 247 of FIGS. 6A and 7A, the outer surface of the corner key provides a single bend at the corner of the spacer frame, e.g. a 90 degree bend around corner 251A as shown in phantom in FIG. 7D. When providing two or more cut outs, e.g. the corner key 251 of FIG. 7C having two cut outs 252D and 253D, each bend is less than the total required bend of the corner key. For example, for a 90 degree spacer frame corner, the corner key can have two 45 degree bends. By reducing the angle of bend, less stress is applied to surface on the corner key at the bend, e.g. surface 254F of the corner key 251. In one nonlimiting embodiment of the invention, this feature of the invention is practiced to reduce the stress on the barrier layers 93 (see FIGS. 3B, and 3I) as the corner keys are bent to form the spacer frame. As can now be appreciated, the peripheral shape of the sheets 34 and 36 preferably correspond to the peripheral configuration of the spacer frame to reduce bending moments on the corners of the sheets, e.g. the corners of the sheets bending toward one another.

Figure 7F:
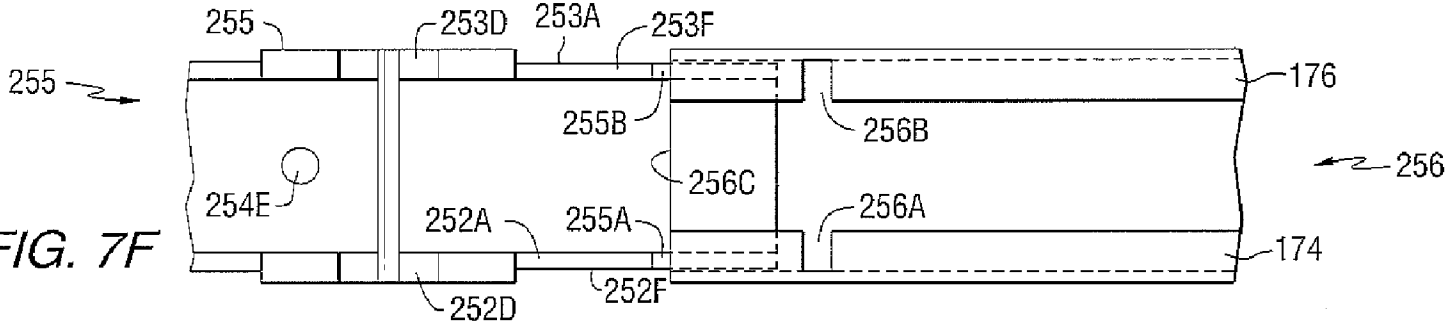
FIG. 7F is a top elevated view showing a portion of an end of the spacer key of FIG. 7E moved into an end of a spacer stock section.
Figure 7G:
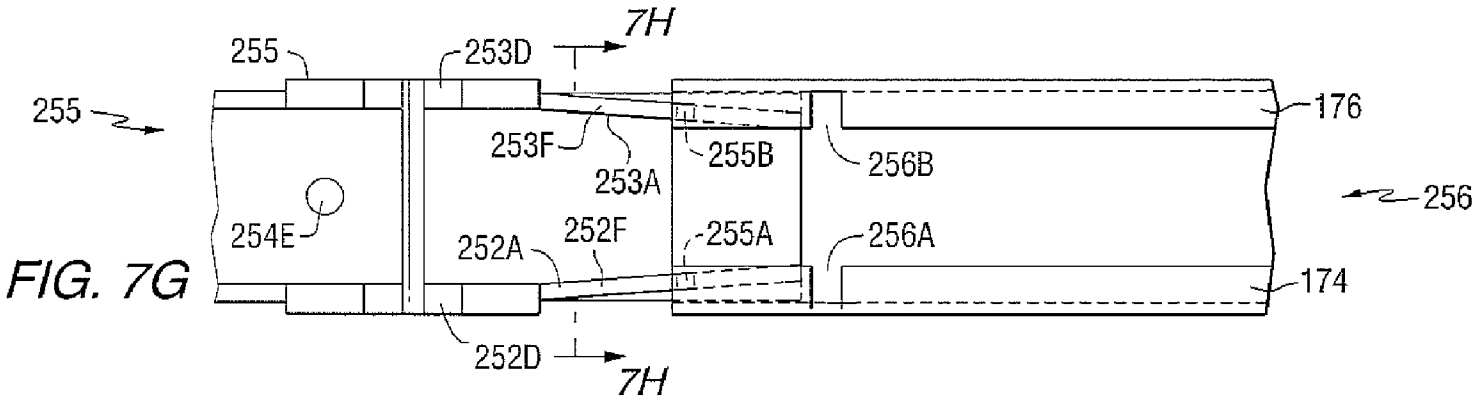
FIG. 7G is a view similar to the view of FIG. 7F showing the end of the corner key moved further into the end of the spacer stock section.
Figure 7I:
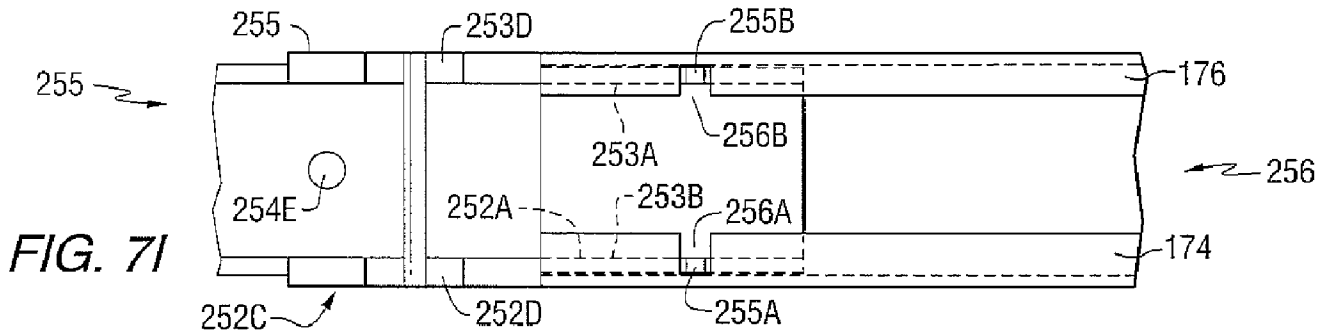
FIG. 7I is a view similar to the view of FIG. 7F showing the end of the corner key secured to the end of the spacer stock section in accordance to the teachings of the invention.

With reference to FIGS. 7E-7I, there is shown another nonlimiting embodiment of a corner key of the invention designated by the number 255. In this nonlimiting embodiment of the invention, the corner key has one part of a connector, e.g. a hole or a tab and the spacer section or spacer segment is provided with another part of the connector, e.g. but not limited to a tab or a hole, respectively, to secure the corner key to the ends of the adjacent spacer sections or the ends of a spacer stock segment. The corner key 255 is similar to the corner key 251 shown in FIGS. 7C and 7D except that the corner key 255 has a tab 255A on the edge 252F of each of the outer portions 252A and 252B of the leg 252, and a tab 255B on the edge 253F of each of the outer portions 253A and 253B of the leg 253 of the corner key 255. The tabs 255A and 255B of the outer portions 252A and 253A, respectively are received in openings, e.g. grooves or holes of the spacer section, to secure the corner key to the end of the spacer section. More particularly, in one nonlimiting embodiment of the invention, spacer section 256 is cut from a lineal of spacer stock 160 (see FIG. 3I). Grooves 256A and 256B are provided in each of the extensions 174 and 176, to receive the tabs 255A and 255B of the corner key 255, respectively. The end of the corner key is moved into end 256C of the spacer stock section 256 until the tabs 255A and 255B engage the end of the extensions 174 and 176, respectively, as shown in FIG. 7F. The outer portions 252A and 253A of legs 252 and 253, respectively, are moved toward one another against the internal biasing action of the corner key to move the tabs 255A and 255B below or outside of their respective extensions 174 and 176, and the corner key moved further into the end 256C of the spacer section 256 (see FIG. 7H) The corner key is moved further into the end of the spacer section until the tabs 255A and 255B are below or aligned with their respective groove 256A and 256B in their respective extensions 174 and 176. The tabs 255A and 255B move into their respective groove 256A and 256B, and the first and second legs 252 and 253 of the corner key 255 move away from one another under the internal biasing action of the corner key to slid and capture the tabs 255A and 255B in their respective groove 256A and 256B (see FIG. 7I). The forgoing is repeated at each end of each spacer section until the spacer frame is made. With this arrangement the spacer sections and corner keys are secured together.

The dimensions of the tabs 255A and 255*b* are not limiting to the invention. In one nonlimiting embodiment of the invention, the height of the tabs is equal to or slightly less than the thickness the extensions 174 and 176 so that the tabs do not extend above the extensions.

Figure 7J:
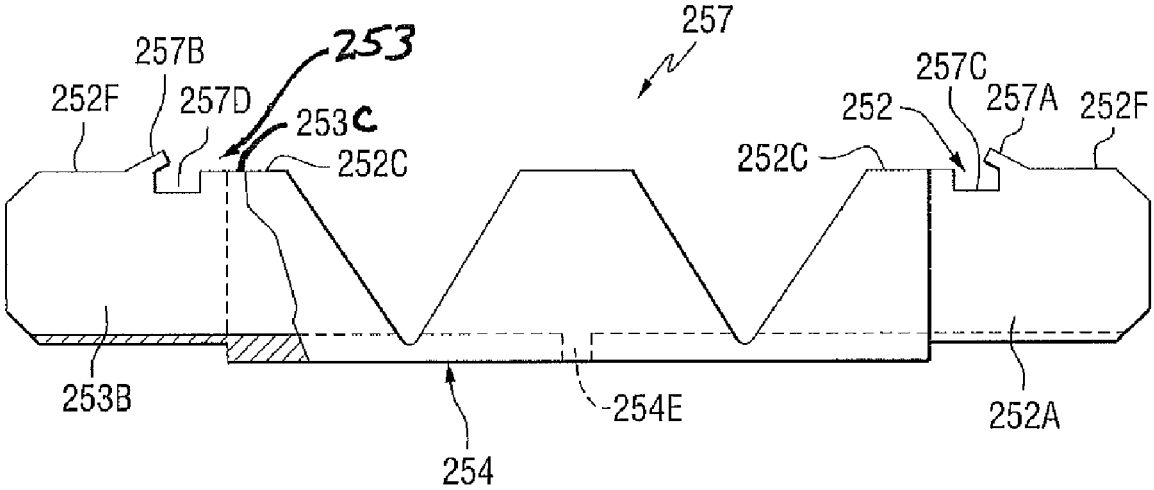
FIG. 7J is a view similar to the view of FIG. 7C showing a still further nonlimiting embodiment of a corner key of the invention.
Figure 7K:
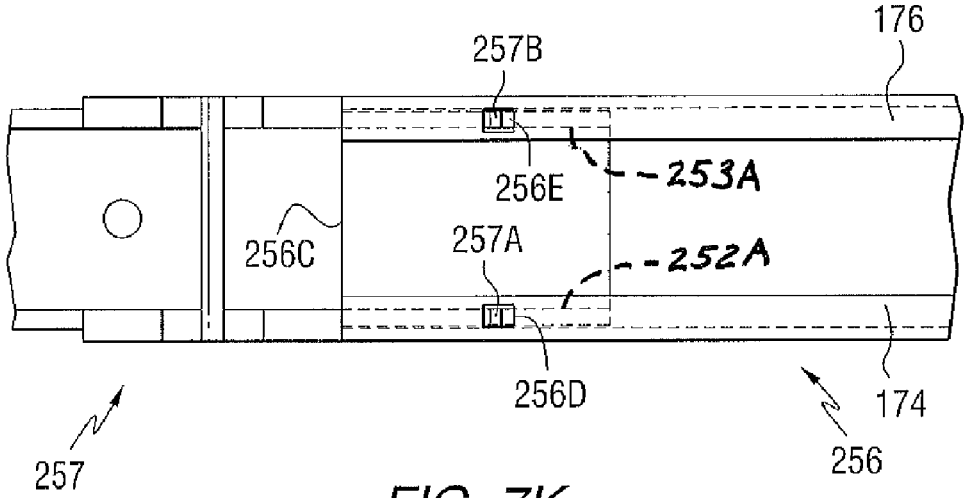
FIG. 7K is a view similar to view of FIG. 7I showing an end of the corner key of FIG. 7J secured to an end of a spacer stock section in accordance to the teachings of the invention.

Shown in FIG. 7J is another nonlimiting embodiment of the invention to secure one end of a corner key in the end of a spacer section. The corner key 257 shown in FIG. 7J is similar to the corner key shown in FIG. 7C except that the edge 252F of the outer portions 252A and 252B of the first upright leg 252 each have a finger 257A extending away from the edge 252F toward the intermediate portion 252C. Similarly, the edge 252F of the outer portions 253A and 253B of the second upright leg 253 each have a finger 257B extending toward the intermediate portion 253C. In one nonlimiting embodiment of the invention, end portions 252A and 253A are moved into the end 256C of the spacer section 256. The extensions 174 and 176 move the fingers 257A and 257B of the outer portions 252A and 253A into their respective pocket 257C and 257D against the internal biasing action of the corner key. When the fingers 257A and 257B are aligned with holes 256D and 256E in the extensions 174 and 176 of the spacer section 256, the fingers 257A and 257B of the end portions 252A and 253A move into the holes 256D and 256E (see FIG. 7K) under the internal biasing action of the corner key to secure the corner key 257 on the end 256C of the spacer section 256. The forgoing is repeated at each end of each spacer section until the spacer frame is made. With this arrangement the spacer sections and corner keys are secured together. As can be appreciated, the invention is not limited to the use of fingers, e.g. the fingers 257A and 257B, or the tabs, e.g. the tabs 255A and 255B, and the invention contemplates the outer surface of the end portions 252A and 253A having a friction surface, e.g. but not limited to peaks and valleys, e.g. but not limited to providing the raised portions 211 on the base 210 (see FIG. 3P) with pointed ends instead of rounded ends.

In a non-limiting embodiment of the invention, a number of spacer section, e.g. four spacer sections 256 are joined together by corner keys, e.g. three corner keys of the type shown in FIGS. 7A-7K. Optionally, one end of a corner key can be positioned in one end of the joined spacers. With a linear arrangement of the spacer sections joined by the corner keys, the desiccating system 100 is applied, e.g. extruded on the base of the spacer sections and the base of the corner keys between the upright legs. The corner keys are bent and the ends of the two outer spacer sections joined together, e.g. by the other end of a fourth corner key to form a spacer frame, e.g. a four sided spacer frame.

As can be appreciated, the invention is not limited to the arrangement to secure the corner key in the end of the spacer stock in the end of the spacer section, and the invention contemplates using mechanical fasteners, e.g. but not limiting to the invention screws, nails, rivets and/or adhesives. Further, the invention contemplates using features of one spacer for the features of another spacer. Still further, the invention is not limited to the dimensions of the corner keys, and the corner keys can be made of any size, and end portions and intermediate portions can be made of any length. Further as can now be appreciated by those skilled in the art, the values of the angles are approximate values, and the angle selected should bring the sides subtending the angle close together with minimum gap between the sides. For example and not limiting to the invention, a stated 90 degree angle could be an angle in the range of 85-90 degrees.

Figure 8:
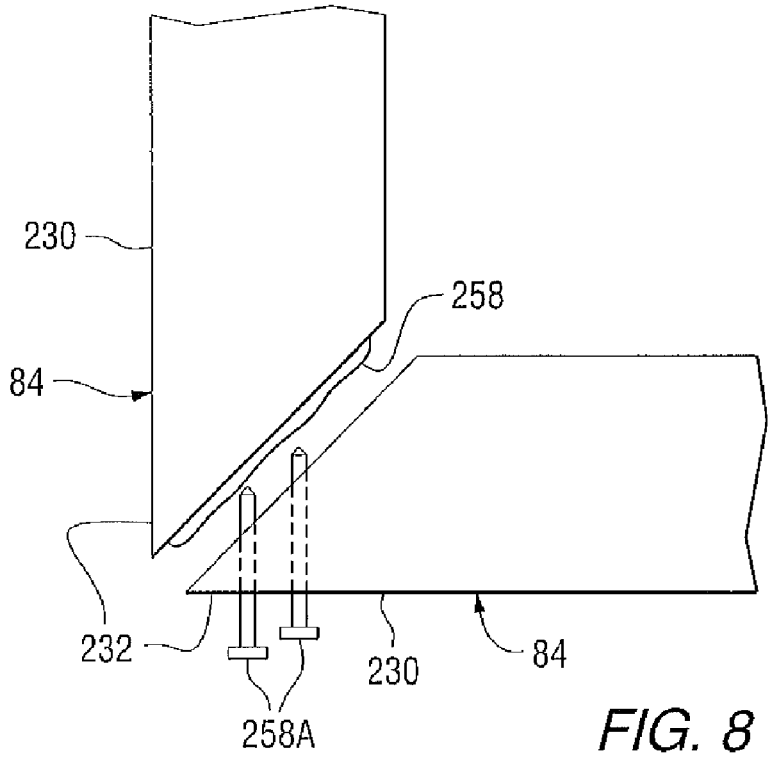
FIG. 8 is a fragmented elevated side view of end portion of two spacer stock sections of the invention being joined according to a nonlimiting embodiment of the invention.

In another nonlimiting embodiment of the invention, sections of spacer stock, preferably solid spacer stock, for example but not limiting the invention, the spacer stock 84 shown in FIG. 3B are joined to form the spacer frame 32 by cutting opposed corners 232 of the spacer stock section 230 at the desired angle and joining adjacent ends of adjacent spacer stock sections using an adhesive layer 258 and/or by mechanical fasteners 258B, e.g. screws, pop rivets and plugs as shown in FIG. 8. In another nonlimiting embodiment of the invention, a recess (not shown) is cut in the ends of the spacer stock sections and the adhesive layer 258 positioned in the recess. The adhesive is not limited to the invention and can be structural adhesive, e.g. silicone adhesive or a moisture and/or gas impervious adhesive-sealant, e.g. a polyisobutylene tape or any of the adhesive-sealants discussed above. As the mitered ends of the spacer stock section are brought together, the adhesive layers 258 are urged together to secure the spacer stock sections together to form the spacer frame. As can be appreciated using moisture and/or gas impervious adhesive-sealant to join the ends of the spacer stock section provides a spacer frame having moisture and/or gas impervious joined corners. The invention further contemplates providing strips of moisture impervious thermoset or thermoplastic adhesive sealant (not shown) between the adjacent ends 232 of adjacent spacer stock sections 230, and heating the adhesive sealant in any convenient manner to flow the adhesive sealant to join and seal the corners of the spacer frame.

Figure 9:
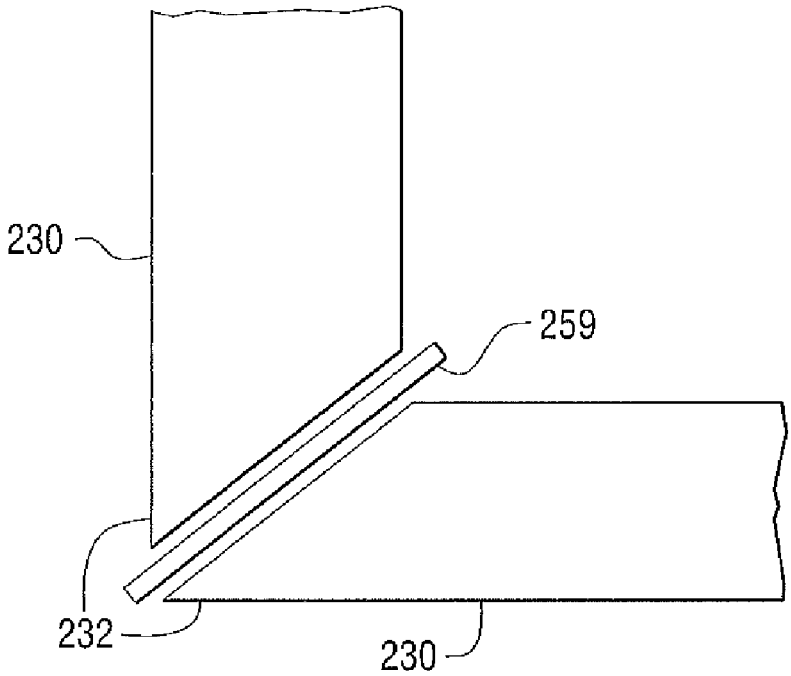
FIG. 9 is a view similar to the view of FIG. 8 showing ends of two spacer stock sections of the invention being joined according to another nonlimiting embodiment of the invention.

In another nonlimiting embodiment of the invention, ends of the spacer stock sections, e.g. of the spacer stock 84 shown in FIG. 3B, are joined by positioning a heatable plate 259 between the adjacent ends 232 of adjacent spacer stock sections 230 as shown in FIG. 9, and heating the plate to the melting temperature of the ends 232 of the spacer stock sections. As the heated ends of the adjacent spacer stock sections start to soften, the plate 259 is removed, and the adjacent ends 232 of the adjacent spacer stock sections 230 are moved together to join the ends of the spacer stock sections to form the spacer frame. When the barrier layer is plastic, ends of adjacent spacer stock sections are moved together, to join the spacer stock sections including the plastic barrier layer. After the spacer frame is formed, excess melted plastic is removed in any convenient manner, e.g. but not limiting thereto by air abrasion. When removing excess material, care should be taken not remove material which will damage an air tight joint and/or weaken the joint.

In a still further nonlimiting embodiment of the invention the adjacent ends 232 of adjacent spacer stock sections 230 are joined together by fusion welding, vibration welding, or any other type of welding. In the instance where the corners of the spacer fame are to be sealed corners, during the welding operation, an additional piece of weldable material (not shown) can be inserted between the ends of the sections as the ends are welded to form the spacer frame. The additional piece of weldable material provides additional material at the joints to ensure airtight welded joints. Although not limiting to the invention, the additional piece can be a flat piece of stock made from the same material as the spacer stock lineal.

In still another nonlimiting embodiment of the invention, a spacer frame is provided with one or more continuous corners. The term "continuous corner" as used herein means that the base of the spacer stock is continuous around the corner and optionally, portions of the sidewalls of the spacer stock section are continuous around the corner. In one nonlimiting embodiment of the invention, the base is continuous from a first corner, over a second corner to a third corner. For a detailed discussion of spacer frames having a continuous corner, reference can be made to U.S. Pat. Nos. 5,177,916 and 5,675,944, which patents are hereby incorporated by reference. In the following discussion, the technique for making a spacer frame having one or more continuous corners is discussed using the spacer stock 160 of FIG. 3I, however, the invention is not limited thereto and the technique discussed can be used with any of the spacer stocks discussed herein.

Figure 10:
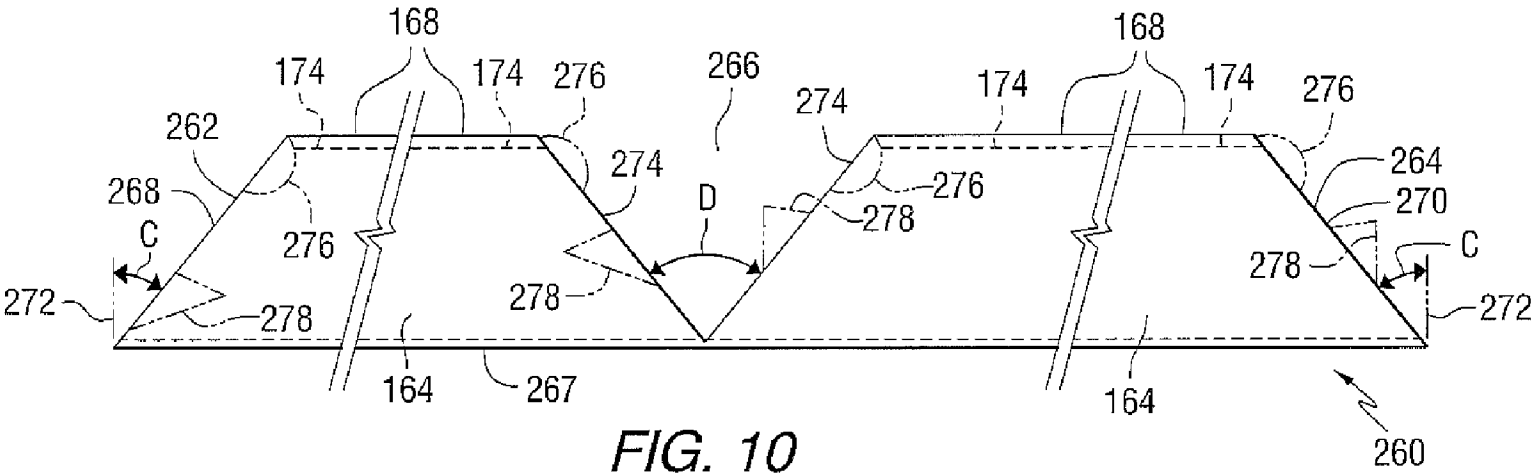
FIG. 10 is an elevated partial side view of a spacer stock segment of the invention prior to folding the segment to form a spacer frame, the segment having a nonlimiting embodiment of a continuous corner of the invention

With reference to FIG. 10, in one nonlimiting embodiment of the invention, a spacer stock segment 260 is cut from a lineal of spacer stock of the type shown in FIG. 3I to a length approximately equal to or slightly greater than of the perimeter of the spacer frame to be made. The angle C of cut of opposite ends 262 and 264 of the spacer stock segment 260, and angle D and number of cut outs 266 (only one shown in FIG. 10) made at locations between the ends 262 and 264 depends on the configuration of the spacer frame. For example, if the spacer frame to be made includes "X" number of corners, the spacer stock lineal 260 will have "X−1" notched cut outs 266 if the ends 262 and 264 of the spacer stock are to be joined at a corner of the spacer frame, or "X" notched cut outs if the ends of the spacer frame are to be joined between a pair of adjacent corners of the spacer frame. The intermediate cut outs 266, in one nonlimiting embodiment of the invention, have a generally V-shaped configuration and are made so as to not cut through the base 267 of the spacer stock segment 260, e.g. the base 172 of the spacer stock 160 (see FIG. 3I), and leave an uncut piece of extruded base around the selected corners of the spacer frame. In this manner, the base 267 of the spacer stock segment 260 is continuous at and around each of the corners where the lineal is notched. The use of multiple notched cut outs along the length of the segment 260 is not limiting to the invention and the number can be of whatever number is needed to form the desired shape of the spacer frame. The angles of the cut outs 266 along the length and the ends 262 and 264 of the segment 260 are adjusted to fit the desired angles at the corners of the spacer frame. The segment 260 is then folded at the cut outs 266, and the ends of the spacer stock lineal joined together in any convenient manner, for example by a corner key, e.g. of the type discussed above, welding, bonding, adhering with an adhesive, or an external fastener.

Figure 10A:
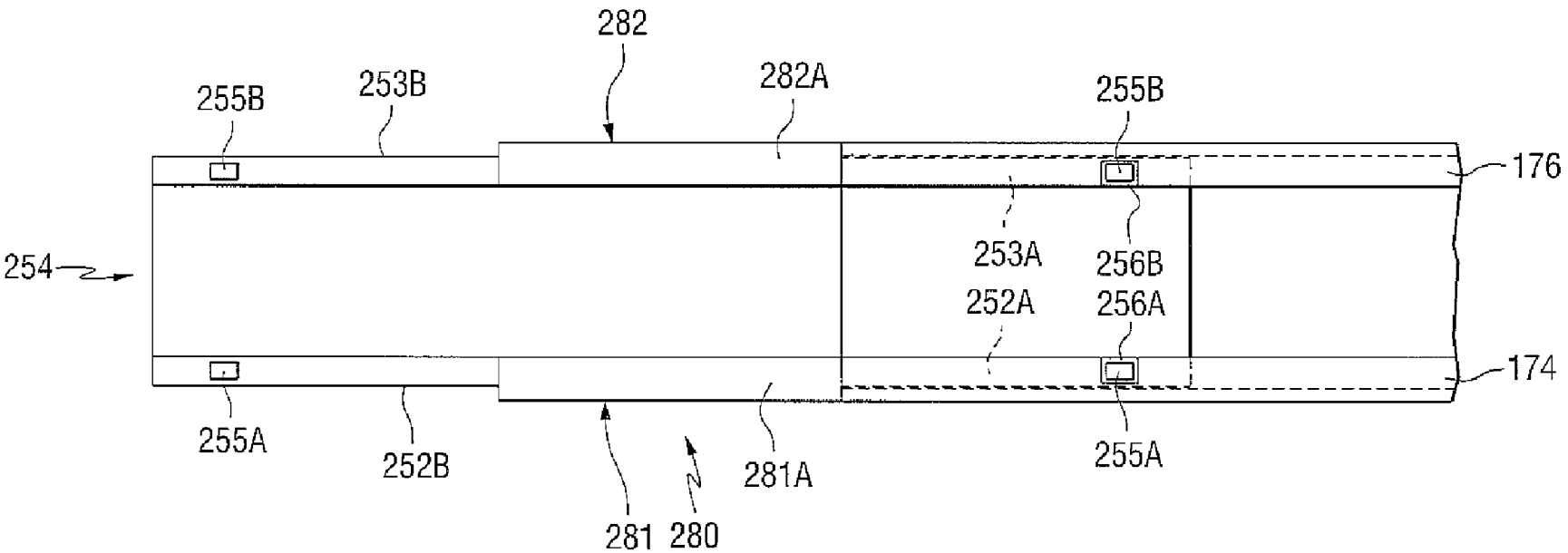
FIG. 10A is a plan view of a nonlimiting embodiment of a fastener of the invention having an end portion secured in an end of a spacer stock segment.

In the instance where the ends of the spacer stock segment are to be joined between corners, the ends of the spacer stock segment can be joined in any convenient manner, e.g. by welding, bonding, adhering with an adhesive, or a fastener. With reference to FIG. 10A there is shown one nonlimiting embodiment of a fastener of the invention to join ends of the spacer stock segment between the corners of the spacer frame. Fastener 280 shown in FIG. 10A is similar in construction to the corner key 254 shown in FIG. 7J but does not include the V-shaped cut outs. More particularly, first leg 281 of the fastener 280 includes intermediate portion 281A between the outer portions 252A and 252B, and second leg 282 of the fastener includes intermediate portion 282A between the outer portions 253A and 253B. The intermediate portions 281A and 282A of the fastener 280, unlike the intermediate portions 252C and 253C of the corner key 255, do not have the cut outs 252D and 253D (the cut outs clearly shown in FIG. 7C). The tabs 255A and 255B are captured in the grooves 256A and 256B of the extensions 174 and 176 as previously discussed. As can be appreciated, the other nonlimiting embodiments of the corner keys discussed above can be adapted for use as a fastener to join ends of the spacer stock segment between adjacent corners.

In a nonlimiting embodiment of the invention to make a spacer frame having a parallelepiped shape with the ends 262 and 264 of the upright legs of the spacer stock segment 260, e.g. the upright legs 168 of the spacer stock 160 of FIG. 3I joined at a corner of the spacer frame, the angle C of cut at both ends 262 and 264 of the segment 260 is approximately 40 to 45 degrees measured between the end of the segment and an imaginary line 272 normal to the plane of the base or web 267. The segment 260 has three intermediate notched cut outs 266 (only one shown in FIG. 10) made at locations between the ends 262 and 264 with sides 274 of the upright legs at the intermediate cut outs 266 forming an angle D of 90 degrees or in the range of 85 to 92 degrees. In another nonlimiting embodiment of the invention, the surface 268 of the upright legs 168 at the end 262 and the surface 270 of upright legs at the end 264 each subtend an angle C in the range from 40 to 43 degrees, and the surfaces 274 of the upright legs at the three intermediate cut outs 266 (only one shown in FIG. 10) form an angle D in the range from 80 to 86 degrees. In this manner, extra material, if needed in the welding process, will be available at each joint formed by the meeting of the ends 268 and 270 of the upright legs at the ends 262 and 264, respectively, and the surfaces 274 of the upright legs at the intermediate cut outs 266 to ensure that the corners of the spacer frame 32 are properly sealed. Additional advantages of not cutting through the base 267 of the spacer stock lineal 260 are that the alignment of adjacent corners during the making of the spacer frame is maintained, and the spacer frame is faster to fabricate than fabricating a spacer frame using individual spacer stock sections, e.g. as discussed above.

The surfaces 268 and 270 of the upright legs at the ends 262 and 264, respectively, and the surfaces 274 of the upright legs 168 and 170 at the cut outs 266 are not limited to a straight edge as shown in solid lines in FIG. 10. More particularly, in another nonlimiting embodiment of the invention, these surfaces are shaped, for example scalloped (imaginary line 276) or stepped (imaginary line 278) as shown in phantom in FIG. 10, to complement each other so that as the segment 260 is bent the surfaces 268 and 270 of the upright legs at the ends 262 and 264, respectively, and the surfaces 274 of the upright legs at the cut outs 266, move into contact with one another, fit together and enmesh to construct the completed spacer frame 32.

Figure 11:
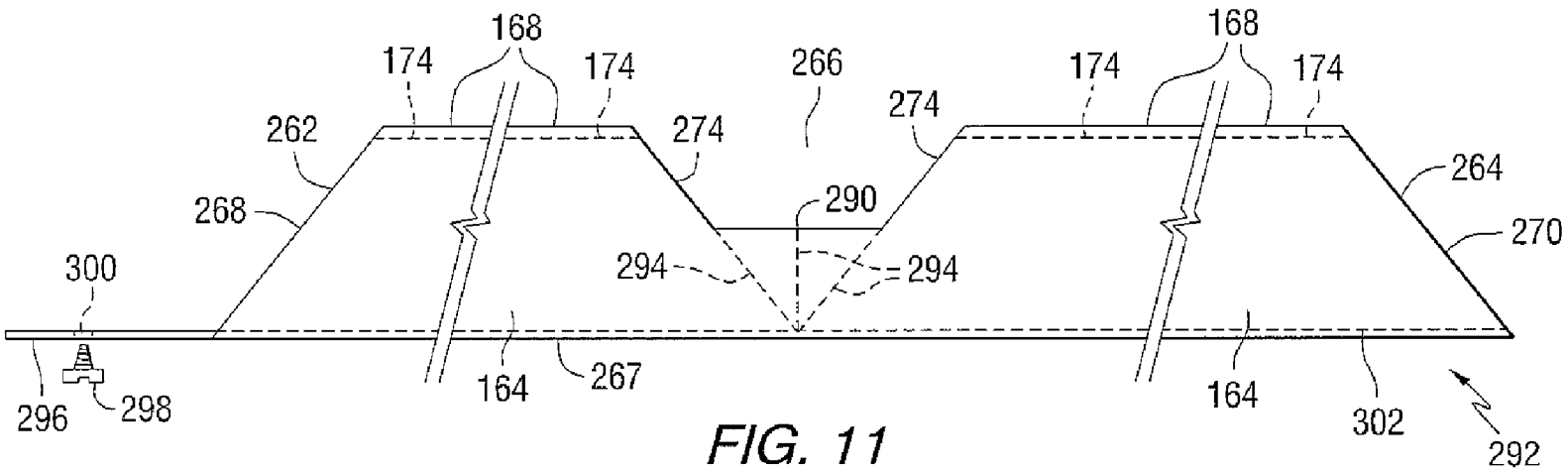
FIG. 11 is a view similar to the view of FIG. 10 showing another nonlimiting embodiment of a continuous corner of the invention.

The nonlimiting embodiment of the invention shown in FIG. 11 has a portion 290 of the upright legs 168 and 170 of spacer stock segment 292 (only upright leg 168 shown in FIG. 11, both upright legs 168 and 170 shown in FIG. 3I) is left in the intermediate notch cut outs 266. The portions 290 of the upright legs 168 and 170 is moved toward each other over the base 267 as the spacer stock segment 292 is bent to form the spacer frame, e.g. the spacer frame 32 shown in FIGS. 1 and 2. To facilitate the portion 290 moving over the base 267, weakening lines 294 are cut, pressed or formed in the portion 290. As can be appreciated the barrier layer 164 (clearly shown in FIG. 3I) can be removed from, or left on, the portion 290.

With continued reference to FIG. 11, one end, e.g. the end 262 of the spacer stock segment 292 is provided with a tab 296 extending away from the end 262. In this nonlimiting embodiment of the invention, as the spacer stock lineal is bent to the shape of the spacer frame, the tab 296 is inserted between the upright legs 168 and 170 at the end 270 of the segment 292 and secured in position by a fastener, e.g. screw 298 passing through hole 300 in the tab 296 and hole 302 in the base 267 of the segment 292 adjacent the end 264 of the segment 292. As can be appreciated, the invention is not limited to the manner in which the tab 296 is formed, e.g. the tab can be formed by heat swaging or by using a punch and die arrangement. Further, the shape of the tab 296 is not limiting to the invention and can include the tabs 255A and B (FIG. 7E), the fingers 257A and B (FIG. 7J), or a barbed shaped tab to frictionally engage the inner walls of the upright legs of the spacer stock segment.

Figure 12:
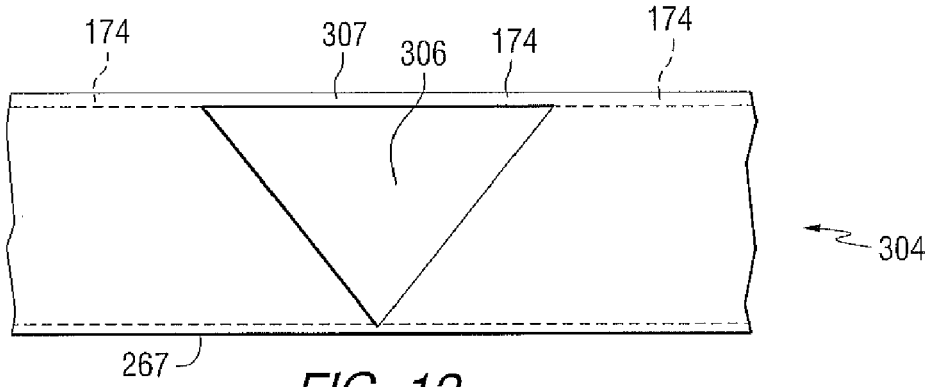
FIG. 12 is an elevated partial side view of a spacer stock segment of the invention showing still another nonlimiting embodiment of a continuous corner of the invention.

Shown in FIG. 12 is another nonlimiting embodiment of a continuous corner of the invention. Spacer stock segment 304 shown in FIG. 12 is similar to the spacer stock segment 260 shown in FIG. 10 except that in FIG. 10, the cut out 266 includes the removal of the portion of the extensions 174 and 176 (extensions clearly shown in FIG. 3I) whereas cut out 306 of the segment 304 includes portion 307 of the extensions 174 and 176 spanning the cut out 303 as shown for the extension 174 in FIG. 12. During the bending of the spacer stock segment 304 to form the spacer frame, the portion 307 of the extensions moves toward the base 267 of the segment 304.

Figure 13A:
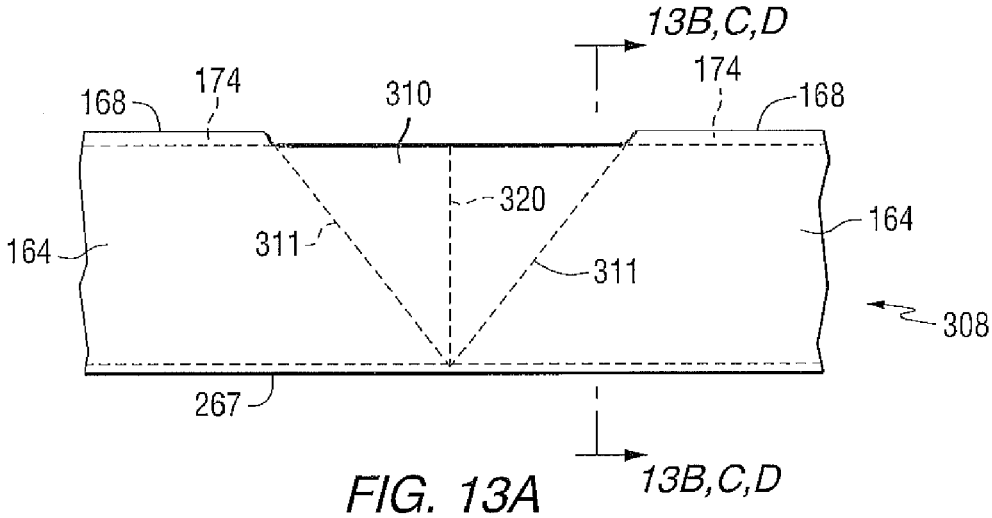
FIG. 13A is a view similar to the view of FIG. 12 showing a further nonlimiting embodiment of a continuous corner of the invention.
Figure 13B:
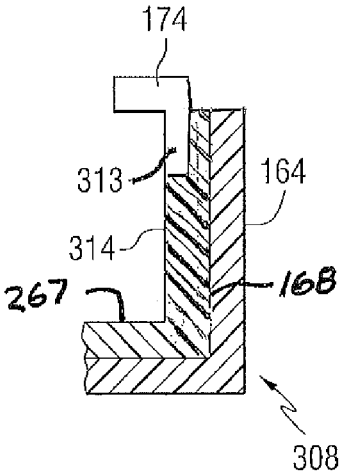
FIGS. 13B-13D are views taken along line 13B, 13C and 13D of FIG. 13A.
Figure 13C:
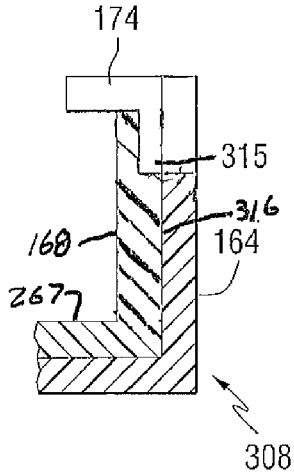
Figure 13D:
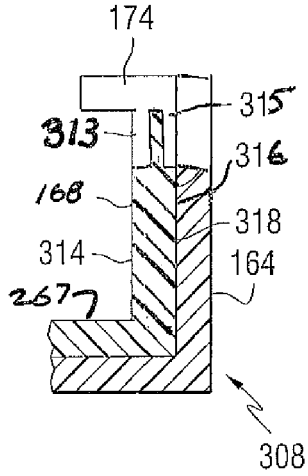

With reference to FIGS. 13A-13D there is shown other nonlimiting embodiments of the continuous corner of the invention. Spacer stock segment 308 shown in FIG. 13A is similar to the spacer stock segment 292 shown in FIG. 11 except that bend portion 310 of the segment 308 defined by bend lines 311 extends to the full height of the legs 168 and 170 (only leg 168 shown in FIG. 13A; legs 168 and 170 clearly shown in FIG. 3I) of the segment 308, whereas the portion 290 of the segment 292 of FIG. 11 has a height shorter than the height of the legs 168 and 170 (only leg 168 shown in FIG. 10). For ease of moving the portions 310 of the legs 168 and 170 of the segment toward one another over the base 267 of the segment 308, portions of the legs 168 and 170 between the bend lines 311 are removed. More particularly, and with reference to FIG. 13B, the portion of the extensions 174 and 176 (only the extension 174 shown in FIG. 13B), and portion 313 of inner surface 314 of the legs 168 and 170, between the bend lines 311 are removed; with reference to FIG. 13C, the portion of the extensions 174 and 176, and portion of the barrier layer 164 and outer surface 316 of the legs 168 and 170, between the bend lines 311 are removed, and with reference to FIG. 13D, the portion of the extensions 174 and 176, the portion 313 of inner surface 314 of the legs 168 and 170, and the portion of the barrier layer 164 and outer surface 316 of the legs 168 and 170, between the bend lines are removed leaving an intermediate portion 318 of the legs 168 and 179 of the segment 308. Optionally a center bend line 320 can be imposed on the portion 310 between the bend lines. The material can be removed from between the bend lines in any convenient manner e.g. by grinding, cutting, or shaving.

Figure 14A:
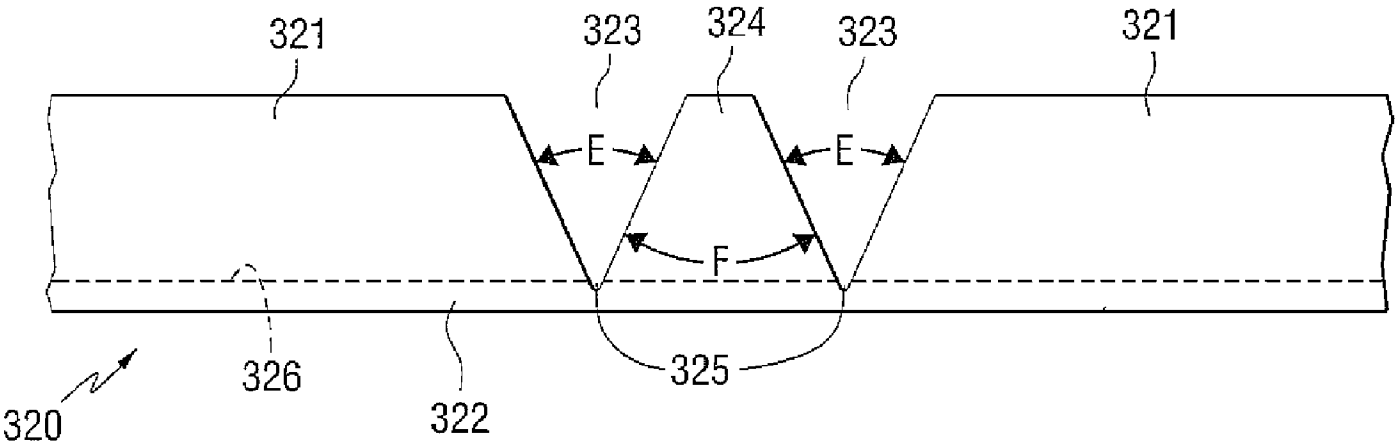
FIGS. 14A and 14B are views similar to the view of FIG. 12 showing additional nonlimiting embodiments of continuous corners of the invention.
Figure 14B:
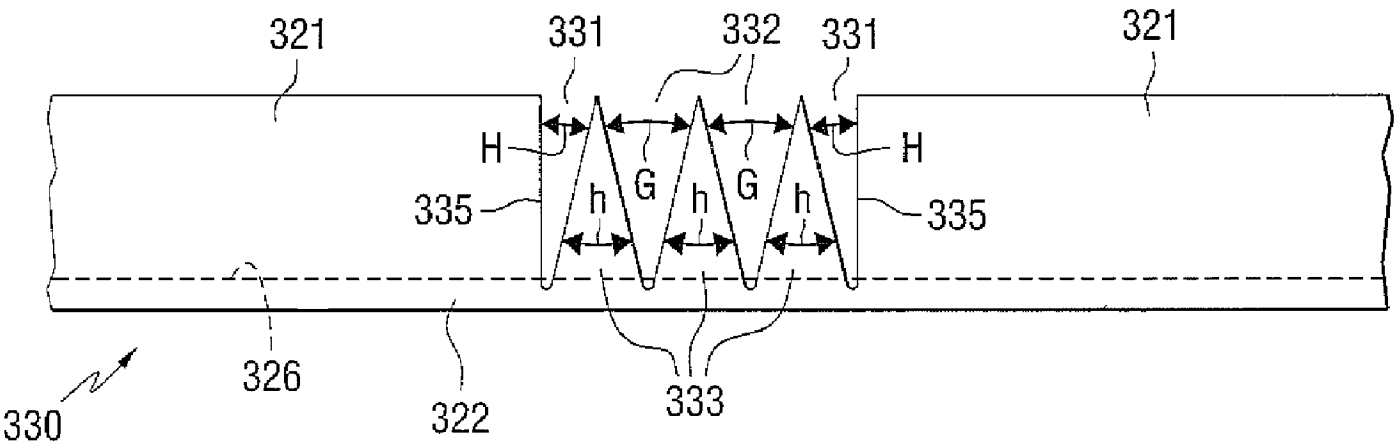

Shown in FIGS. 14A and 14B are additional nonlimiting embodiments of a continuous corner designed to facilitate the bending of the spacer stock segment to form a continuous corner. With specific reference to FIG. 14A, spacer stock segment 320 has a pair of spaced upright legs 321 (only one shown in FIG. 14A) connected to a base 322 to provide the segment 320 with a U-shaped cross section similar to the cross section of the spacer stock 150 of FIG. 3G. Each leg 321 has two V-shaped cut outs 323 separated by a leg portion 324. In the instance when the legs of the spacer stock segment have extensions, e.g. see spacer stock 160 in FIG. 3I, the portion of the extension can be left on the upper portion of the leg portion 324. With continued reference to FIG. 14A, each of the cut outs 323 has an angle E, and the leg portion 324 has an angle F. For a spacer frame having 90 degrees corners, angle F is 45 degrees. As can be appreciated, as the angle of the corners decrease and the number of cut outs remain constant, the angle of the cut out, e.g. angle E decreases and vise versa, and as the angle of the corners remain constant, and the number of cut outs increase, the angle of the cut out, e.g. angle E, decreases and vise versa. The discussion above relating to corner keys having two or more cut outs is applicable to the spacer stock segment having two or more cut outs shown in FIGS. 14A and 14B. Further, the farther vertex 325 of the cut outs 323 are from one another, the greater the length of the base 320 between the vertexes 325 of the cut outs and vise versa.

With continued reference to FIG. 14A, for ease of bending the spacer stock segment to form the corners of the spacer frame, the vertex 325 of the cut outs 323 can extend below inner surface 326 of the base or web 322 of the segment 320 with a groove (also designated by the number 325) extending from the vertices 325 of the cut outs 323 in one leg to corresponding vertices of the cut outs in the other leg as discussed above for the corner key 247 shown in FIG. 7A. The invention is not limited to the depth of the groove, and the discussion regarding the depth of the groove of the corner keys is applicable to this discussion. More particularly, the depth of the groove 325 into the base 322 in the range of 0-99% of the base thickness is acceptable, e.g. 50-95% of the base thickness, or 70-90% of the base thickness. In one nonlimiting embodiment of the invention, the spacer stock segment 320 is made of plastic and has a base having a thickness of 0.2250 inches (5.715 mm). The vertex 325 of the cut outs 323 each have a radius of 0.0150 inches (0.381 mm) and the groove extends into the inner surface 326 of the base 322 to a depth of 0.1950 inches (4.953 mm).

In the instance when the cut out of the designated corner of the spacer stock segment has the portion 290 in the cut out as shown for the segment 292 shown in FIG. 11, the base of the segment 292 between the cut outs 266 can be removed, e.g. by milling for ease of bending the segment 292 to form the spacer frame.

With reference to FIG. 14B there is shown another nonlimiting embodiment of a spacer stock segment of the invention. Segment 330 shown in FIG. 14B includes the two spaced upright legs 321 (only one shown in FIG. 14B) joined to the base 322 to provide the segment 330 with a generally U-shaped configuration. Each of the legs 321 includes a pair of outer cut outs 331 and a pair of inner cut outs 332 between the outer cut outs 331. Adjacent cut outs are separated by a leg portion 333. The inner cut outs 332 each have an angle G of 30 degrees, the outer cut outs 331 each have an angle H of 15 degrees, and the leg portions 333 each have an angle H of 30 degrees. The outer cut outs 331 each have a side 335 that lies in a line normal to the base 322.

As is appreciated, the invention contemplates the angle of the cut outs being equal or unequal, e.g. and not limiting to the invention the cut outs 323 of the segment 320 can be equal or unequal, e.g. one cut out can have a 60 degree angle and the other cut out can have a 30 degree angle. Further, the features of the segments shown in FIGS. 10-12, 13A-13D, 14A and 14B and discussed above can be used with one another. For example and not limiting to the invention, the portion 310 of the spacer stock segment 267 shown in FIGS. 13A-13D can be used in place of the cut outs 323 of the spacer stock segment 320 shown in FIG. 14A.

Still further the components of the corner keys shown in FIGS. 6A, 6B and 7A-7I, and the components of the segments shown in FIGS. 10-12, 13A-13D, 14A and 14B and discussed above can be interchanged with one another. For example and not limiting to the invention, the portion 310 of the spacer stock segment 267 shown in FIGS. 13A-13D, and/or the portion 290 of the upright legs of the section 292 shown in FIG. 11 can be used to fill in all or part of the V-shaped grooves 248D and 249D of the corner key 247 shown in FIG. 7A. With this arrangement, when the corner key is bent, the portions 290 are bent over the base of the corner key.

As is appreciated, the invention contemplates applying one of the desiccating systems discussed above, e.g. the desiccating system 100 to the spacer stock segment before forming the spacer frame or to the spacer frame.

The discussion is now directed to using the spacer frame 32 to make a multi-sheet insulating unit, the invention; however, is not limited thereto and can be practiced to make any type of multi-sheet unit. In this nonlimiting embodiment of the invention, the spacer frame is made from a spacer stock segment, or joined spacer stock sections, as discussed above; the spacer frame having a cross section of the spacer stock shown in FIG. 3I. A layer 48 of a moisture impervious adhesive sealant is applied to the outer opposite surfaces 42 and 56 of the space frame 32 (see FIG. 2) and the sheets 34 and 36 biased against its respective side 42 and 56 of the spacer frame to flow the adhesive and secure the sheets to the spacer frame.

Figure 15:
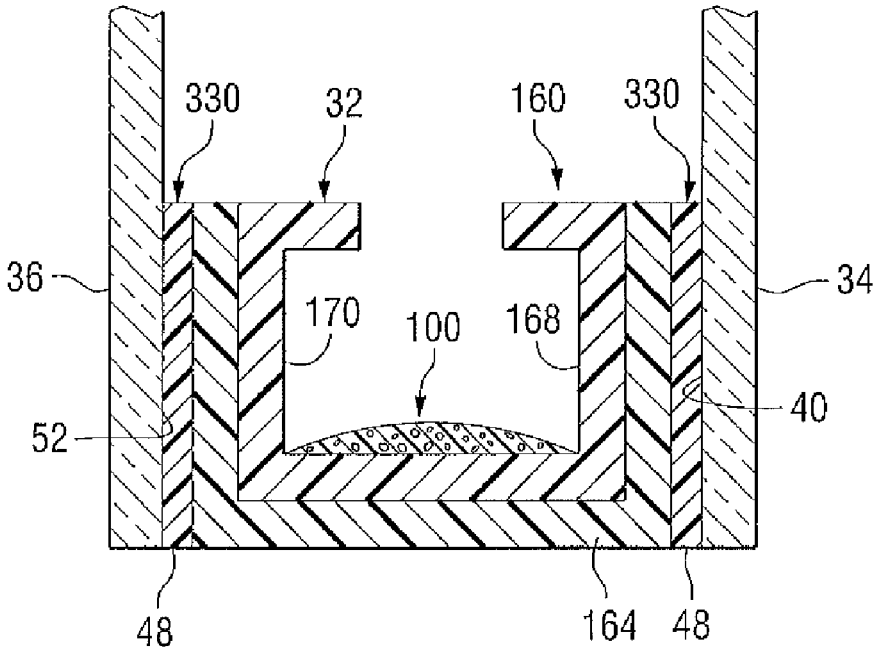
FIG. 15 is a cross sectional view of a nonlimiting embodiment of an edge seal of a multi sheet insulating unit of the invention.
Figure 16:
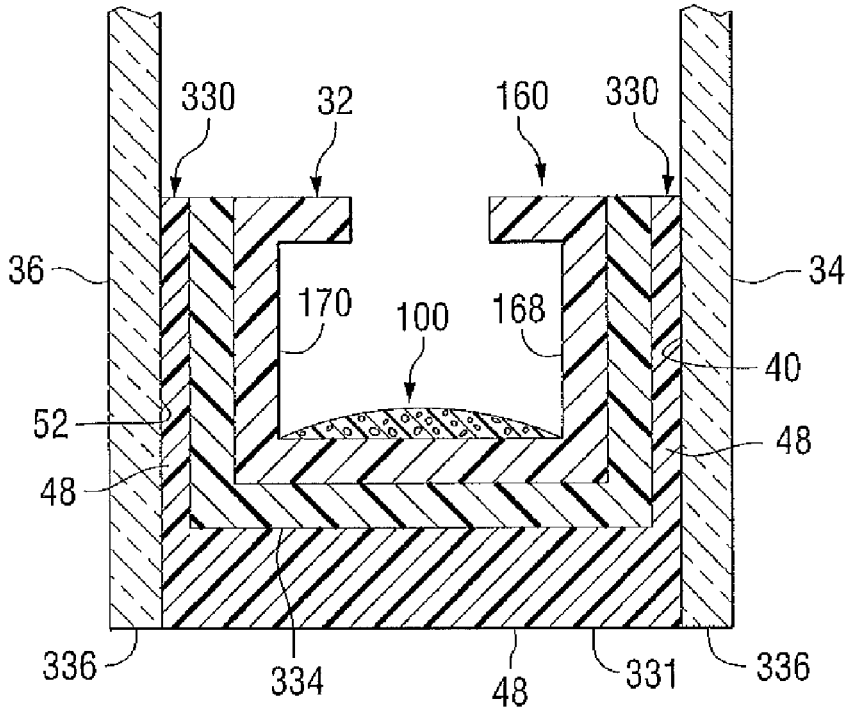
FIG. 16 is a view similar to the view of FIG. 15 showing another nonlimiting embodiment of an edge seal of the invention.

The adhesive-sealant layers 48 can be applied to the spacer frame 32 to provide a moisture and/or gas primary seal 330 (see FIGS. 2, 15 and 16) and/or a secondary seal 331 (see FIG. 16). The adhesive-sealant layer 48 between the inner marginal edges 40 and 52 of the sheets 34 and 36, respectively and adjacent one of the outer sides of the spacer frame 32 provides the primary seal 330. As is appreciated by those skilled in the art, there are two primary seals, one between each sheet and adjacent side of the spacer frame. The secondary seal 331 is the adhesive-sealant layer in peripheral channel 334 formed by positioning the spacer frame 32 with the base of the spacer frame between the sheets 34 and 36, and spaced from the peripheral edges 336 of the sheets as shown in FIG. 16.

In one nonlimiting embodiment of the invention of making a multi-sheet unit having a primary and secondary seal, the sheets and spacer frame are sized such that the sheets extend beyond the spacer frame to provide the peripheral channel 334. The adhesive-sealant layer 48 is provided on an outer side surface of the spacer frame and adjacent one of the sheets. The sheets are pressed toward one another to flow the adhesive-sealant layers to provide the primary seals. Thereafter, the layer 48 is provided in the peripheral channel 334 to provide the secondary seal 331.

In another nonlimiting embodiment of the multi-sheet unit of the invention, the sheets are secured to the spacer frame using a dual seal of (polyisobutylene) PIB/silicone, e.g. of the type disclosed in U.S. Pat. No. 5,675,944, which patent is hereby incorporated by reference. The PIB portion of the seal provides the moisture and/or gas impervious barrier, e.g. the primary seal, and the silicone provides the adhesive strength to secure the sheets against the spacer frame, e.g. the secondary seal.

The invention contemplates the insulating units of Group A and of Group B having the primary seals 330 and/or the secondary seal 331.

Group B Nonlimiting Embodiments of the Invention

Group B nonlimiting embodiments of the invention include, but are not limited to, spacer stocks, and spacer frames, for multi-sheet units having three or more sheets. The spacer stock, spacer frame and unit of Group B of the invention are not limited to the number of sheets the unit has, and the invention contemplates units of three or more sheets having each pair of adjacent sheets separated by a spacer frame, and units of three or more sheets having the sheets separated by one spacer frame.

Figure 17:
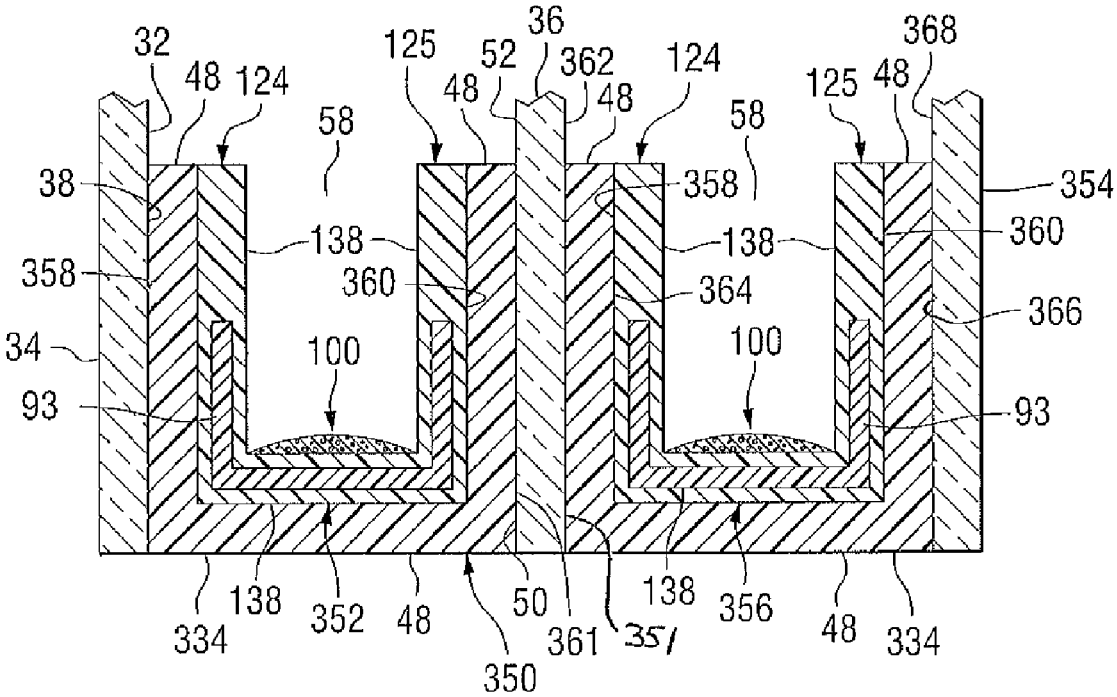
FIG. 17 is a view similar to the view of FIG. 15 showing a nonlimiting embodiment of an edge seal of a multi-sheet insulating unit of the invention having three sheets.

Shown in FIG. 17 is a multi-sheet insulating unit 350 having the sheets 34 and 36 secured to and separated by a spacer frame 352, and the sheets 36 and 354 secured to and separated by a spacer frame 356. Although not limiting to the invention, the spacer frames 352 and 356 are made from segments of the spacer stock 124 shown in FIG. 3F. The spacer frames 352 and 356 can be made from the spacer stock 124 in any convenient manner, for example and not limiting to the invention practicing one of the methods, or a variation of one or more of the methods, discussed above. In one nonlimiting embodiment of the invention, the unit 350 is fabricated by securing the marginal edges 38 of the inner surface 32 of the sheet 34 to side surface 358 of the spacer frame 352, and the marginal edges 50 of the inner surface 52 of the sheet 36 to the side surface 361 of the spacer frame 352, by the adhesive-sealant layer 48. Marginal edges 351 of opposite surface 362 of the sheet 36 are secured to the side surface 358 of the spacer frame 356, and marginal edges 366 of inner surface 368 of the sheet 354 are secured to side surface 360 of the spacer frame 356, by the adhesive layer 48. The sheets 34 and 354 are biased toward one another to flow the layers 48. Thereafter the peripheral channels 334 of the unit 350 are filled with the layer 48.

The invention further contemplates making a multi-sheet unit having three or more sheets using a spacer frame to space the outer sheets, e.g. the sheets 34 and 36, and providing one or more sheets within the spacer frame and between the sheets 34 and 36. In one nonlimiting embodiment of the invention, one or more sections of a spacer stock are positioned on the peripheral edges of the inner sheet(s) and the ends of spacer stock joined together to form a spacer frame having one or more sheets within the spacer frame. In another nonlimiting embodiment of the invention, the spacer frame is formed, e.g. as previously discussed, and one ore more sheets secured within the spacer frame.

Figure 18:
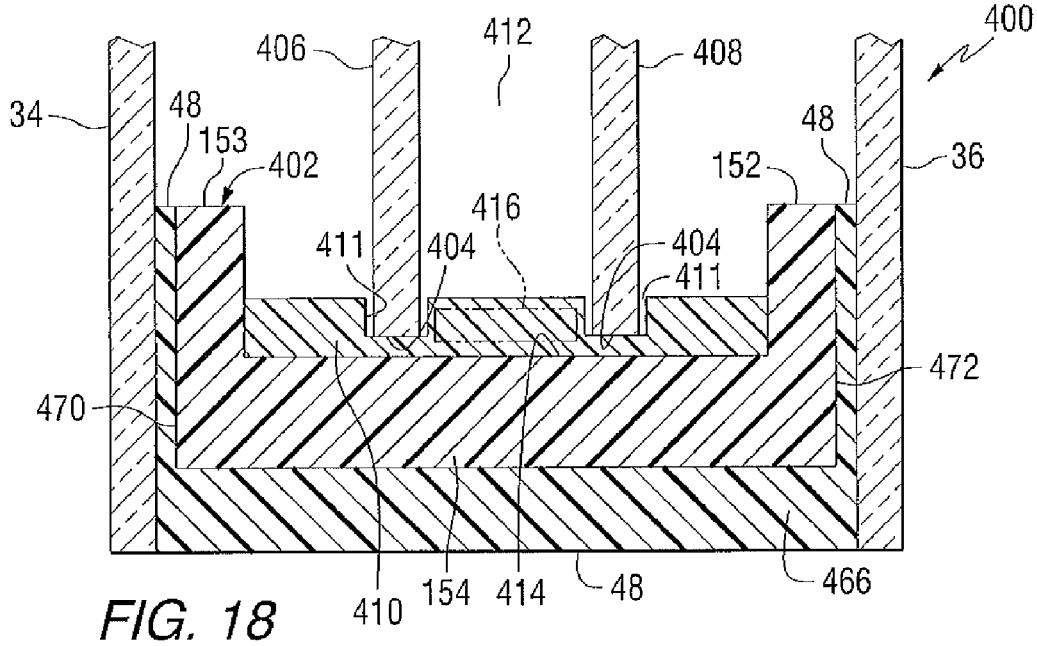
FIG. 18 is a view similar to view of FIG. 15 showing another nonlimiting embodiment of an edge seal of a multi-sheet insulating unit of the invention having four sheets.

With reference to FIG. 18, there is shown a multi-sheet unit 400 made by assembling a spacer frame 402 around peripheral edges 404 of inner sheets 406 and 408. The invention contemplates assembling the spacer frame around one sheet and more than two sheets. The spacer frame 402 can be made from any type of spacer stock; is preferably made from spacer stock 124 shown in FIG. 3F, the spacer stock 150 shown in FIG. 3G, or the spacer stock 160 shown in FIG. 3I, and is shown in FIG. 18 made from the spacer stock 150 shown in 3G. The inner sheets 406 and 408 are maintained in spaced relationship to one another within the space frame 402 by a sheet-retaining member 410 having grooves 411 to receive the peripheral edges 404 of the sheets 406 and 408 to provide a compartment 412 between the sheets 406 and 408.

The material and configuration of the sheet-retaining member 410 is not limiting to the invention and can be made of any material that can maintain the inners sheets 406 and 408 in a fixed relationship to one another. For example and not limiting to the invention, the sheet-retaining member can be formed from a preformed plastic spacer material of the type taught in U.S. Pat. No. 4,149,348, a flowable material of the type taught in, and applied as taught in, U.S. Pat. No. 5,531,047 or a hardened or rigid plastic or metal as taught in U.S. Pat. No. 5,553,440. The disclosure of the patents is hereby incorporated by reference.

In one nonlimiting embodiment of the invention, the material selected for the sheet-retaining member 410 is a material that is flowable onto inner surface 414 of the base 154 of the spacer stock 150 or spacer frame 402 and adheres thereto as contrasted to the desiccating system 155 shown in FIG. 3G, discussed above and in U.S. Pat. No. 4,149,348. The term "flowable material" means a material that can be flowed onto a surface, for example but not limiting to the invention, by extrusion or pumping. In the selection of the materials for the sheet-retaining member 410, consideration should be given to maintaining the inner sheets 406 and 408 in position e.g. prevent or limit their movement toward and away from one another. In one nonlimiting embodiment, materials that can be used in the practice of the invention are those materials that are flowable and remain pliable after flowing, and materials that are flowable and harden e.g. are dimensionally stable after flowing. The term "pliable materials" means materials that have a Shore A Hardness of less than 45 after 10 seconds under load. Pliable materials that can be used in the practice of the invention have a Shore A Hardness of less than 40 after 10 seconds, e.g. have a Shore A Hardness of 25 with a range of 20-30 after 10 seconds. The term "hardened material" is a material other than a pliable material.

In the instance where the inner sheets 406 and 408 are to be held in position only by a flowable material, the flowable material should be sufficiently rigid to maintain the inner sheets in position. In the instance where the flowable material is not sufficiently rigid, it is recommended that facilities be provided to secure the inner sheets in position. Also, if the flowable material requires time to become sufficiently rigid, and the unit 400 is to be moved prior to setting of the flowable material, it is recommended that facilities be provided to secure the inner sheets in position, e.g. a spacer block 416 shown in phantom between the inner sheets 406 and 408 in FIG. 18.

Figure 19:
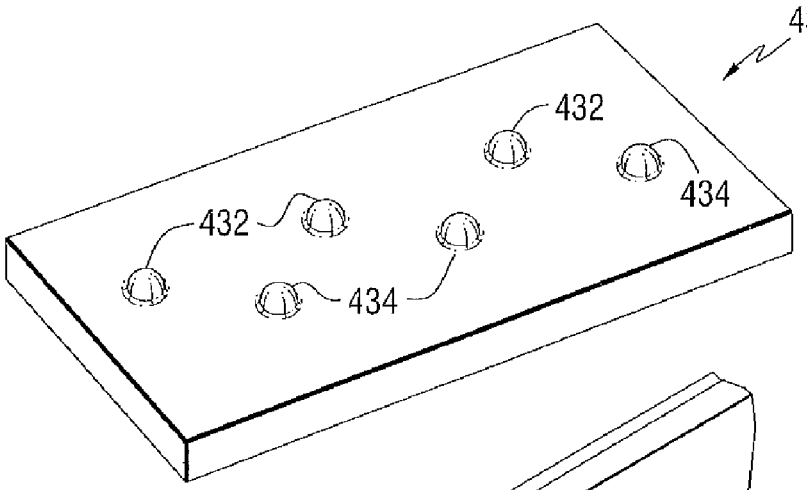
FIG. 19 is an isometric view of a strip for securing an inner glass sheet in position within a spacer frame in accordance to the teachings of the invention.

With reference to FIG. 19 there is shown another nonlimiting embodiment of a sheet retainer that can be used in the practice of the invention designated by the number 430. The sheet retainer 430 can be made of metal or plastic, and is preferably made of plastic because plastic has a lower thermal conduction of heat than metal. The sheet-retaining member 430 has a first row 432, and a second row 434, of spaced raised portions or bumps. The bumps of each row can be aligned with one another but are preferably off set from one another as shown in FIG. 19. The space between the rows 432 and 434 is sufficient to receive peripheral edge portions of a sheet in a similar manner as the grooves 411 of the sheet retainer 410 shown in FIG. 18. As can be appreciated, the sheet-retainer 430 shown in FIG. 19 is preferably used to secure one inner sheet in position within a spacer frame. Additional spaced rows of spaced bumps can be provided to secure additional inner sheets within the spacer frame.

Figure 20:
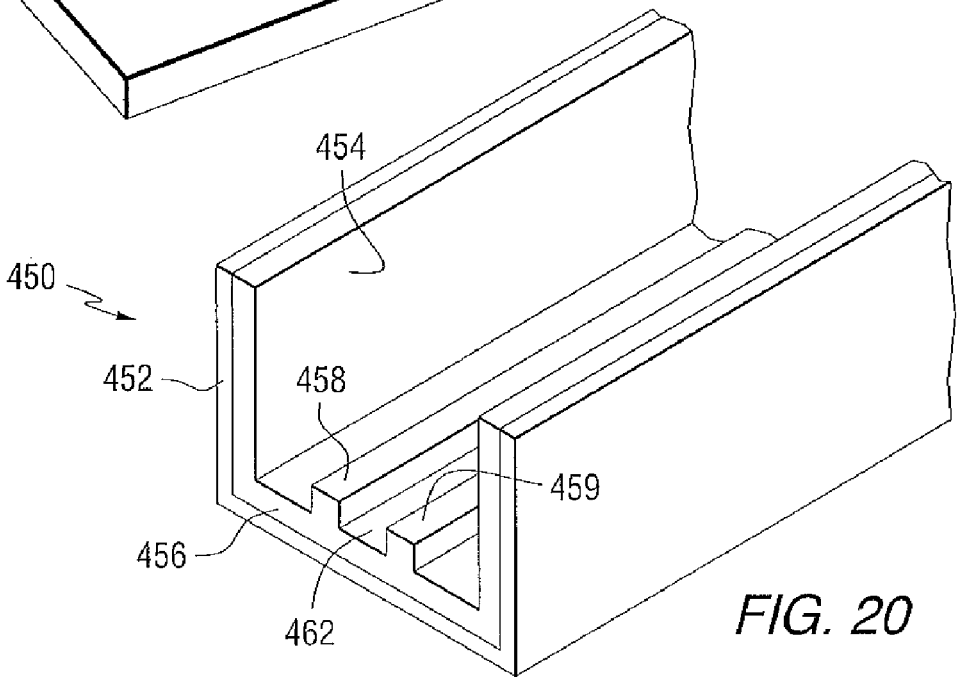
FIG. 20 is a partial isometric view of a lineal of a nonlimiting embodiment of a spacer stock of the invention used in the fabrication of a multi-sheet insulating unit of the invention having more than two sheets.

In another nonlimiting embodiment of the invention discussed in detail below and shown in FIG. 20, a groove between first and second continuous raised portions receives the peripheral edges of an inner sheet. As can be appreciated the invention is not limited to the manner in which the groove (s) of the sheet-retaining member 430 are formed to retain the inner sheet(s) in position, and any arrangement to form groove(s) can be used in the practice of the invention, e.g. and not limiting to the invention, the arrangements for forming a groove discussed in U.S. Pat. No. 5,553,440; the disclosure of U.S. Pat. No. 5,553,440 is hereby incorporated by reference.

In the instance where the sheet-retaining member, e.g. the sheet retainer 410 shown in FIG. 18 is to carry the desiccant to keep the compartment(s) of the unit dry, the material, e.g. the flowable material and preformed spacer material should be a moisture and/or gas pervious material, e.g. and not limiting to the invention the desiccating system 100 (see FIG. 3I) and the desiccating system 155 (see FIG. 3G).

The spacer stock 450 is similar to the spacer stock 160 of FIG. 3I in that the spacer stock 450 includes an outer layer 452 of the moisture and/or gas impervious plastic or metal over a U-shaped core 454 made from a moisture and/or gas pervious plastic material. Base 456 of the plastic core 454 includes a pair of spaced continuously raised portions 458 and 459 forming a groove 462 to receive peripheral edge of the inner sheet. As can be appreciate, the base 456 can have two or more grooves 462 to receive two or more sheets.

The invention further contemplates forming the legs of the spacer stock to retain the inner sheet between the spacer frame. More particularly and with reference to FIG. 3I, in one nonlimiting embodiment of the invention, the extensions 174 and 176 of the upright legs 168 and 170, respectively are spaced to receive the inner sheet. In another nonlimiting embodiment of the invention, the upturned end portions 190 of the extensions 188 and 189 of the upright legs 185 and 186, respectively of the spacer stock 184 of FIG. 3J are spaced to receive the inner sheet.

The invention is not limited to the desiccating system and any desiccating system can be used in the practice of the invention to maintain the compartment between adjacent sheets dry.

In one nonlimiting embodiment of the invention, the spacer frame of a multi-sheet unit of Group B is assembled from spacer stock sections in a similar manner as the spacer frame shown in FIG. 5 was assembled. More particularly and not limiting to the invention, spacer stock sections having a sheet retaining member are provided. The inner sheet has an outer configuration similar to the inner configuration of the spacer frame, e.g. a rectangular shape and the sheet is sized to fit in the groove of the inner sheet retaining members of the spacer stock sections when the sections are assembled into a spacer frame. A first spacer stock section is positioned on a side of the sheet with the edge of the sheet in the groove of the sheet retaining member of the first section; a second spacer stock section is positioned on the opposite side of the inner sheet with the edge of the sheet in the groove of the sheet retaining member of the second section; a third spacer stock section is positioned on one of the two remaining sides of the sheet with the edge of the sheet in the groove of the sheet retaining member of the third spacer stock section, and a fourth spacer stock is positioned on the remaining side of the sheet with the side of the sheet in the groove of the sheet retaining member of the fourth spacer stock section. The ends of the spacer stock sections of the spacer stock are secured together in any usual manner, e.g. with corner keys to form a spacer frame having an inner sheet.

In another nonlimiting embodiment, the spacer frame of a multi-sheet unit of Group B is made from a spacer stock segment having portions of the upright legs notched as previously discussed to designate the continuous corners of the spacer frame. The spacer stock segment having the sheet retaining member is wrapped around the peripheral edges of the inner sheet, moving the edge of the inner sheet into the groove of the sheet retaining member, e.g. the groove 411 of the sheet retaining members 410 shown in FIG. 18. After the elongated piece of spacer stock encompasses the inner sheet, the ends of the spacer stock segment are joined together.

With reference to FIG. 18, the outer sheets 34 and 36 have an outer configuration similar to the outer configuration of the spacer frame and are sized to extend beyond the periphery of the spacer frame to provide the peripheral channel 466. Marginal edge portions of the inner surface of the sheet 34 are adhered to one of the outer surfaces of the spacer frame, e.g. the outer surface 470 of the leg 153 of the spacer frame by the adhesive-sealant layer 48; marginal edge portions of the inner surface of the sheet 36 is adhered to the other one of the outer surfaces of the spacer frame, e.g. outer surface 472 of the leg 152 of the spacer frame by the adhesive-sealant layer 48; and the peripheral channel 466 is filled with the adhesive-sealant layer 48.

The invention contemplates providing a piece of the sheet-retaining member only on center portions of selected sides of the spacer frame between and spaced from the corners of the spacer frame, providing each side of the spacer frame with spaced pieces of the sheet-retaining member, providing each side of the spacer frame with a sheet-retaining member extending from one corner to the adjacent corner, providing a sheet-retaining member on every other side of the spacer frame, and combinations of the forgoing.

The invention further contemplates positioning one or more sheets within a spacer frame after the spacer frame is assembled In one nonlimiting embodiment of the invention, the inner sheet(s) is (are) sized such that the inner sheet(s) is (are) slightly smaller than the perimeter of the open area within the spacer frame and is (are) held in position within the spacer frame by sheet engaging members that engage marginal edge portions of the inner sheet(s). In another nonlimiting embodiment of the invention, the inner sheet(s) is (are) sized such that one side of the inner sheet(s) is (are) mounted between the upright legs or sides of the spacer frame and can be pivoted through the open area of the spacer frame. In this embodiment of the invention, the inner sheet(s) is (are) held within the spacer frame by the sheet engaging members engaging portions of one or more of the remaining sides of the sheet(s) that move(s) through the open area of the spacer frame.

Figure 21:
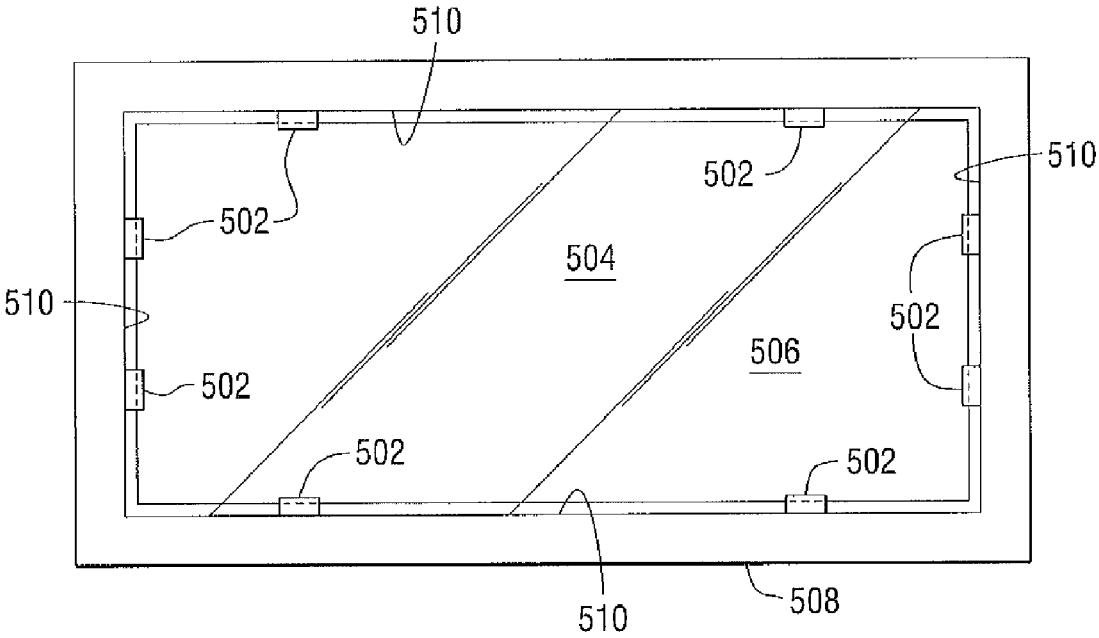
FIG. 21 is a plan view of a spacer frame having an inner sheet within the spacer frame in accordance to the invention.

With reference to FIG. 21, the discussion is now directed to the nonlimiting embodiment of the invention using sheet engaging members 502 to secure an inner sheet 504 sized to pass through open area 506 of spacer frame 508. The sheet engaging members 502 are mounted on inner surface 510 of the spacer frame 508 defining the open area 506.

Figure 22:
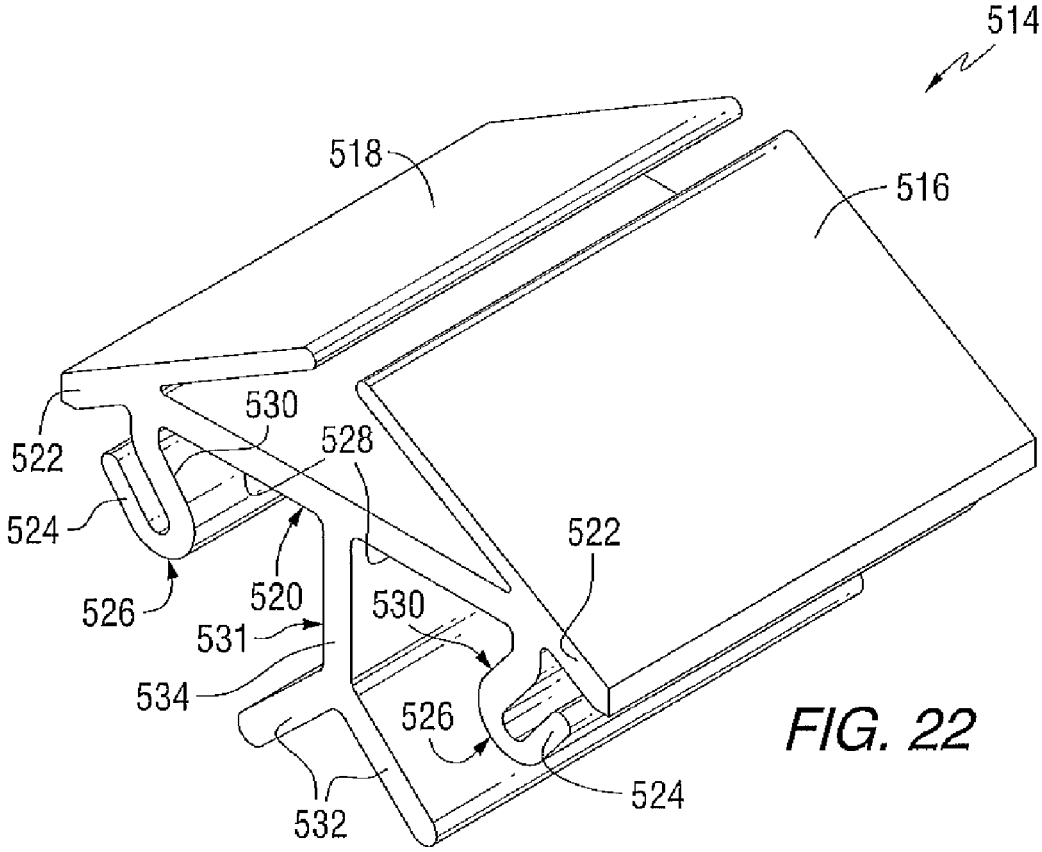
FIG. 22 is an isometric view of a sheet-engaging member used in one nonlimiting embodiment of the invention to secure an inner sheet within a spacer frame.
Figure 23:
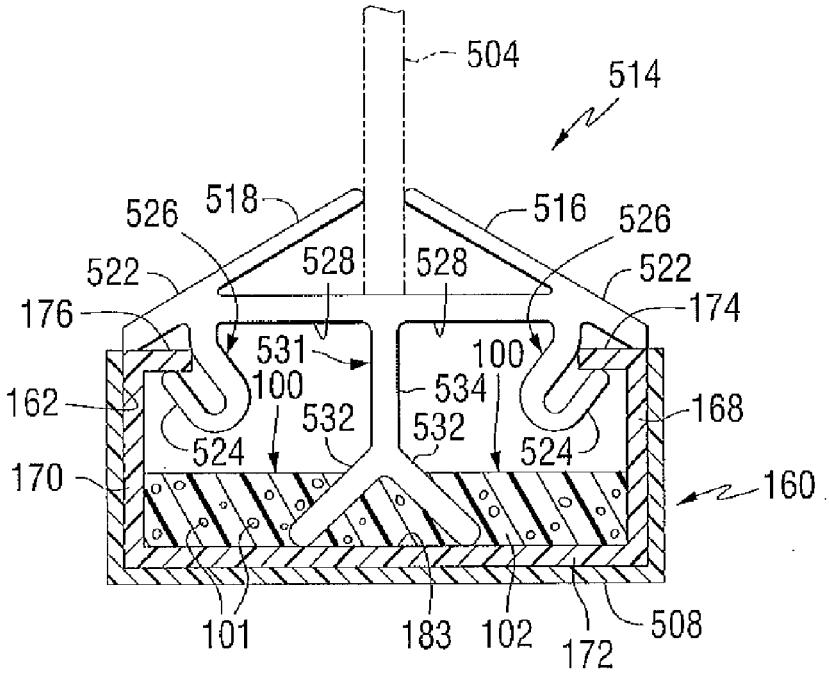
FIG. 23 is a cross sectional view of a spacer stock section or segment of the invention having the sheet engaging member of FIG. 22.

With reference to FIGS. 22 and 23, and with specific reference to FIG. 22, sheet engaging member 514 has a plurality of fingers 516 and 518 mounted to support platform or facilities 520 as shown in FIG. 22 to engage and/or capture the inner sheet 504 between the fingers 516 and 517 in a manner discussed below. The support platform 520 includes extensions 522, which rest on upper portions of the spacer frame. For example and not limiting to the invention, in FIG. 23, the extensions 522 of the sheet engaging member 514 are resting on the extensions 174 and 176 of the upright legs 168 and 170, respectively of the spacer stock 160 of FIG. 3I used to make the spacer frame 508.

Although not limiting to the invention and as shown in FIG. 23, the extensions 174 and 176 of the spacer stock 160 are captured between the extensions 522 and flexible fingers 524. The flexible finger 524 is a part of U-shaped member 526 attached to bottom surface 528 of the support platform 520. The other finger 530 of the U-shaped member 526 is less flexible, i.e. more rigid, than the finger 524 and is attached to the bottom surface 528 of the support platform 520. The support member 520 and fingers 524 and 530 are sized and shaped such that moving the sheet engaging member 514 between the extensions 174 and 176 of the spacer stock 160, biases the finger 524 toward the finger 530. Continued downward motion of the sheet engaging member 514 as viewed in FIG. 23 seats the extensions 522 of the support member 520 on the extensions 174 and 176 as viewed in FIG. 23 and the extensions 174 and 176 disengage the fingers 524 allowing them to move under the extensions to capture the sheet engaging member 514 on the inner surface 510 of the spacer frame 508.

The sheet-engaging member can be mounted on the inner surface 510 of the spacer frame in any convenient manner depending on the shape of the spacer stock used to make the spacer frame. For example, and with reference to FIG. 24, sheet-engaging member 540 has the fingers 516 and 518 mounted on support platform 542. Surface 544 of the sheet-engaging member 540 is secured to side 66 of the spacer stock 60 (see FIG. 3A) used to make the spacer frame 508. The surface 544 can be secured to the surface 66 of the spacer stock 60 in any usual manner, e.g. and not limited to an adhesive, e.g. the adhesive-sealant of the layer 48 (not shown) or by a mechanical arrangement, e.g. screws (not shown). As can be appreciated, the sheet engaging member 540 can also be used with spacer frames made using sections or segments cut from a lineal of the spacer stock 84 shown in FIG. 3B and 106 shown in FIG. 3C.

In the instance where the sheet engaging member 514 is used with a U-shaped spacer frame having extensions, e.g., the spacer frame 160 shown in FIG. 3I, and the inner sheet 32 has significant weight or more than one inner sheet is used, a support shim 531 shown in FIGS. 22 and 23 can be used as to prevent the sheet engaging member 514 from dropping between the legs of the spacer frame. The support shim 514 can be made of any structurally stable material and is preferably made of plastic. The support shim 531 has an inverted Y shape with legs 532 resting on the inner surface 183 of the base 172 of the plastic core 162 of the spacer frame 508, and leg 534 of the shim 531 connected or in surface contact with the support platform 520. When the support shim 531 and the desiccating system 100 having the desiccant 102 are used, the adhesive 101 of the desiccating system 100 can be provided on each side of the support shim 531 or the shim can be pushed into the adhesive 101 if it is sufficiently soft. One type of adhesive that is soft at room temperature and can be used as the matrix 102 of the desiccating system 100 is PRC 525DM sold by PRC-DeSoto International. As can be appreciated, the size of the shim is not limiting to the invention and any size that fits within the upright legs of the spacer frame can be used in the practice of the invention.

Figure 25:
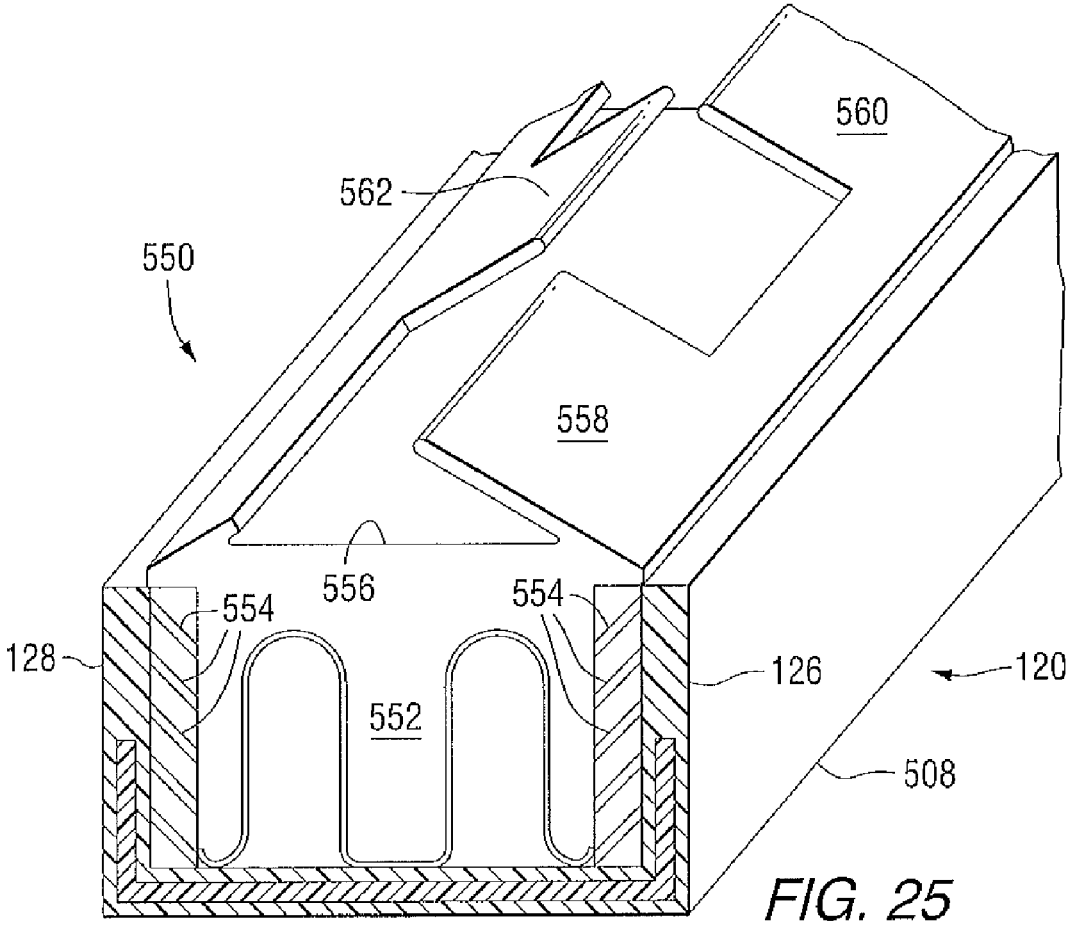
FIG. 25 is an isometric view of another embodiment of a sheet-engaging member for securing a sheet within a spacer frame.

Shown in FIG. 25 is sheet engaging member 550 having a shim 552 having an "M" cross section and fins 554 to capture the sheet engaging member 552 between the legs 126 and 128 of the spacer stock 120 shown in FIG. 3F. Platform 556 of the shim 552 has a pair of fingers 558 and 560 on one side of the platform and one finger 562 on the other side of the platform.

Figure 24:
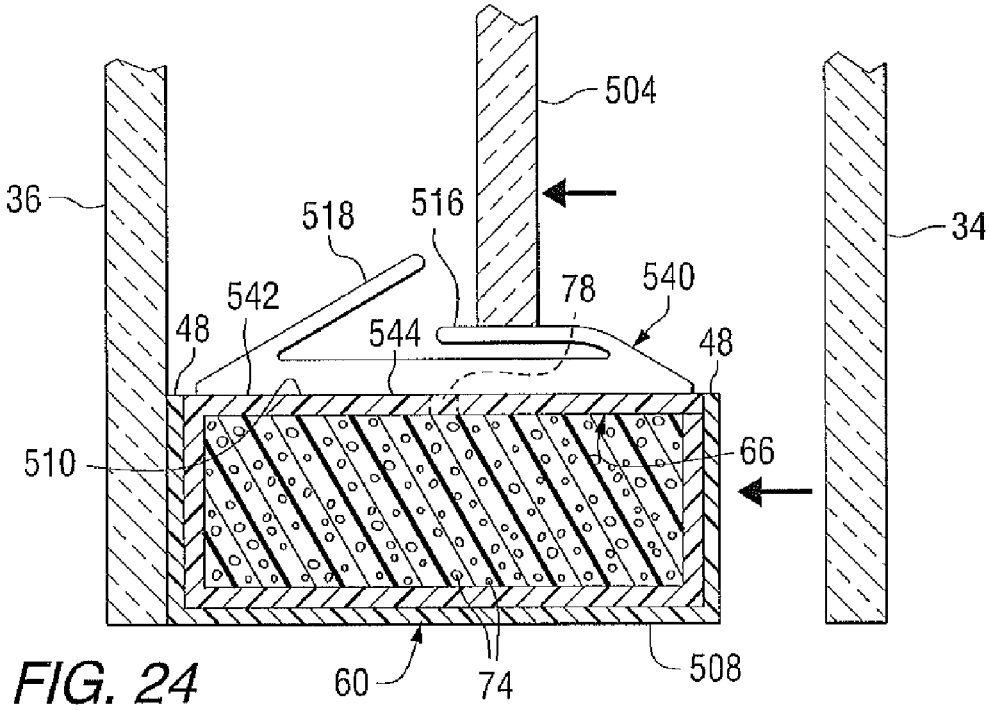
FIG. 24 is a cross-sectional view showing a step in the fabrication of multi-sheet insulating unit of the invention.

With reference to FIG. 24, in the practice of a nonlimiting embodiment of the invention, the spacer frame 508 is fabricated from sections or segments cut from a lineal of the spacer stock, 60 of FIG. 3A in any convenient manner, e.g. as discussed above. A pair of sheet engaging members 540 (see FIGS. 21 and 24) equally spaced is secured by an adhesive to the inner surface 510 (side 66 of the spacer stock 60) of the spacer frame 508. One of the outer sheets 34 or 36, the outer sheet 36 in FIG. 24 is held to one side of the spacer frame 508 by the adhesive-sealant layer 48. The inner sheet 504 is moved to the left as viewed in FIG. 24 biasing the finger 516 toward the inner surface 510 of the spacer frame 508. The sheet 504 is further moved to the left against the finger 516 until the inner sheet 504 clears the end of the finger 516 after which the finger 516 moves away from the surface 510 of the spacer frame 508 to the unbiased position as shown for the fingers 516 and 518 in FIGS. 22 and 23. The inner sheet 504 is captured between the fingers 516 and 518 as shown in phantom in FIG. 23. Thereafter the other sheet 34 is held to the other side of the spacer by the adhesive-sealant layer 48, and the outer sheets biased toward one another to flow the layers 48. Optionally, the inner sheet 504 is captured between the fingers 516 and 518 as shown in phantom in FIG. 18, after which the sheets 34 and 36 are secured to the outer surfaces of the spacer frame by the adhesive-sealant layer 48 as previously discussed.

Figure 26:
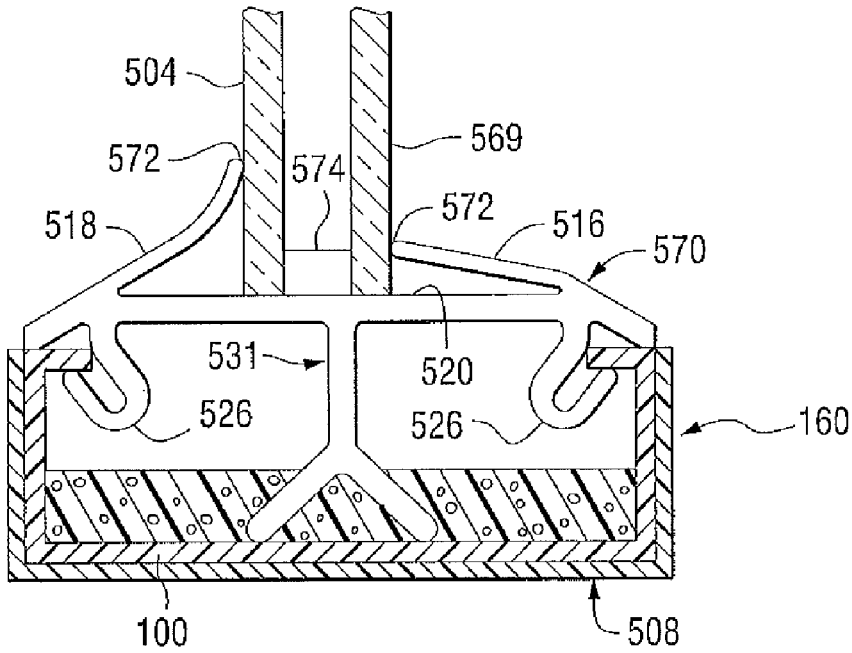
FIG. 26 is a cross sectional view showing a step in the fabrication of multi-sheet unit in accordance to the teachings of the invention.

With reference to FIG. 26, there is shown the edge construction of a multi-sheet unit having two inner sheets 504 and 569. The spacer frame 508 is provided as previously discussed and sheet engaging members 570 (only one shown in FIG. 26) are secured on the inner surface of the frame 508 by the U-shaped members 526 as previously discussed for the sheet engaging member 514 (see FIGS. 22 and 23). The spacing between ends 572 of the fingers 516 and 518 is equal to or slightly larger than the thickness of the two inner sheets 504 and 569, and sheet-separating frame 574. The sheet 504 is mounted between the fingers 516 and 518 of the sheet-engaging member 570 as previously discussed. The sheet-separating frame 574 is mounted between the sheet 504 and one of the fingers, e.g. the finger 516 of the sheet-engaging member 570. Thereafter the sheet 569 is moved to the left as viewed in FIG. 26 to move the finger 516 toward the spacer frame 508. Continued movement of the sheet 569 to the left moves the sheet separating frame 574 and the inner sheet 504 to the left as viewed in FIG. 26. After the peripheral edge of the sheet 569 moves past the end 572 of the finger 516, the finger 516 moves away from the spacer frame 508, e.g. to the unbiased position, to capture the inner sheets 504 and 569 between the fingers 516 and 518 and to separated the sheets by the sheet separating frame 574. The outer sheets 34 and 36 are mounted to the spacer frame 508 as previously discussed.

Figure 27:
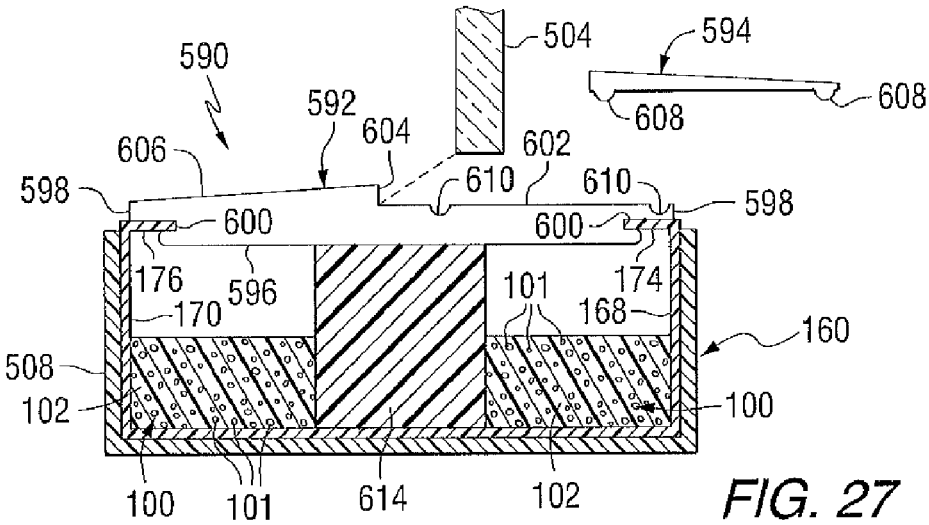
FIGS. 27-29 are views similar to the view of FIG. 26 showing steps in the fabrication of multi-sheet unit in accordance to the teachings of the invention.
Figure 28:
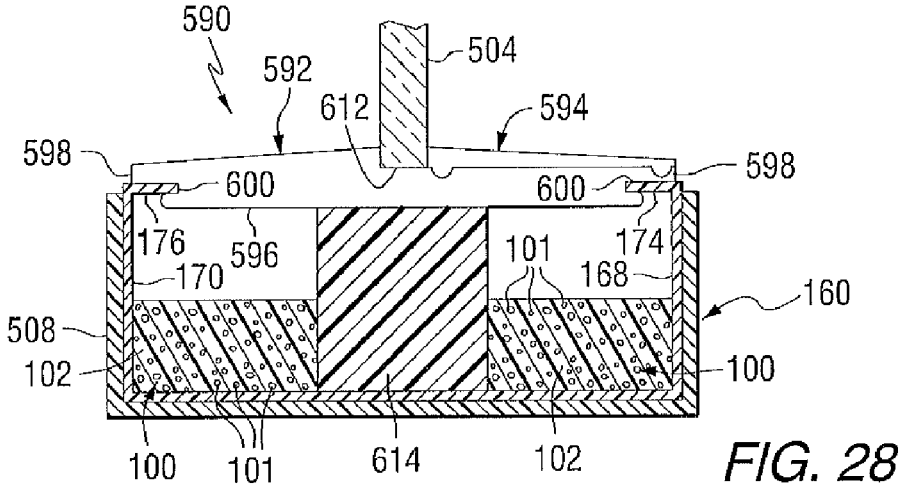

Shown in FIGS. 27 and 28 is another nonlimiting embodiment of a sheet engaging member designated by the number 590 for securing inner sheet(s) within the open area of a spacer frame, e.g. the open area 506 of the spacer frame 508 (see FIG. 27) made using the spacer stock 160 shown in FIG. 3I. The sheet-engaging member 590 has a sheet stopping member 592 and a securing or locking member 594. The sheet stopping member 592 has a support portion 596 which is captured between the extensions 174 and 176 of the spacer frame 508 as shown in FIGS. 27 and 28. Tabs 598 of the sheet stopping member 592 are support on upper portions of the extensions 174 and 176 of the spacer frame 508. The extensions 174 and 176 are received in recess 600 provided on each side of the support portion 596. The support portion 596 is sized and shaped such that moving the sheet-engaging member 590 between the extensions 174 and 176 of the spacer frame, moves the upright legs 168 and 170 of the spacer frame 508 or the spacer stock 160 apart to receive the support portion 596. Continued downward movement of the sheet engaging member 590 as viewed in FIG. 27 seats the tabs 598 of the support portion 596 on top of the extensions 174 and 176 of the spacer frame as viewed in FIGS. 27 and 28, allowing the extensions 174 and 176 of the spacer frame 508 to move into the recesses or grooves 600 of the support portion 596.

With continued reference to FIG. 27, the sheet-stopping member 592 of the sheet-engaging member 590 has an upper flat surface 602 and vertical stop surface 604 and a sloped surface 606. The locking member 594 has a pair of protrusions 608 to be captured in holes 610 in the flat surface 602 of the sheet-stopping member 592. When the locking member 594 is secured to the flat surface 602 by inserting the protrusions 608 into the holes 610 (see FIG. 27), the locking member 594 and the vertical stop surface 604 provide the sheet engaging member 590 with a groove 612 as shown in FIG. 28 to secure the intermediate sheet 504 in position within the open area 506 of the spacer frame 508 as shown in FIG. 21.

As can be appreciated, the locking member 594 can be secured to the flat surface 602 to provide the groove 612 in any usual manner. For example, the locking member 594 can be secured to the flat surface 602 by an adhesive or by application of heat to fuse the pieces together, or can be detachably secured using hole and protrusion combinations. In another nonlimiting embodiment of the invention, the securing member 594 is hinged at one end for movement toward and away from the vertical stop surface 604.

Figure 29:
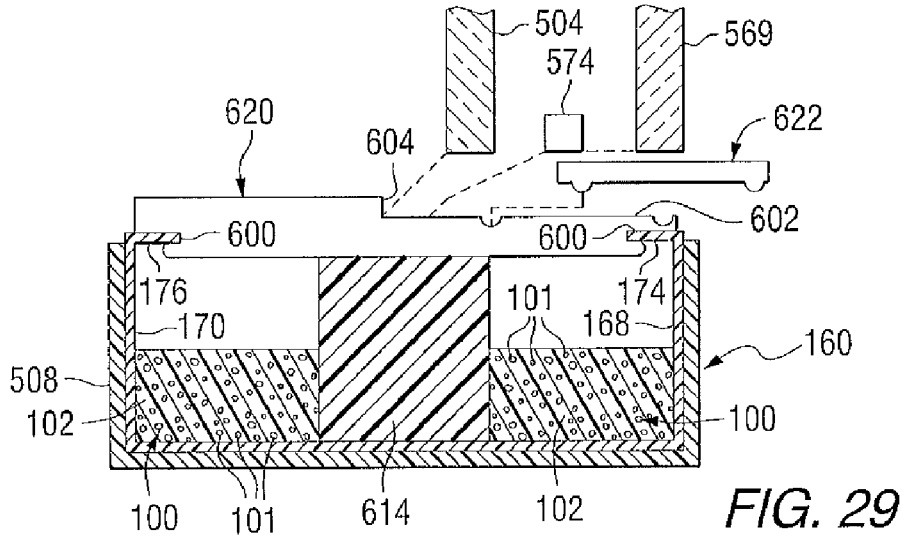

With reference to FIG. 29, there is shown a nonlimiting embodiment of the invention of a sheet-engaging member 620 for holding the two inner sheets 504 and 569 within the spacer frame 508. As shown in FIG. 29, the sheet-engaging member 620 is secured to the spacer frame as discussed above. The inner sheet 504 is moved against vertical stop 604; the sheet-separating frame 574 is moved against the sheet 504, and the sheet 569 is moved against the sheet-separating frame 574. Thereafter, the securing member 622 is secured in position as previously discussed. The outer sheets 34 and 36 are secured to outer surfaces of the spacer frame as previously discussed.

The sheet engaging members 590 and 620 can be mounted on the spacer frame 508 in any convenient manner, e.g. and not limiting to the invention in similar manners as the sheet engaging members 514, 540 and 550 (see FIGS. 23-25) were mounted to the spacer frame 508.

In the instance where the sheet engaging members are used with a U-shaped spacer frame, e.g. the spacer frame 508 made using the spacer stock 160 shown in FIG. 3I, a support shim is used when the inner sheet(s) has (have) significant weight. The support shims 531, 550 and/or 614 (see FIGS. 23, 25 and 27) can be made of any structurally stable material and are preferably made of plastic. Further as can be appreciated, the invention is not limited to the design of the shim and any shaped shim can be used to support the sheet engaging members.

Figure 30:
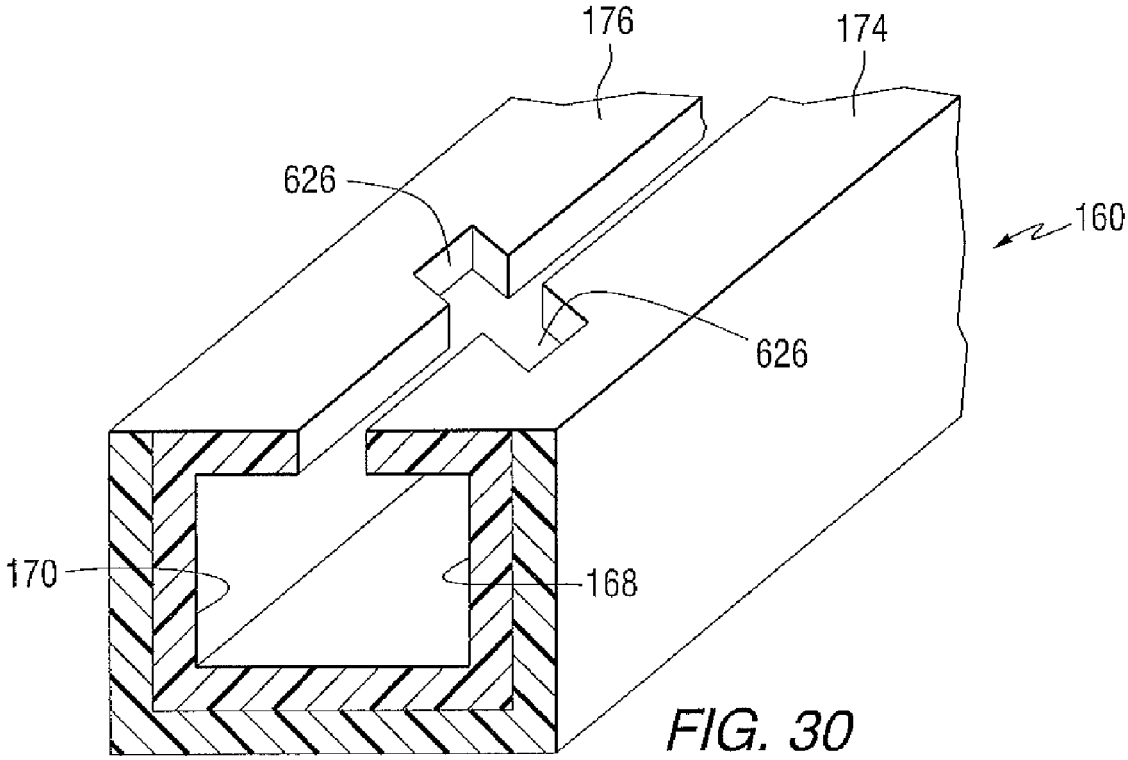
FIG. 30 is an isometric view of another nonlimiting embodiment of a spacer stock section or spacer stock segment of the invention.

With reference to FIG. 30, in another nonlimiting embodiment of the invention, the spacer frame 508 is provided with cut outs 626 in the extensions 174 and 176 to prevent or minimize any movement of the sheet engaging member 514, 590 and/or 620 along the elongated side of the spacer frame and to maintain the sheet engaging member over their respective shim 531, 552 and 614 (shims shown in FIGS. 23, 25 and 27).

The sheet-engaging members can extend along each elongated side of the spacer frame or along any selected elongated side(s) of the spacer frame. In the instance where a plurality of sheet engaging members are used along an elongated side of the spacer frame (see FIG. 21), the number of sheet engaging members should be sufficient to capture and support the inner sheet 504 in the open area 506 of the spacer frame (see FIG. 21).

For a more detailed discussion of sheet engaging members having flexible fingers, or a vertical stop and securing member forming a groove to receive one or more inner sheets, reference can be made to U.S. Pat. Nos. 6,115,989, 6,250,026 and 6,289,641 which patents are hereby incorporated by reference.

The height of the sheet engaging members 514, 550, 590 and 620 extending into the open area 506 of the spacer frame 508 is not limiting to the invention. However, as can be appreciated, the more the sheet engaging member extends into the open area, the more visible are the sheet engaging members. Further, as the distance between the edge of the inner sheet(s) and the inner surface 510 of the spacer frame 504 increases, air circulation between the sheets 36 and 38 increases, moving the insulating gas between the compartments between adjacent sheets and setting up thermal paths. SIR H975, which is incorporated by reference, has a discussion regarding the spaced distance and reference can be made thereto. Although not limiting to the invention, in one nonlimiting embodiment there is no spaced distance between the edge of the inner sheet(s) and the spacer frame to prevent air circulation. However, the invention contemplates any distance therebetween, e.g. a distance of 0 to 0.25 inches (0.635 cm) or 0.03125 inches (0.07938 cm).

As can be appreciated, the invention is not limited to the material of the sheet engaging members. For example, the sheet engaging members can be made of plastic, rubber, metal, wood, glass and/or reinforced plastic. In the practice of the invention, it is preferred that the sheet engaging members be made of plastic because it is thermally non-conductive and economic to form. Further, as can be appreciated, the sheet-engaging member can be a one piece member or a member made up of several parts. As can further be appreciated by those skilled in the art, the material of the sheet engaging members should be selected or prepared so that there is no outgassing of the material during use.

Figure 31:
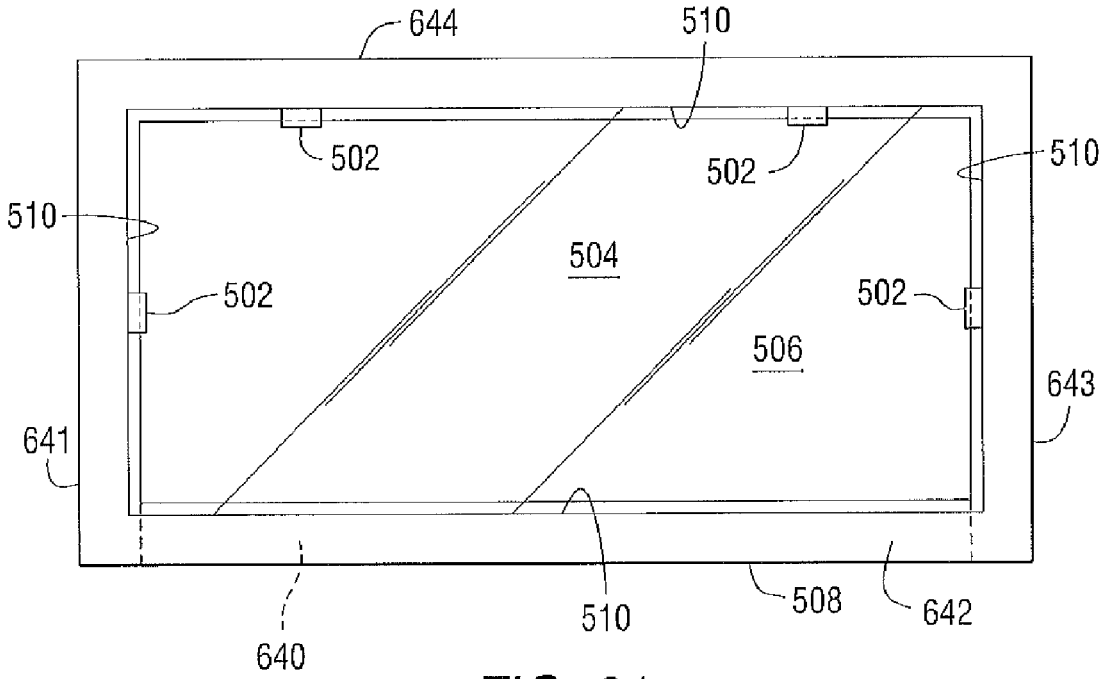
FIG. 31 is a view similar to the view of FIG. 21 showing another nonlimiting embodiment of a spacer frame of the invention having a sheet within the spacer frame.
Figure 32:
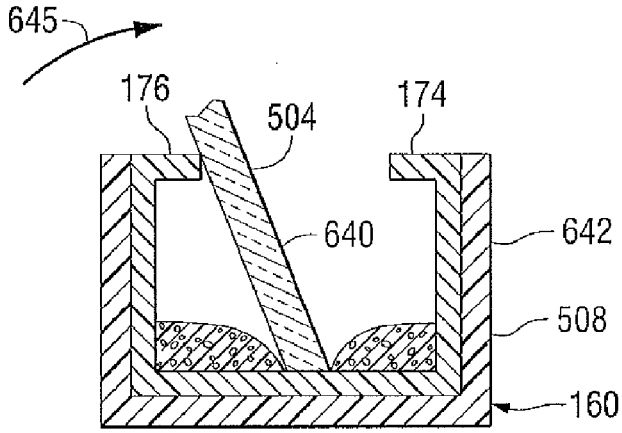
FIG. 32 is a cross sectional side view illustrating a nonlimiting embodiment of the invention to mount an inner sheet within a closed spacer frame.

With reference to FIG. 31, in the following embodiment of the invention, the inner sheet 504 is peripherally sized to position one side, e.g. side 640 (clearly shown in FIG. 32) of the inner sheet 504 between the upright sides of the spacer frame 508 and pivoted the remaining portions of the sheet through the open area 506 of the spacer frame. Sheet engaging members, e.g. of the type discussed above are used to prevent the inner sheet 504 from moving through, and to assist in securing the inner sheet within, the spacer frame. More particularly, and with reference to FIGS. 31 and 32, the spacer frame 508 having sides 641, 642, 643 and 644 is made as previously discussed from sections or segments cut from a lineal of the spacer stock 160 shown in FIG. 3I. The sheet engaging members 502, e.g. of the type discussed above are mounted on inner surface 510 of the sides 641, 643 and 644 of the spacer frame 508 as previously discussed. The side 640 of the inner sheet 504 is positioned between the extensions 174 and 176 of the side 642 of the spacer frame 508, and the sheet pivoted toward the open area 506 of the spacer frame, e.g. in the direction of arrow 645 shown in FIG. 32 to move the sides of the sheet into engagement with the sheet engaging members 502. With the inner sheet secured within the spacer frame, the outer sheets 34 and 36 are secured to outer surfaces of the spacer frame by the adhesive sealant layer 48 as previously discussed.

Figure 33:
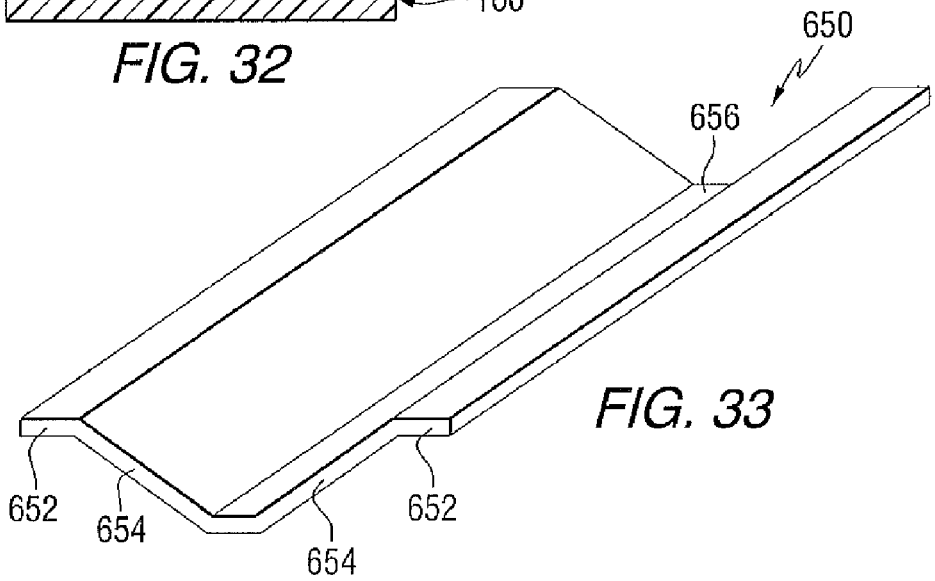
FIG. 33 is an isometric view of a nonlimiting embodiment of an edge-receiving member of the invention.
Figure 34:
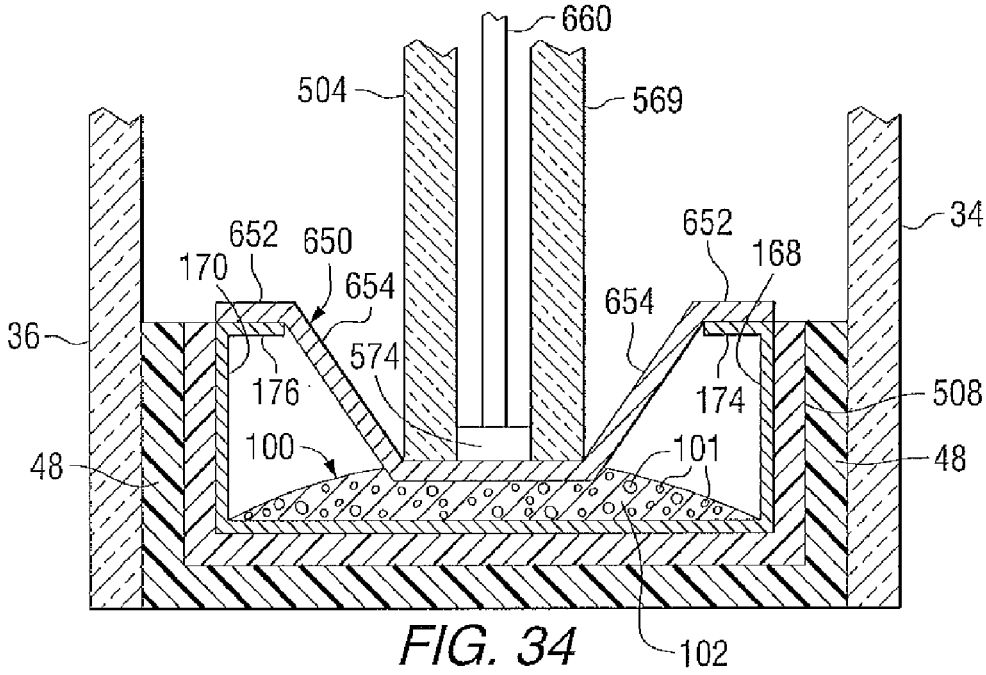
FIG. 34 is a view similar to the view of FIG. 18 showing a multi-sheet insulating unit of the invention having the edge-receiving member of FIG. 33.

With reference to FIGS. 31, 33 and 34, in another nonlimiting embodiment of the invention, edge receiving member 650 is mounted within one side of the spacer frame 508, e.g. the side 642 between the upright legs 168 and 170 of the spacer frame 508 (spacer stock 160) with horizontal members 652 of the edge receiver 652 supported on the extensions 174 and 176 of the spacer frame 508. The edge receiving member 650 has inward sloping sides 654 that meet a base 656 to support the edge of the inner sheet(s) (clearly shown in FIG. 34). As is appreciated, the edge receiver 650 can extend along the length of the side 642 of the spacer frame, or two or more edge-receiving members can be mounted along the length of the side 642.

In one nonlimiting embodiment of the invention, the depth of the edge receiving member 650, i.e. the vertical distance between the base 656 and the horizontal members 652 of the edge receiving member 650 is selected such that the bottom surface of the base 656 of the edge receiver 650 as viewed in FIG. 34 rests on, or slightly moves into, the matrix 102 of the desiccating system 100 when the horizontal members 652 of the edge receiving member 650 are seated on the extensions 168 and 170 of the spacer frame 508. In this manner, the edge of the inner sheet(s) when positioned on the base 656 of the edge receiver member 650 contacts the adhesive 102 of the desiccating system 100 with minimal, if any, sinking of the inner sheet(s) into the matrix 102 of the desiccating system.

The inner sheets 504 and 569, separated by the sheet-separating frame 574 (see FIG. 34) are positioned within the spacer frame 508 in any convention manner. In one nonlimiting embodiment of the invention, a side of the inner sheet 504 is positioned on the base 656 of the edge receiver 650 and pivoted toward and into the open area of the spacer frame into engagement with sheet engaging members 502 (shown in FIG. 31); a side of the sheet separating frame 574 is positioned on the base 656 of the edge receiver 650 and pivoted toward and into the open area of the spacer frame into engagement with the sheet engaging member 502 and into contact with the inner sheet 504, and a side of the inner sheet 569 is positioned on the base 656 of the edge receiver 650 and pivoted toward and into the open area of the spacer frame into engagement with sheet engaging members 502 and into contact with the sheet separating frame 574. After the inner sheets and the sheet separating frame are secured within the spacer frame, the outer sheets 34 and 36 are secured to the outer surface of the spacer frame 508 by the adhesive-sealant layer 48 (see FIG. 34) as previously discussed.

In the construction of multi-sheet glazing units having muntin bars, in one nonlimiting embodiment the muntin bars are provided between the outer sheets 34 and 36. With reference to FIG. 34, muntin bar 660 is shown mounted in the sheet-separating frame 574; however the invention is not limited thereto and reference can be made to U.S. Pat. No. 6,115,989 for a discussion of locating muntin bars at different positions between the outer sheets 34 and 36. The construction of muntin bars is well known to those skilled in the art of fabricating multi-sheet units and is not limiting to the invention, therefore, a more detailed discussion of the muntin bars is not deemed necessary and reference may be had to U.S. Pat. No. 6,115,989 to PPG Industries Ohio, Inc., U.S. Pat. No. 5,313,761 to Glass Equipment Development Inc. and to U.S. Pat. No. 5,099,626 to Allmetal Inc., which disclosures are hereby incorporated by reference.

Figure 35A:
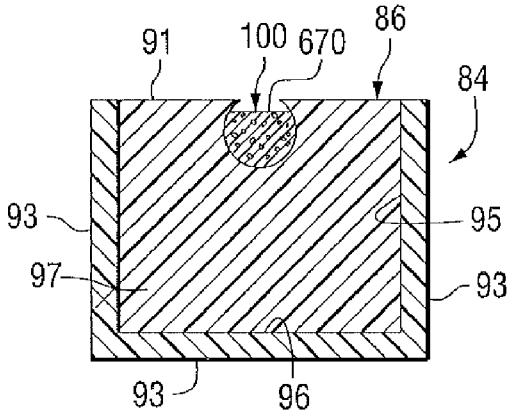
FIGS. 35A-35J are arrangements to contain desiccating systems in fluid communication with the compartment between adjacent sheets of a multi-sheet unit in accordance to the teaching of the invention.

When a section or segment of spacer stock of the type shown in FIG. 3B is used to construct a spacer frame for a multi-sheet unit, the desiccating system 100 is preferably out of the line of sight for, among other things, aesthetic reasons. Shown in FIGS. 35A-35J are nonlimiting arrangements for containing a desiccating system, e.g. and not limiting to the invention, the desiccating system 100, for aesthetic and functional reasons. More specifically, FIG. 35A shows the desiccating system 100 in a round cavity 670 in the surface 91 of the spacer stock 84 facing the sealed compartment, e.g. the compartment 58 between the sheets 34 and 36 (see FIG. 2), hereinafter also referred to as the supporting surface 91 of the spacer stock 84. The rounded cavity 670 reduces the amount of the desiccant system visible when looking through the vision area of the unit.

Figure 35B:
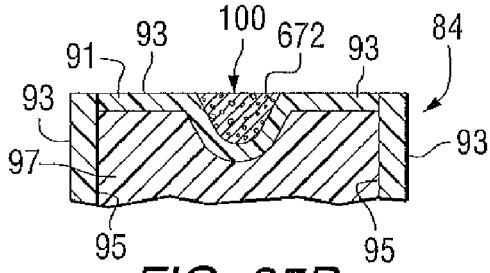
Figure 35C:
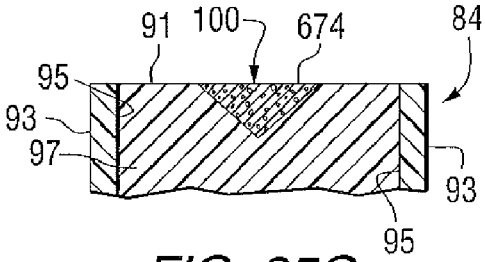
Figure 35D:
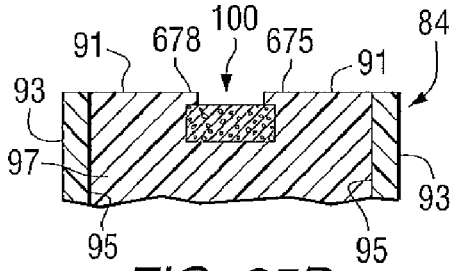
Figure 35E:
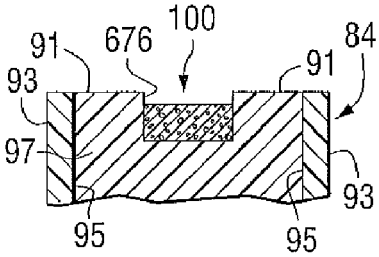

FIG. 35B shows the desiccating system 100 in a curvilinear shaped groove 672 formed in the supporting surface 91 of the spacer stock. The curvilinear shape of the groove allows for easier application of the barrier layer 93 on the supporting surface 91 of the spacer stock 84. FIG. 35C shows the desiccating system in a "V" shaped channel 674. Because of the open upward end of the channel 674, the use of nozzle tips of various shapes could be accommodated for varying the rate at which the matrix 102 of the desiccating system 100 can be applied to the channel 674. FIGS. 35D and 35E show the desiccating system 100 in a generally "U" channel 675 and 676, respectively. The channel 675 shown in FIG. 35D incorporates flaps 678 which allow insertion of a nozzle into the channel 675 and lowers the amount of the desiccating system that is visible. The channel 676 shown in FIG. 35E does not incorporate the flaps 678 and is easier to fill and hold more of the desiccant system 100.

Figure 35F:
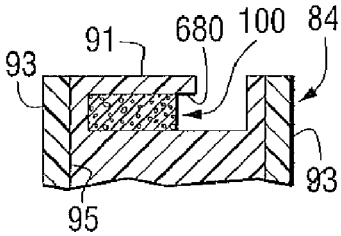
Figure 35G:
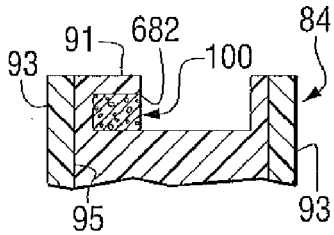

FIGS. 35F and 35G show the desiccating system 100 in side pockets 680 and 682, respectively, formed below the supporting surface 91 of the spacer stock 84. The orientation of the side pockets 680 and 682 hides the desiccating system 100, making a more aesthetically pleasing unit while providing communication between the desiccating system and the compartments between adjacent sheets. As can be appreciated the depth of the pockets 680 and 682 are not limiting to the invention and can be any depth to hold varying amounts of the desiccating system 100, e.g. the side pocket 680 shown in FIG. 35F is deeper than side pocket 682 shown in FIG. 35G, and will hold greater amounts of the desiccating system than the pocket 682. The pocket depth is a factor to be considered when the volume of the compartment between the sheets or the number of sheets increases. For example, but not limiting to the invention, more desiccating medium is required for a patio door than for a window.

Figure 35H:
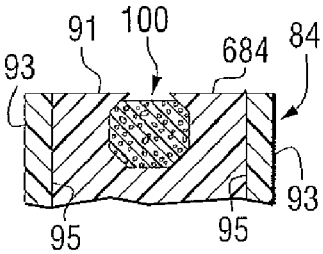
Figure 35I:
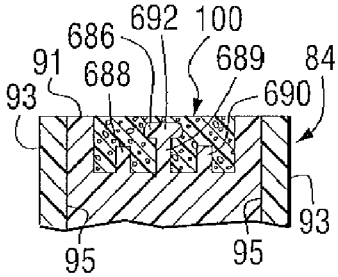
Figure 35J:
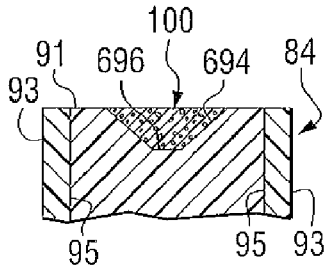

FIG. 35H shows the desiccating system 100 in a channel 684. The channel 684 is similar to the cavity 670 with the channel 684 channel having an interior faceted configuration instead of circular interior walls. The cavity 686 shown in FIG. 35I has a plurality of upright members 688-690 to increase the surface area for the matrix 102 of the desiccant system 100 to adhere to. In another nonlimiting embodiment of the invention, the upright 689 is provided with a rounded end 692 to provide additional surface area. Cavity 694 shown in FIG. 35J is similar to cavity 674 shown in FIG. 35C except that the cavity 694 has a flat bottom 696 to contain greater amounts of the desiccating system 100.

As is appreciated by those skilled in the art, when a multi-sheet unit having a sealed compartment filled with gas is transported between different altitudes, e.g. moving from valleys to mountains, the gas pressure in the compartment is different from the gas pressure acting on the outer surface of the sheets. When the difference is significant, a separation of the marginal edges of the sheets from its respective adhesive-sealant layer can occur. To maintain the difference between the gas pressure in the compartment and the gas pressure acting on the outer surfaces of the sheets at a minimum, a vent hole is provided in the spacer frame, e.g. and not limiting to the invention, the passageway 159A (see FIG. 3H) is provided. More particularly, the passageway 159A is left open so as to equalize the gas pressure inside the compartment between the sheets to the pressure outside the compartment when moving the unit between different altitudes. Once the unit arrives at its final destination, the passageway is hermetically sealed, or optionally, a desired gas is moved through the passageway into the compartment and thereafter, the passageway is hermetically sealed to retain the gas within the unit.

In those instances where it is desired to maintain the pressure in the unit equal to the pressure outside the unit, the passageway 159A is connected to a column of desiccant and the passageway remains open to move gas into and out of the unit with the gas passing through the column of desiccant.

In the fabrication of insulating units it is preferred to have dry gas in the compartment between adjacent sheets e.g. air, krypton, argon or any other type of thermally insulating gas. When air is the insulating gas, the multi-sheet unit can be fabricated in the environmental atmosphere to capture the atmosphere in the compartment between the sheets. In the instance where an insulating gas is of a particular purity or other than atmospheric air is desired in the compartment, one or more passageways 159A can be provided to move the desired gas into the compartment between adjacent sheets in any usual manner, e.g. as disclosed in U.S. Pat. No. 5,531,047, which disclosure is hereby incorporated by reference. After the compartment is filled, the passageway opening in the spacer frame is hermetically sealed.

As can be appreciated, the compartment between adjacent sheets can be open to the environment by having air into and out of the compartment through the passageways 159A, e.g. in a manner disclosed in U.S. Pat. No. 4,952,430, which patent is hereby incorporated by reference. When air is continuously moved into and out of the compartment, any coating on the surfaces of the sheets facing the compartment should be capable of being in continuous contact with the atmosphere moving through the compartment without the coating deteriorating.

The vent holes, unlike breather tubes, are usually opened as needed to equalize the pressure in the compartment to the pressure acting on the outer surfaces of the glass sheets. For an additional discussion of breather tubes reference can be made to Glass Technical Document TD-103 published by PPG Industries Inc., which document is incorporated herein by reference.

As can be appreciated, the passageway 159A can be provided in any of the spacer stocks discussed herein and the spacer frame can have one or more passageways 159A. FIGS. 10A-10C and FIG. 11 of United States Patent Application Publication No.: U.S. 2005/0028458 (hereinafter also referred to as "PAP 2005/0028458") illustrates several different breather tube designs and FIGS. 10D-10H of PAP 2005/0028458 illustrate several different vent hole designs that can be used in the practice of the present invention. As can be appreciated the invention is not limited to the breather tubes or vent holes shown in FIGS. 10 and 11 of PAP 2005/0028458 which are shown for purposes of illustration and not for purposes of limitation. United States Patent Application Publication No.: U.S. 2005/0028458 is incorporated herein by reference.

It should be appreciated that other processes can be used to form the spacer stock lineals. For example, the spacer stock lineals can be extruded on-line, e.g. adjacent the equipment to assemble the spacer frame and secure the glass sheets to the spacer frame, or off-line in an area spaced from the equipment. The invention also contemplates forming the spacer stock lineals by a pultrusion process. In a pultrusion process, fiber glass strands are typically used as reinforcement. Fiber glass strands are pulled through a die having the desired cross section and the desired polymeric material is formed around the fiber glass as it is pulled. Using this type of process, the barrier layer can also be formed over one or more surfaces the plastic core of the spacer stock lineal. More particularly, and not limiting to the invention, a barrier layer can be formed on the base as the plastic core as the core is formed, or a metal layer can be applied to the base of the plastic core as it is being formed or after it is formed. The pultrusion process is well known in the art and no further discussion is deemed necessary.

Figure 36:
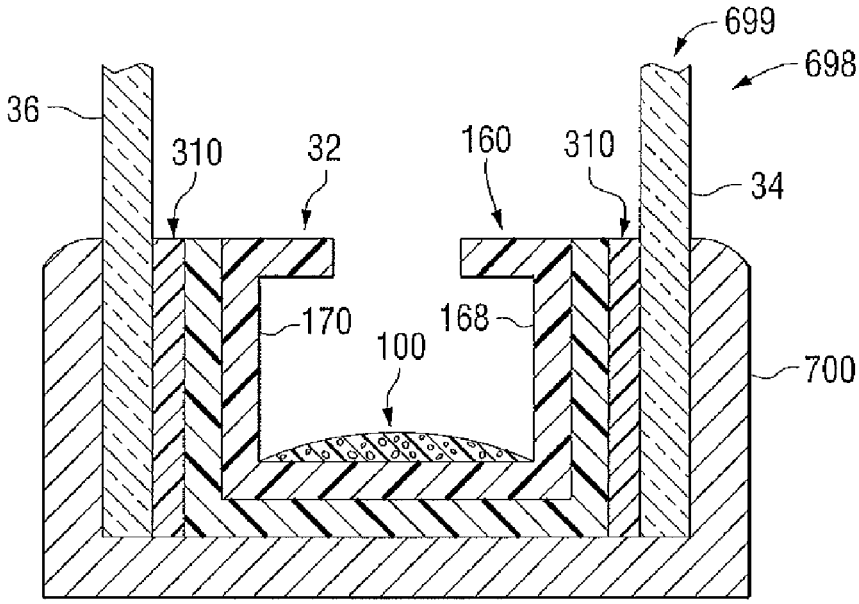
FIG. 36 is a cross sectional view of a multi-sheet unit of the invention mounted in a window sash.

Although the non-limiting embodiments of the invention were discussed to make multi sheet units which are subsequently mounted in a wooden or plastic frame or sash, e.g. and not limiting to the invention, the window 698 shown in FIG. 36 having multi sheet unit 699 mounted in the sash 700. One nonlimiting embodiment of the invention includes forming a sash having features of the spacer stocks of the invention, forming a frame from sections of the sash, and securing sheets in the sash to provide a window as shown in FIG. 37.

Figure 37:
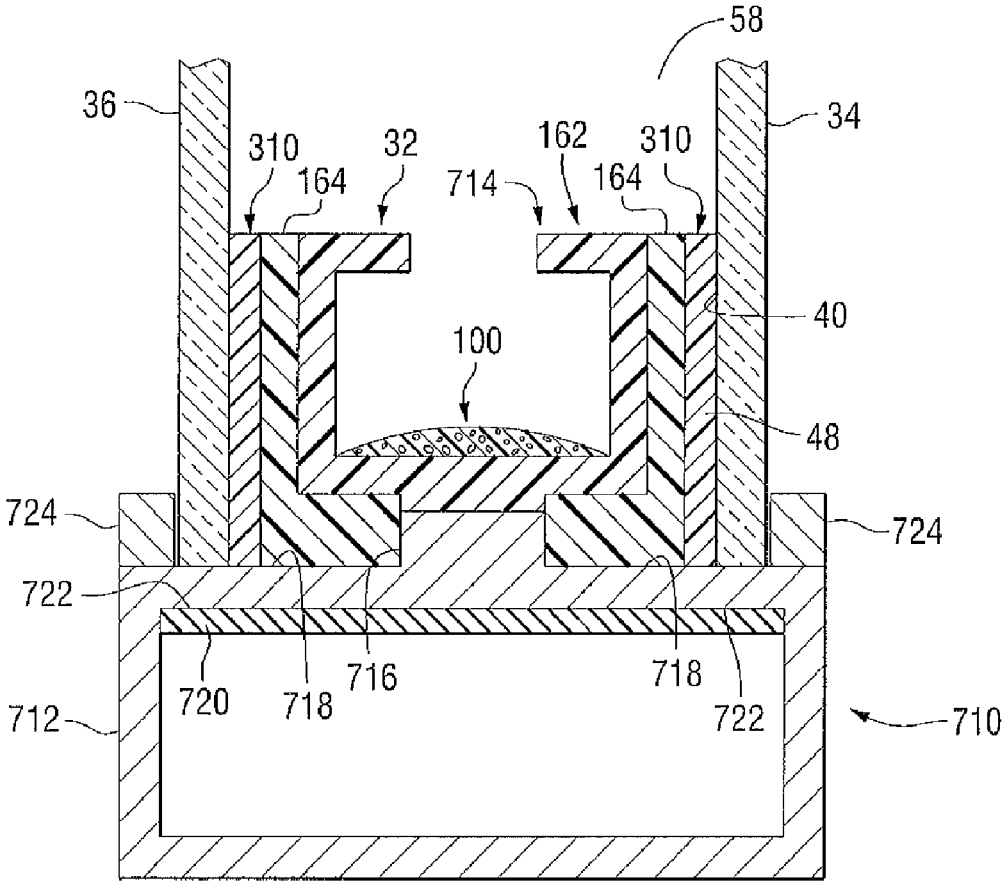
FIG. 37 is a view similar to the view of FIG. 36 showing a window or patio door of the invention.

More particularly, and with reference to FIG. 37 the sash frame 710 in cross section includes a web portion 712 have a rectangular shape joined to a spacer portion 714 similar to the spacer stock 160 shown in FIG. 3I by connecting section 716. In one nonlimiting embodiment of the invention, the spacer section includes the plastic core 162 joined to the web 712 by the connecting section 716. The barrier film 164 covers the outer surface of the plastic core 162 as discussed above for the spacer stock 160 and also covers the outer surface of the connecting section 716 and adjacent surface 718 of the web portion. In the instance when the plastic core 162 of the spacer portion 714 and the web portion 712 are made of moisture and/or gas pervious plastic, a barrier film 720 can be provided in the connecting section 716 and on inner surface portion 722 of the web portion 712. In this manner the path for moisture and/or gas to pass from the environment to the compartment 58 is limited to the moisture and/or gas pervious portion of the web portion 712 between the moisture and/or gas impervious layers 164 and 720. The sheets 34 and 36 are secured to the spacer portion 714 of the sash 710 by the adhesive-sealant layers 310 and by shims 724 securely mounted to the surface 718 of the web portion 712 and engaging outer marginal edges of the sheets 34 and 36. In another nonlimiting embodiment of the invention, inner sheets are provide in the spacer portion in any convenient manner, e.g. in the manners discussed above.

In another nonlimiting embodiment of the invention, plastic sash members, e.g. and not limiting to the invention the sash member 710 shown in FIG. 37 can have a moisture and/or gas barrier layer, e.g. and not limiting to the invention, a polyvinylidene chloride barrier layer protected against ultraviolet degradation by practicing any of the ultraviolet protection techniques discussed above.

Figure 38:
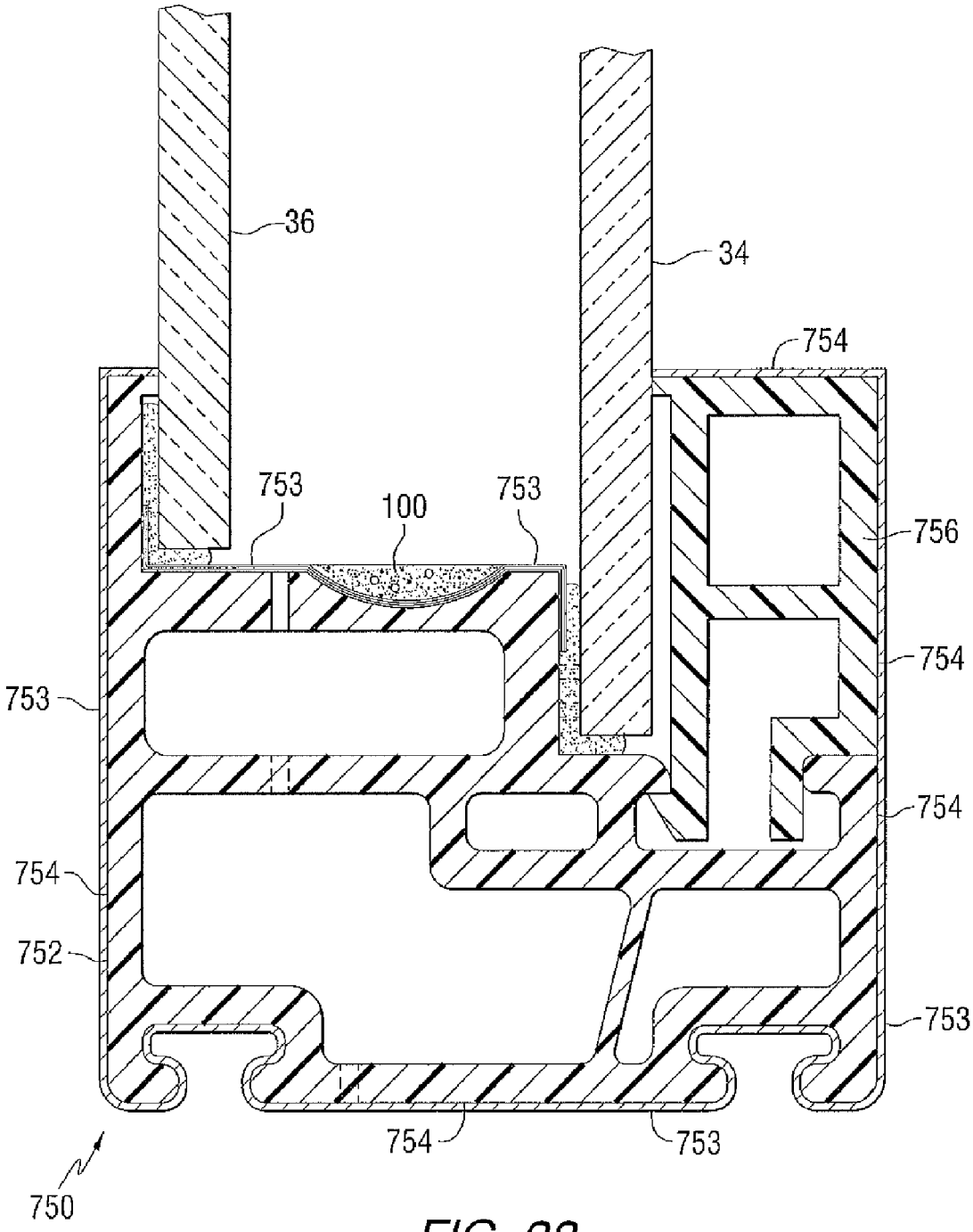
FIG. 38 is a cross sectional view of a sash member of an integrated window sash.

As can be appreciated, the nonlimiting embodiments of the invention disclosed herein can be practiced on the integrated window sash disclosed in U.S. application Ser. No. 10/874,435 filed on Jan. 23, 2004, in the names of Stephen L. Crandell et al. for "Method of Making An Integrated Window Sash"; in U.S. application Ser. No. 10/874,503 filed on Jan. 23, 2004, in the names of Barent A. Rosskamp et al. for "Integrated Window Sash With Lattice Frame And Retainer Clip": in U.S. application Ser. No. 10/874,682 filed on Jan. 23, 2004, in the names of Cory D. Steffek, et al. for "Integrated Window Sash", and in application Ser. No. 10/874,721 filed on Jan. 23, 2004, in the names of Stephen L. Crandell et al. for "Integrated Window Sash With Groove For Desiccant Material", which applications in their entirety are incorporated herein by reference. More particularly and not limiting thereto, FIG. 38 illustrates a cross section of a sash member 750 of the type discussed in and similar to FIG. 3 of the above mentioned Patent Applications, incorporating techniques of the present invention to prevent ultraviolet degradation of the barrier films. More particularly and without limiting the present invention, the integrated window sash 750 shown in FIG. 38 has the glass sheets 34 and 36 held in spaced relationship by the sash frame 752 as discussed in the above identified patent application publications. To prevent UV degradation of a barrier layer over outer surfaces of the sash frame, the sash frame has a protective film 753 over outer surface 754 of the sash frame 752 and of the sheet retaining member 756 to block or reduce ultraviolet transmission. The protective film 753 can be any of the protective films discussed herein, e.g. and not limiting thereto the protective film can be a layer of a moisture and gas impervious material, e.g. but not limited to an inorganic-organic hybrid material, and/or a layer of a material to protect against UV radiation. In one nonlimiting embodiment of the invention, the protective film 753 is clearcoat TKU1050, a two-component isocyanate containing clearcoat, and clearcoat DCT5555, a solvent-borne, thermosetting clear coat. The coatings are available from PPG Industries, Inc. and a more detailed discussion of the coatings is found in U.S. Pat. Nos. 6,762,240 B2; 6,841,641 B2, and 7,001,952 B2, which patents are hereby incorporated by reference. The coatings can be applied in any convenient manner, e.g. but not limited to spraying, rolling, curtain or flow coating and brushing.

In another nonlimiting embodiment of the invention the desiccating system 100 can be contained in any of the arrangements shown in FIGS. 35A-35J.

Based on the description of the embodiments of the invention, it can be appreciated that this invention is not limited to the particular embodiments disclosed, but it is intended to cover modifications that are within the spirit and scope of the invention, as defined by the appended claims.

What is claimed is:

1. Spacer stock for making a spacer frame for a multi-sheet unit, comprising;

a first supporting surface;

a second supporting surface opposite to, and facing away from, the first supporting surface;

a base surface between and connecting the first and second supporting surfaces; and wherein the first and second supporting surfaces and base surface are made of plastic and a rate of moisture and/or gas movement through portions of the first and second supporting surfaces is greater than a rate of moisture and/or gas movement through the base surface wherein the first sheet supporting surface is an outer surface of a first upright member, the second sheet supporting surface is an outer surface of a second upright member, the first and second upright members joined to the base to provide the spacer stock segment with a generally U-shaped cross section; the first upright member has an inner surface opposite to the outer surface; the second upright member has an inner surface opposite to the outer surface of the second member, and the base has an inner surface facing space between the first and second upright members and an opposite outer surface with a groove in the inner surface of the base, and wherein the first and second upright members at the position designed as a bend line for the at least one corner have a V-shape cut out with apex of the V-shape cut out of each of the upright members below the inner surface of the base, and the first and second upright members each comprise an extension located at the distal end of the upright members with respect to the base member and extending from the upright members toward one another over the inner surface of the base with the extension of each of the upright members continuous at the V-shaped cut out of its respective upright member.

2. The spacer stock according to claim 1, wherein the first supporting surface is an outer surface of a first supporting member; the second supporting surface is an outer surface of a second supporting member; the base surface is an outer surface of a base between and connecting the first and second supporting members, and the base has a thickness that is greater than a thickness of the first supporting member and greater than a thickness of the second supporting member.

3. The spacer stock according to claim 1, wherein the first supporting surface is an outer surface of a first supporting member; the second supporting surface is an outer surface of a second supporting member; the base surface is an outer surface of a base, the base between and connecting the first and second supporting members, and further comprising:

a moisture and gas impervious barrier layer between the outer surface and an opposite inner surface of the base.

4. The spacer stock according to claim 1, wherein the spacer stock further comprises a first end and a second end, a tab extending from the first end and sized to have a pressure fit into the second end of the spacer stock.

5. The spacer stock according to claim 1, further comprising a moisture and/or gas impervious barrier layer over the outer surface of the base.

6. The spacer stock according to claim 5, wherein the barrier layer is made of a material selected from metal, moisture and/or gas impervious plastic and combinations thereof.

7. The spacer stock according to claim 5, wherein the base comprises a flat portion, a first interconnecting portion connecting the first supporting member to the flat portion of the base and a second interconnecting portion connecting the second supporting member to the flat portion of the base and the second supporting member.

8. The spacer stock according to claim 7, wherein the shape of the first and second interconnecting portions is selected from a curved shape, a flat shape, and combinations thereof.

9. A spacer stock for making a spacer frame for a multi-sheet unit, comprising a plastic core made from a material selected from a moisture pervious material, a gas pervious material, and a moisture and gas pervious material, the plastic core comprising outer surface portions and opposite inner surface portions;

a barrier layer made from a material selected from a moisture impervious plastic material, a gas impervious plastic material, and a moisture and gas impervious plastic material, the barrier layer over selected surface portions of the plastic core; and an ultraviolet barrier layer over at least portions of the barrier layer expected to have exposure to ultraviolet radiation wherein a first sheet supporting surface is an outer surface of a first upright member, a second sheet supporting surface is an outer surface of a second upright member, the first and second upright members joined to the base to provide the spacer stock segment with a generally U-shaped cross section; the first upright member has an inner surface opposite to the outer surface; the second upright member has an inner surface opposite to the outer surface of the second member, and the base has an inner surface facing space between the first and second upright members and an opposite outer surface with a groove in the inner surface of the base, and wherein the first and second upright members at the position designed as a bend line for the at least one corner have a V-shape cut out with apex of the V-shape cut out of each of the upright members below the inner surface of the base, and the first and second upright members each comprise an extension located at the distal end of the upright members with respect to the base member and extending from the upright members toward one another over the inner surface of the base with the extension of each of the upright members continuous at the V-shaped cut out of its respective upright member.

10. The spacer stock according to claim 9, wherein the ultraviolet barrier layer is a coating selected from a two-component isocyanate containing clear coat, and a solvent-borne, thermosetting clear coat.

11. A spacer stock for making a spacer frame for a multi-sheet unit, the spacer frame having at least one corner, comprising:

an elongated plastic spacer stock segment having a predetermined length and comprising a first sheet supporting surface, an opposite second sheet supporting surface, a base between and connecting the first and second supporting surfaces, and a position designed as a bend line for the at least one corner, the position comprising a groove in the base and extending between the first and the second supporting surfaces wherein the first sheet supporting surface is an outer surface of a first upright member, the second sheet supporting surface is an outer surface of a second upright member, the first and second upright members joined to the base to provide the spacer stock segment with a generally U-shaped cross section; the first upright member has an inner surface opposite to the outer surface; the second upright member has an inner surface opposite to the outer surface of the second member, and the base has an inner surface facing space between the first and second upright members and an opposite outer surface with the groove in the inner surface of the base, wherein the spacer stock segment comprises a moisture and/or gas pervious plastic core and a moisture and/or gas impervious barrier layer over selected portions of the first and second supporting surfaces and outer surface of the base, and wherein the first and second upright members at the position designed as a bend line for the at least one corner have a V-shape cut out with apex of the V-shape cut out of each of the upright members below the inner surface of the base, and the first and second upright members each comprise an extension located at the distal end of the upright members with respect to the base member and extending from the upright members toward one another over the inner surface of the base with the extension of each of the upright members continuous at the V-shaped cut out of its respective upright member.

12. The spacer stock according to claim 11, wherein the first and second upright members at the position designed as a bend line for the at least one corner each have a V-shape cut out with apex of the V-shape cut out of each of the upright members below the inner surface of the base.

13. The spacer stock according to claim 12, wherein one sloping side of the V-shape cut outs of the upright members has a tab and other opposite sloping side of the V-shape cut outs has a receiving portion to receive the tab when the spacer stock segment is bent to form the at least one corer.

14. The spacer stock according to claim 11, wherein the first and second upright members at the position designed as a bend line for the at least one corner have a cut out comprising a portion of each of the upright members spaced from the base removed and portion of each of the upright members between the removed portion and the base having bend lines having a V-shape with apex of the V-shape below the inner surface of the base.

* * * * *